US008647171B2

(12) United States Patent
Duescher

(10) Patent No.: US 8,647,171 B2
(45) Date of Patent: Feb. 11, 2014

(54) FIXED-SPINDLE FLOATING-PLATEN WORKPIECE LOADER APPARATUS

(76) Inventor: Wayne O. Duescher, Roseville, MN (US)

( * ) Notice: Subject to any disclaimer, the term of this patent is extended or adjusted under 35 U.S.C. 154(b) by 682 days.

(21) Appl. No.: 12/807,765

(22) Filed: Sep. 14, 2010

(65) Prior Publication Data

US 2011/0223837 A1 Sep. 15, 2011

Related U.S. Application Data

(63) Continuation-in-part of application No. 12/807,802, filed on Sep. 14, 2010, which is a continuation-in-part of application No. 12/799,841, filed on May 3, 2010, now Pat. No. 8,602,842, which is a continuation-in-part of application No. 12/661,212, filed on Mar. 12, 2010.

(51) Int. Cl.
*B24B 7/22* (2006.01)
*B24B 53/00* (2006.01)

(52) U.S. Cl.
USPC ..... 451/11; 451/5; 451/288

(58) Field of Classification Search
USPC ..... 451/11, 28, 36, 37, 41, 59, 64, 259, 451/260, 270, 271, 280, 283, 285, 288
See application file for complete search history.

(56) References Cited

U.S. PATENT DOCUMENTS

| | | | |
|---|---|---|---|
| 1,989,074 | A | 1/1935 | Bullard |
| 2,410,752 | A | 11/1946 | Sells et al. |
| 2,696,067 | A | 12/1954 | Leach |
| 2,973,605 | A | 3/1961 | Carman et al. |
| 2,979,868 | A | 4/1961 | Emeis |
| 3,342,652 | A | 9/1967 | Reisman et al. |
| 3,475,867 | A | 11/1969 | Walsh |
| 3,662,498 | A | 5/1972 | Caspers |
| 4,104,099 | A | 8/1978 | Scherrer |
| 4,165,584 | A | 8/1979 | Scherrer |
| 4,256,535 | A | 3/1981 | Banks |
| 4,315,383 | A | 2/1982 | Day |
| 4,588,473 | A | 5/1986 | Hisatomi et al. |
| 4,593,495 | A | 6/1986 | Kawakami et al. |
| 4,720,938 | A | 1/1988 | Gosis |
| 4,735,679 | A | 4/1988 | Lasky |
| 4,910,155 | A | 3/1990 | Cote et al. |

(Continued)

OTHER PUBLICATIONS

International Search Report from related International Application No. PCT/US2011/028088 (13 sheets).

*Primary Examiner* — Robert Rose
(74) *Attorney, Agent, or Firm* — Mark A. Litman & Associates, P.A.

(57) ABSTRACT

A method and apparatus for robotic devices that can be used to load and remove workpieces and abrasive disks for an abrading system having a floating, rotatable abrading platen that is three-point supported by annular, flat abrading-surface of the floating platen. The rotary spindles are mounted on the flat horizontal surface of a machine base and the spindle-top flat surfaces are aligned to be precisely co-planar with each other where the rotational-centers of each of the spindles fixed-position rotary flat-surfaced spindles. The flexible abrasive disks are releasably attached to the are positioned at the center of the annular radial-width of the platen abrading-surface. Flat-surfaced workpieces are attached to the spindle-top flat surfaces and the abrasive surface of the abrasive disk that is attached to the rotating floating-platen abrading surface contacts the workpieces to perform single-sided abrading on the workpieces. Workpieces can be flat-lapped to provide precision-flat and smoothly-polished surfaces.

20 Claims, 13 Drawing Sheets

(56) References Cited

U.S. PATENT DOCUMENTS

| | | | |
|---|---|---|---|
| 4,918,870 | A | 4/1990 | Torbert et al. |
| 5,014,468 | A | 5/1991 | Ravipati et al. |
| 5,032,544 | A | 7/1991 | Ito et al. |
| 5,137,542 | A | 8/1992 | Buchanan et al. |
| 5,191,738 | A | 3/1993 | Nakazato et al. |
| 5,205,082 | A | 4/1993 | Shendon et al. |
| 5,274,960 | A | 1/1994 | Karlsrud |
| 5,314,513 | A | 5/1994 | Miller et al. |
| 5,364,655 | A | 11/1994 | Nakamura et al. |
| 5,422,316 | A | 6/1995 | Desai et al. |
| 5,454,844 | A | 10/1995 | Hibbard et al. |
| 5,456,627 | A | 10/1995 | Jackson et al. |
| 5,538,460 | A | 7/1996 | Onodera |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,833,519 | A | 11/1998 | Moore |
| 5,840,629 | A | 11/1998 | Carpio |
| 5,857,898 | A | 1/1999 | Hiyama et al. |
| 5,860,847 | A | 1/1999 | Sakurai et al. |
| 5,863,306 | A | 1/1999 | Wei et al. |
| 5,882,245 | A | 3/1999 | Popovich et al. |
| 5,910,041 | A | 6/1999 | Duescher |
| 5,916,009 | A | 6/1999 | Izumi et al. |
| 5,938,506 | A | 8/1999 | Fruitman et al. |
| 5,964,651 | A | 10/1999 | Hose |
| 5,967,882 | A | 10/1999 | Duescher |
| 5,972,792 | A | 10/1999 | Hudson |
| 5,975,997 | A | 11/1999 | Minami |
| 5,981,454 | A | 11/1999 | Small |
| 5,989,104 | A | 11/1999 | Kim et al. |
| 5,993,298 | A | 11/1999 | Duescher |
| 6,001,008 | A | 12/1999 | Fujimori et al. |
| 6,007,407 | A | 12/1999 | Rutherford et al. |
| 6,022,266 | A | 2/2000 | Bullard et al. |
| 6,048,254 | A | 4/2000 | Duescher |
| 6,077,153 | A | 6/2000 | Fujita et al. |
| 6,089,959 | A | 7/2000 | Nagahashi |
| 6,102,777 | A | 8/2000 | Duescher et al. |
| 6,120,352 | A | 9/2000 | Duescher |
| 6,139,428 | A | 10/2000 | Drill et al. |
| 6,149,506 | A | 11/2000 | Duescher |
| 6,165,056 | A | 12/2000 | Hayashi et al. |
| 6,168,506 | B1 | 1/2001 | McJunken |
| 6,217,433 | B1 | 4/2001 | Herrman et al. |
| 6,273,786 | B1 | 8/2001 | Chopra et al. |
| 6,371,838 | B1 | 4/2002 | Holzapfel |
| 6,398,906 | B1 | 6/2002 | Kobayashi et al. |
| 6,425,809 | B1 | 7/2002 | Ichimura |
| 6,439,965 | B1 | 8/2002 | Ichino et al. |
| 6,506,105 | B1 | 1/2003 | Kajiwara et al. |
| 6,520,833 | B1 | 2/2003 | Saldana et al. |
| 6,607,157 | B1 | 8/2003 | Duescher |
| 6,632,127 | B1 | 10/2003 | Zimmer et al. |
| 6,652,764 | B1 | 11/2003 | Blalock |
| 6,702,866 | B2 | 3/2004 | Kamboj |
| 6,752,700 | B2 | 6/2004 | Duescher |
| 6,769,969 | B1 | 8/2004 | Duescher |
| 6,786,810 | B2 | 9/2004 | Muilenberg et al. |
| 6,893,332 | B2 | 5/2005 | Castor |
| 6,896,584 | B2 | 5/2005 | Perlov et al. |
| 6,899,603 | B2 | 5/2005 | Homma et al. |
| 6,935,013 | B1 | 8/2005 | Markevitch et al. |
| 7,001,251 | B2 | 2/2006 | Doan et al. |
| 7,008,303 | B2 | 3/2006 | White et al. |
| 7,014,535 | B2 | 3/2006 | Custer et al. |
| 7,029,380 | B2 | 4/2006 | Horiguchi et al. |
| 7,033,251 | B2 | 4/2006 | Elledge |
| 7,044,838 | B2 | 5/2006 | Maloney et al. |
| 7,125,313 | B2 | 10/2006 | Zelenski et al. |
| 7,144,304 | B2 | 12/2006 | Moore |
| 7,147,541 | B2 | 12/2006 | Nagayama et al. |
| 7,166,016 | B1 | 1/2007 | Chen |
| 7,214,125 | B2 | 5/2007 | Sharples et al. |
| 7,250,368 | B2 | 7/2007 | Kida et al. |
| 7,276,446 | B2 | 10/2007 | Robinson et al. |
| 7,357,699 | B2 | 4/2008 | Togawa et al. |
| 7,364,495 | B2 | 4/2008 | Tominaga et al. |
| 7,367,867 | B2 | 5/2008 | Boller |
| 7,393,790 | B2 | 7/2008 | Britt et al. |
| 7,422,634 | B2 | 9/2008 | Powell et al. |
| 7,446,018 | B2 | 11/2008 | Brogan et al. |
| 7,449,124 | B2 | 11/2008 | Webb et al. |
| 7,456,106 | B2 | 11/2008 | Koyata et al. |
| 7,470,169 | B2 | 12/2008 | Taniguchi et al. |
| 7,491,342 | B2 | 2/2009 | Kamiyama et al. |
| 7,507,148 | B2 | 3/2009 | Kitahashi et al. |
| 7,520,800 | B2 | 4/2009 | Duescher |
| 7,527,722 | B2 | 5/2009 | Sharan |
| 7,582,221 | B2 | 9/2009 | Netsu et al. |
| 7,585,425 | B2 | 9/2009 | Ward |
| 7,588,674 | B2 | 9/2009 | Frodis et al. |
| 7,614,939 | B2 | 11/2009 | Tolles et al. |
| 7,632,434 | B2 | 12/2009 | Duescher |
| 7,635,291 | B2 | 12/2009 | Muldowney |
| 7,648,409 | B1 | 1/2010 | Horiguchi et al. |
| 2005/0118939 | A1 | 6/2005 | Duescher |
| 2008/0182413 | A1 | 7/2008 | Menk et al. |
| 2008/0299875 | A1 | 12/2008 | Duescher |
| 2010/0003904 | A1 | 1/2010 | Duescher |

*Fig. 25*
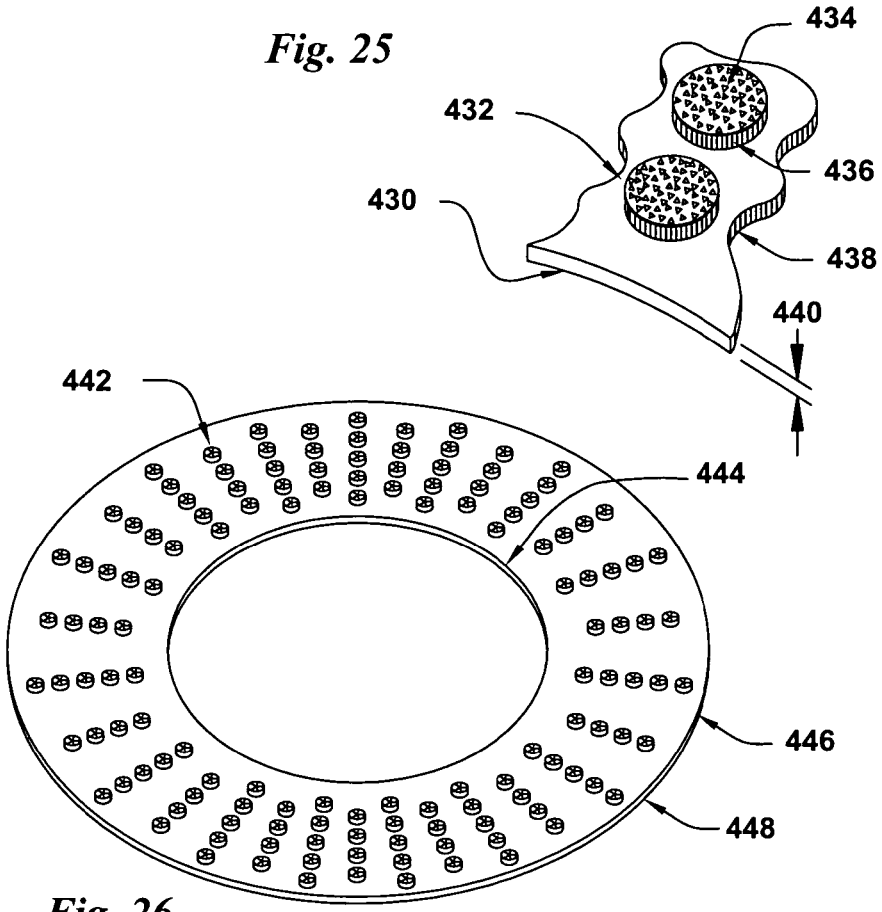
*Fig. 26*
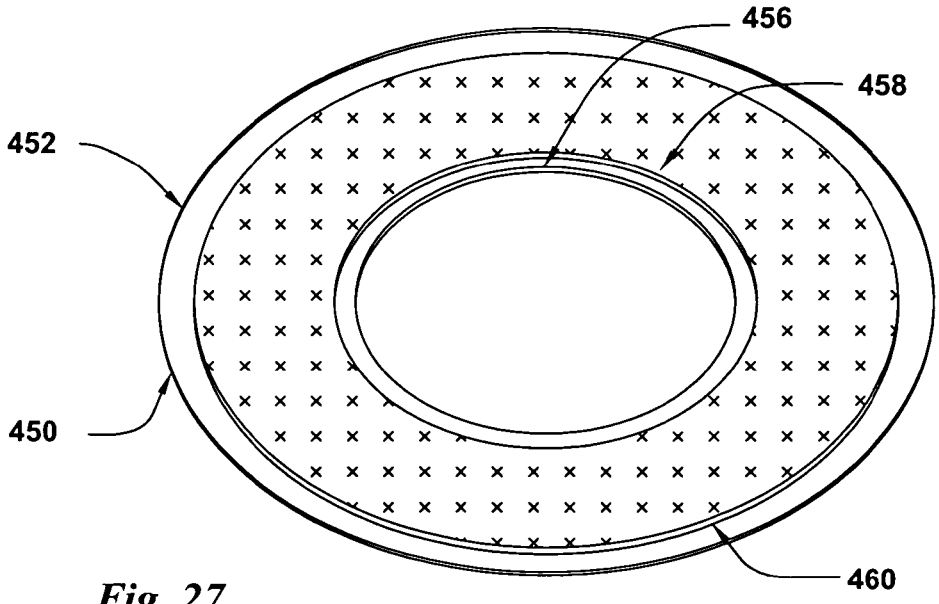
*Fig. 27*

FIXED-SPINDLE FLOATING-PLATEN WORKPIECE LOADER APPARATUS

CROSS REFERENCE TO RELATED APPLICATION

This invention is a continuation-in-part of the U.S. patent application Ser. No. 12/807,802, filed Sep. 14, 2010, which is a continuation-in-part of the U.S. patent application Ser. No. 12/799,841 filed May 3, 2010 now U.S. Pat. No. 8,602,842 and which is a continuation-in-part of the U.S. patent application Ser. No. 12/661,212 filed Mar. 12, 2010.

BACKGROUND OF THE INVENTION

Field of the Invention

The present invention relates to the field of abrasive treatment of surfaces such as grinding, polishing and lapping. This is a high speed lapping system that provides simplicity, quality and efficiency to existing lapping technology using a rotary abrasive floating platen having an attached flexible abrasive disk that is supported by multiple fixed-position rotary workpiece spindles that are mounted on a dimensionally stable machine base. In particular, the present invention relates to automated workpiece and abrasive disk loading apparatus devices.

Fixed-Spindle-Floating-Platen System

The present invention relates to methods and devices for a single-sided lapping machine that is capable of flat-lapping ultra-thin semiconductor wafer workpieces at high abrading speeds. This is done by providing a nominally-flat granite machine base that is used as the stable support for three rigid flat-surfaced rotatable equal-height workpiece spindles that are attached to the machine base. Each of the three near-equal-spaced rotary spindles form a stable three-point support of the rotary platen. The spindles have flat-surfaced rotary spindle-tops that are aligned to be precisely co-planar with each other. The co-planar flat surfaces of the spindle-tops are precisely co-planar with the precision-flat platen abrading-surface of a rotary platen when the platen conformably contacts the spindle-tops. Precision-thickness flexible abrasive disks having annular bands of abrasives are attached to the rigid precision-flat abrading-surface of the rotary platens that float in three-point abrading contact with the three equal-spaced flat-surfaced rotatable workpiece spindles. Water coolant is used with abrasive disks having abrasive coated raised island abrasive.

The fixed-spindle-floating-platen abrading system has many unique features that allow it to provide flat-lapped precision-flat and smoothly-polished thin workpieces at high abrading speeds. Here, the top flat surfaces of the equal-height rotary spindles are in a common plane that is approximately parallel with the granite flat-reference surface. Each of the three rigid spindles is positioned with equal spacing between them to form a triangle of platen spindle-support locations.

The fixed-spindle-floating platen system can be used at high abrading speeds to produce precision-flat and mirror-smooth workpieces at very high production rates. There is no abrasive wear of the platen surface because it is protected by the attached flexible abrasive disks. A minimum of three spindles are used to support the floating platen but more spindles can be added to the three spindles to provide additional workpiece abrading workstations. However, all of the spindle top flat surfaces must be precisely positioned in a common plane.

Air-Bearing Flat-Surfaced Spindles

This fixed-spindle-floating-platen system is particularly suited for flat-lapping large-sized workpieces that must be extremely flat and also have extremely smooth polished surfaces such as large-diameter semiconductor wafers. Here, high-value large-sized workpieces such as 12 inch diameter (300 mm) semiconductor wafers can be attached to ultra-precise flat-surfaced air bearing spindles for precision lapping. Ultra-precise air bearing spindles can be mounted on structurally-stable granite bases to provide the desired ultra-flat workpieces. The high—speed spindles and other components can be easily assembled to construct these lapper machines that can be operated at high lapping speeds. Ultra-precise 12 inch diameter air bearing spindles provide flat rotary mounting surfaces for flat workpieces. These spindles provide flatness accuracy of 5 millionths of an inches (or less) during rotation, are very stiff in resisting abrading load deflections and can support loads of 900 lbs. A typical air bearing spindle having a stiffness of 4,000,000 lbs/inch is more resistant to deflections from abrading forces than a spindle having steel roller bearings. The weight of a single 12 inch diameter spindle is typically 130 lbs and the required set of three spindles weighs 390 lbs. Air bearing spindles are preferred because of the precision flatness of the spindle surfaces at all abrading speeds. Commercial 12 inch (300 mm) diameter ultra-flat air bearing spindles, weighing approximately 85 lbs, are available from the Nelson Air Corp, Milford, N.H.

Non-Precision-Flat Granite Machine Bases

Thick-section granite bases that have flat surfaces, structural stiffness and dimensional stability to support these heavy air bearing spindles without distortion are also commercially available. Fluid passageways in the granite bases can allow the circulation of heat transfer fluids that thermally stabilize them to provide long-term dimensional stability of the nominally-flat granite bases. Floating platens having precision-flat planar annular surfaces that are dimensionally stable can also be fabricated or readily purchased.

Granite is the material-of-choice for machine bases because they provide time-stable reference surfaces that can be maintained in a dimensionally stable condition. Epoxy-granite is another machine based material that is used. These granite bases are used for precision motion machine tools or component inspection or component measurement devices such as coordinate measurement machines (CMM). Relatively inexpensive flat-surfaced granite bases are often provided which have nominally-flat surfaces. Granite surface plates can also be purchased that have precision-flat surfaces which allows them to be used in laboratories, as inspection plates or for precision-motion machine bases.

However, there are a number of issues related to these precision-flat granite bases. First, the lapping process that is required to create a precision-flat surface on a flat-surfaced granite base is time consuming and expensive. Granite bases having nominally-flat surfaces are typically abraded by abrading machines to produce that flatness. These nominally-flat or non-precision-flat granite bases often have surface flatness variations that exceed 0.0005 inches which is much larger than the often-required 0.0001 inch variations. It is typically necessary to hand-lap the flat surfaces of granite bases to produce precision-flat surfaces that have a surface flatness variation of less than 0.0001 inches over the surfaces of large sized granite bases. These precision-flat granite bases are expensive because the required hand lapping is an expensive and time consuming process compared to machine abrading. Further, the granite base must be provided with a three-point support when this surface lapping procedure is done. This same three-point support must be maintained throughout the life of the granite base to maintain this original precision-flatness. If the support system of the granite base is changed, the granite base will distort and the granite surface will no longer have the required precision-flat surface.

The flatness accuracy of precision-flat granite bases that can be used in applications requiring precision-flat surfaces often have an allowable flatness tolerance variation of 0.0001 inches across the full surface of the granite base. Large granite bases that have this precision-flatness over long granite base surface spans require larger granite base purchase investments because of the addition costs of process required for surface-measuring and flat-lapping them. This precision-flat granite surface accuracy has been required for some workpiece flat-lapping machines that are used to successfully perform high speed flat-lapping. This same 0.0001 inch surface variation precision-flatness tolerance is required for the abrading-surfaces of the rotary platens to which the precision-thickness abrasive disks are attached that are also used in the high speed lapper system. Often, the larger size of the granite bases that are required for use with typical 3 or 4 foot diameter raised island abrasive disks (or larger) results in the purchase of very expensive precision-flat granite bases to achieve this 0.0001 inch granite surface precision-flatness. Granite base are available from the Tru-Stone Division of the Starrett Company at Waite Park, Minn.

Developing techniques to successfully use non-precision-flat, but dimensionally stable, granite bases is very desirable. The rotary spindle mounting system described here can utilize these non-precision-flat granite bases. The precision-flat workpiece spindles can be mounted to these non-precision-flat granite bases where all of the spindle-tops are precisely aligned to be precisely co-planar with each other within 0.0001 inches, This provides significant cost savings and abrading performance advantages for these non-precision-flat granite base abrading systems.

Spindle-Top Alignment of Spindles Mounted on a Non-Precision-Flat Machine Base

The three-point fixed-spindles can also be attached to the horizontal flat surface of a rigid machine base where the nominally-flat machine base surface is not precisely flat. By precisely aligning all three of the flat-surfaced spindle tops in a common plane, these rotary co-planar spindle tops can be used to perform precision flat lapping or other types of precision abrading. Each of the three (or more) rotary workpiece spindles have three (or more) spindle mounting legs that form a three-point support of each spindle. These three spindle legs are spaced equal distances around the outer periphery of the stationary rotary-spindle bodies to form a three-point triangle support of the spindle. The spindles are rigidly attached to a spherical rotor that is mounted in a matching spherical base where both the rotor and the base share a common spherical diameter. The spindles are attached to the spindle spherical rotor with threaded fasteners at each of the three spindle legs and the spindle spherical bases are attached to the top nominally-flat top surface of the machine base. Here, the top flat surfaces of the three rigid-body flat-topped spindles are positioned in a common plane by rotating the spindle spherical rotor while the rotor is mounted in the matching spindle spherical base.

To precisely align all three spindle top flat surfaces in a common plane, a number of different spindle alignment procedures can be followed. In one spindle alignment procedure, a first of the three spindles is attached to a rotor that is mounted in a spherical base that is attached to the rigid and structurally-stable machine base where the spindle rotatable top portion flat top surface is approximately parallel to the nominally-flat machine base. Then, spherical rotor rotations are independently made at each of the three rotary to allow co-planar alignment of all of the spindle-top flat surfaces with the use of spindle-top surface-flatness alignment instruments.

This precision co-planar alignment of all the spindles is completely independent of the localized non-flat defect-type contours of the machine base nominally-flat (non-precision-flat) top horizontal surface.

Another spindle-top alignment technique is to contact the spindle-top flat surfaces of the floating spindles that are attached to the spherical rotors with the precision-flat surface of a platen to allow the spindle tops to assume the precision-flatness of the platen abrading surface. The spindles can be vibrated during the alignment procedure to assure that the spindle-tops are conformably seated with the platen abrading surface. Also, pressurized air can be applied to the common contact surfaces of the flat spindle-tops and the platen flat abrading surface to act as a low-friction air-gap between the platen abrading surface and the spindle-tops. This pressurized air aids the conformal alignment of the spindle-top's flat surfaces with the platen abrading-surface. Here, the weight of the near-horizontal platen abrading-surface contacting the near-horizontal flat spindle-tops can help the alignment procedure where the pressurized air pressure is progressively diminished to allow the heavy platen abrading-surface to be in direct contact with the spindle-tops. After spindles are aligned to be precisely co-planar with each other they are fixtured in these aligned positions to the granite nominally-flat surface. Even though the flat surfaces of the spindle-tops are not precisely co-planar with the nominally-flat granite base surface, all of the spindle-top's flat surfaces are precisely co-planar with each other.

Three equally-spaced primary spindles are typically used to provide three-point support of the platen. However, auxiliary spindles can be mounted on the nominally-flat granite base between the primary spindles using the spherical rotor/base mounting devices. During alignment, the elevation of the auxiliary spindles are adjusted to allow the flat surfaces of the auxiliary spindle-tops to be aligned to be precisely co-planar with flat surfaces of the primary spindle-tops.

Co-Planar Spindle-Tops Surfaces are the Primary Abrading System Reference

The plane formed by the co-planar flat top surfaces of all the spindles is the primary reference plane for this abrading system. All alignments of the abrading system components are dependent on this precision spindle-top reference plane. Any changes of the abrading system components, such as spindle replacements, must have their critical alignments reestablished relative to this reference plane. Here, the granite base provides a stable mounting surface for all these spindles so they retain their co-planar alignment once it is established. However, the abrading system component alignment is not dependent on the precision flatness of the surface of the granite base.

Flat Lapping 300 mm Semiconductor Wafers

This fixed-spindle-floating-platen system is particularly suited for precision flat-lapping large diameter semiconductor wafers. High-value large-sized workpieces such as 12 inch diameter (300 mm) semiconductor wafers can be attached to the ultra-precise flat-surfaced air bearing spindles for precision lapping. Ultra-precise 12 inch (300 mm) diameter air bearing spindles provide flat rotary mounting surfaces for the flat-surfaced 12 inch (300 mm) diameter semiconductor wafers. The 5 millionths of an inches flatness accuracy of the air bearing spindles provide support for the wafers to produce highly-desired extremely-flat surfaces on these wafers. Because the air bearing spindles are so stiff, there is little spindle-top distortion from abrading forces when the spindles are rotated, at all rotation speeds.

Use of time-stable nominally-flat lapper machine granite bases that are maintained in a dimensionally stable condition allows the use of the equal-height rigid rotatable workpiece air bearing spindles to provide spindle-top workpiece mounting surfaces that are in a common plane. The multiple workpieces are in abrading contact with a floating rotary platen that also has a precision-flat annular abrading surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

This fixed-spindle-floating-platen system is uniquely capable of providing precision flat lapping of workpieces using rigid lapping machine components at high abrading speeds and high productivity. Because all of the machine components are rigid (including the floating platen), it is required that each abrading component has a precision-flat characteristic. Then, when all of these components are used together, they provide uniform abrading to the surfaces of spindle-mounted workpieces that are simultaneously contacted by a platen planar abrading surface. It is particularly important that all of the individual workpiece surfaces are individually and collectively co-planar with each other. Here, even the raised-island abrasive disks have a uniform precision-thickness over the full annular abrading surface of the disk. This results in both the abrasive surface of the disk and the opposite disk-backing mounting surface being precisely co-planar with each other.

Rigid Workpiece Spindles and Flexible Raised-Island Abrasive Disks

In addition, the flexible raised-island abrasive disks having thin and flexible backings are rigid in a direction that is perpendicular to the disk flat abrading surface. An analogy here is a flexible piece of sheet metal that can be easily flexed out-of-plane but yet provides rigid and stiff load-carrying support for flat-surfaced components that are placed in flat-faced contact with the sheet metal flat surface. Vacuum-attached abrasive disks are flexible so they will conform to the flat surfaces of the platens. The raised-island abrasive disks are constructed from thin but structurally-stiff backing materials and the island structures are also constructed from structurally-stiff construction materials to assure that the abrasive coated island disks are not resilient. The abrasive disks do not distort locally due to abrading forces.

The abrasive disk backing materials are flexible to allow the abrasive disks to conform to the flat abrading surfaces of the platens where the disk can be firmly attached to the platen with vacuum. The disk backings have a continuous and smooth platen-attachment surface that provides an effective seal for the vacuum when the disk is attached to the smooth flat abrading surface of the platen. Abrasive disks can have a continuous backing surface over the full diameter of the disk where the abrasive is coated in an annular band on the disk backing. Also, the abrasive disks can have an annular shape where the disk backing has a open central area at the disk center and the abrasive is coated in an annular shape on the annular backing.

When very thin and flexible abrasive disk backings are sometimes used in the construction of large-diameter raised-island abrasive disks, it is possible that these large abrasive disks can be ripped or torn in the event when a sharp-edged workpiece is inadvertently forced at an angle into contact with this somewhat fragile abrasive disk. Abrasive disks that are constructed with thick and tough backing materials, including laminations of flexible sheets of metal and sheets of fiber materials tend to eliminate or reduce the possibility of disk tearing. These multiple backing layers can be laminated together and the precision-thickness of the composite disk backing are controlled by thickness-grinding the composite disk backing before the abrasive layer is applied to the disk backing.

If the vacuum attachment seal between the disk backing and the platen abrading surface is broken by this disk-cutting action, portions of the ripped disk can lift off the surface of the platen. Undesirable extra-thin abrasive disk backings can then crumple and become wedged between the workpieces and the moving platen surface on high-speed non-floating platen abrading systems. On these open-platen systems, where the platen has a high surface speed, the wedging action of the crumpled disk can quickly apply lifting forces on the workpieces and upon the individual workpiece holder devices that are positioned above the horizontal platen. Because the workpieces are free to travel in a direction that is perpendicular to the platen surface, a gap opening can develop between the workpiece and the platen. Leading-edge portions of the crumpled disk can then enter this gap and the resultant wedge-like event can even increase the workpiece lifting force. Here, the torn abrasive disk that is separated from the platen looses its vacuum attachment bond and the disk no longer rotates with the platen but assumes a stationary-position with the stationary-position workpieces. When that happens, the near-stationary non-abrasive disk backing simply tends to skid on the surface of the moving platen. The precision-flat platen abrading surface typically is not affected by these abrasive disk separation events because it is contacted by the non-abrasive-coated mounting side of the backing. Abrading system sensors are typically used to sense the disk separation event and to activate a platen braking system that quickly decelerates the platen to stop its rotation and also activate other abrading system components to minimize the effects of the torn abrasive disk.

When flexible abrasive disks are used with the three-point fixed-spindle floating-platen abrading system, the issue of cutting or tearing the disks is substantially less than with the abrading systems where the workpieces are held in abrading contact with an open-surfaced rotating platen. Any abrasive disk that looses its vacuum attachment with the bottom abrading surface of the platen will tend to fall into the very large open areas that exist between the adjacent three-point workpiece spindles. There is little opportunity for the disks to become wedged between the moving platen and the workpieces, in part, because the workpieces are not free to move vertically away from the platen surface when the workpieces are subjected to forces from a separated abrasive disk. The workpieces are attached to rigidly mounted spindles that do not move away from the surface of the platen when subjected to abrading-event forces. These flat-surfaced workpieces are trapped between the rigid spindle top surfaces and the rigid platen surface where they simply hold the loose abrasive disk at a stationary position while the platen is decelerated to a stop. Because the flat platen surface moves against the smooth non-abrasive surface of the abrasive disk, the precision-flat platen abrading surface typically is not affected by these abrasive disk separation events. Abrading system sensors are used to sense the disk separation event and to activate a platen braking system that quickly decelerates the platen to stop its rotation. The sensors also are used to quickly reduce the abrading pressure between the platen and the workpieces.

Also, ripping or tearing of these fragile thin-backing abrasive disks can be easily avoided by simply using increased-thickness and/or tougher tear-resistant backing materials.

These thick and tough backings are not vulnerable to tearing when they are subjected to sharp edges of workpieces that are mistakenly directed at angles into the body of the moving abrasive disks. Thick backings can be constructed of polymers or metals or even composite layers of different backing materials. The vacuum provides huge attachment forces that result in the abrasive disk becoming an integral part of the rigid platen structure. The raised-island structures that are attached to the thick and robust backings are ground to have a uniform thickness relative to the backside of the backing before the abrasive coating is applied to the top flat surfaces of the raised island structures. The precision-thickness of the non-coated raised island structures establishes the precision-thickness foundation of the abrasive disks that typically have thin and precision-thickness abrasive coatings. Here, it is as easy to provide thick-backing abrasive disks that have a precision-thickness over the full abrasive surface of the abrasive disks as it is to provide precision-thickness abrasive disks that have thin and fragile backings.

Flexible abrasive disks are attached to the bottom flat annular surfaces of the platens used in the fixed-spindle floating-platen abrading system with vacuum. The vacuum attached abrasive disks that become an integral part of the rigid platen provide rigid abrading surfaces. This system allows disks having different abrasive sizes to be quickly changed. Once an abrasive disk is conformably attached to the platen smooth and flat annular abrading-surface, it will tend to remain attached to the flat platen surface even when the vacuum is interrupted. There is a cohesion-adhesion effect present between the lightweight abrasive disk smooth backing and the smooth platen surface. This abrasive disk cohesion-adhesion effect can be due to multiple sources. Typically there is a very thin water film present on the surface of the platen before a disk is conformable attached. Once the vacuum engages the disk and it becomes an integral part of the platen, the water film then acts as a suction-type disk retention system. This disk attachment effect is so strong that it can even be necessary to peel the disk off the platen surface when the disk is changed. This water-film suction-type attachment technique is often used to attach flat surfaced workpieces such as semiconductor wafers to flat-surfaced rotary spindles for abrading.

Another technique that can be used to separate the disk from the platen is to apply positive air pressure to the platen disk-attachment vacuum port holes. This air pressure will gently break the water-film seal that bonds the abrasive disk to the platen. Here, the loosened abrasive disk will tend to free-fall off the bottom horizontal surface of the platen.

Typically, the platen is allowed to rest on the top surfaces of the spindles when the disk attachment vacuum is turned off for an extended period of time. A stiff flat-plate member having a resilient pad surface can be positioned on top of the three-point spindles before the platen is brought to rest on the spindles. The stiff support plate will provide support of the abrasive disk across the full surface of the disk. Here, the disk will remain in full conformal contact with the platen when the abrading machine is in an at-rest mode with the vacuum shut off.

Also, clip-on abrasive disk support plates can be attached to the platen to retain the abrasive disk in place on the platen. When the abrasive system is restarted, the disk-attachment vacuum is reactivated to bond the disk back onto the platen surface in the same disk-position on the platen as it had before the vacuum was interrupted. Other techniques can be used to enhance the retention of the abrasive disks to the platen. For example, surface-tension enhancement fluids or other cohesion-adhesion agents can be applied to either the abrasive disk backings or the platen attachment surfaces prior to attachment of the disk to the platen. Water-mist sprays, low-tack adhesives sprays, or low-tack films can be applied to the disk backing surfaces. Electro-static charges can also be applied to the disk prior to attachment.

To assure that the flexible abrasive disks are in full conformal contact with the bottom side of large-diameter horizontal platens, the disk can be attached to the platen by "rolling" or progressively lifting it to contact the flat platen abrading surface. Here, one portion of a flexible disk is first brought in contact with the flat platen surface where vacuum engages this contact portion of the disk. Then the remaining portion of the flexible disk is progressively brought into contact with the platen. To concentrate the vacuum attachment capability at the progressive engaging portions of the disks, a thin flexible polymer slider-sheet can be first placed in contact with the platen flat annular surface to seal most of the vacuum attachment port holes that are located in the disk-mounting surface of the platen. As the abrasive disk is "rolled-on" to the platen, the slider-sheet is progressively moved back to expose more vacuum port-holes to the abrasive disk backing. Even very stiff, but flexible, abrasive disks can be installed using this technique. This is a simple and effective procedure of attaching large diameter flexible abrasive disks to the bottom flat annular surfaces of the platens used in the fixed-spindle floating-platen system.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles. The term "precisely" as used herein refers to within ±5 wavelengths planarity and within ±0.01 degrees of perpendicular or parallel, and precisely coplanar means within ±0.01 degrees of parallel and with a standard deviation between planes that does not exceed ±20 microns.

With the fixed-spindle-floating-platen system, there are no resilient or complaint component members n this abrading system that would allow forgiveness of out-of-dimensional-tolerance variations of other of the system components. For example, there is no substantial structural compliance of the platen-mounted abrasive disks to compensate for spindle-to-spindle workpiece surface positional variations. The precision-flat platen abrasive surface must be precisely co-planar with the top exposed surfaces of all three of the rigid-spindle workpieces to provide workpieces that are abraded precisely flat when using these non-resilient abrasive disks. Further, the rigid granite base that the rigid spindles are mounted on does not deflect or elastically distort when the spindles are subjected to typical abrading forces. Likewise, the air bearing workpiece spindles are also extremely stiff and the spindle rotating tops do not experience significant deflection when subjected to the typical abrading forces. The whole fixed-spindle-floating platen system is extremely rigid, but also, has many component surfaces that are precisely co-planar with other of the system component surfaces.

Raised-Island Abrasive Disk Production

Production of a wide variety of precision-thickness raised island abrasive disks is very easy to accomplish with a very low capital investment. First, inexpensive abrasive disk backings are produced that have the desired annular patterns of raised-island flat-surfaced island-structures that are attached to a disk backing sheet. Then, these island-structure disks are attached to the flat surface of a precision-flat rotary spindle. All of the island-structures are then ground down when the spindle is rotating to produce island-structure equal heights where the island-structure heights are measured from the bottom mounting surface of disk backing. Next, a uniform thickness of a liquid abrasive slurry, that contains a selected size and type of abrasive particles and an adhesive binder, is transfer-coated on the top flat surfaces of the island structures. The uniform-thickness abrasive coating on the island-structures is then solidified in an oven or by other energy sources. The resultant high-performance precision-thick abrasive disk can be used for high speed flat lapping of workpieces.

Abrading System Workpiece Abrading Action

In the present system having flat workpiece surfaces positioned horizontally, there is no vertical movement of the workpiece wafer mounted on one spindle relative to the position of any wafer mounted on any of the other fixed-position rotary workpiece spindles. Here, it is critical that a precision-flat datum reference plane is established on the surfaces of the rotary spindle-tops. When a floating precision-flat platen is brought into abrading face contact with the three spindles, the flat abrading surface of the platen is precisely co-planar with the surfaces of the spindle-tops. Equal-thickness workpieces are attached in flat contact with the flat surfaces of the spindles where the flat abrading surface of the platen contacts the full flat surfaces of the workpieces that are attached to the spindle-tops. Here, the abraded flat surfaces of all three workpieces are also precisely co-planar with the co-planar flat surfaces of the spindle-tops.

During abrading action, both the workpieces and the abrasive platens are rotated simultaneously. Once a floating platen "assumes" a position as it rests conformably upon and is supported by the three spindles, the planar abrasive surface of the platen retains this platen alignment even as the floating platen is rotated. The three-point spindles are located with equal spacing between them circumferentially in alignment with the centerline of the platen annular abrasive. The controlled abrading pressure applied by the abrasive platen to the three individual same-sized and equal-thickness workpieces is evenly distributed to the three workpieces. All three equal-sized workpieces experience the same shared platen-imposed abrading forces and abrading pressures. Semiconductors wafer workpieces can then be lapped where precision-flat and smoothly polished wafer surfaces can be simultaneously produced at all three spindle stations by the fixed-spindle-floating platen abrading system.

Flat-lapped workpieces are typically abraded to a flatness that is 10 to 30, or more, times flatter than the abrading surfaces. This is a surface enhancement magnification process effect where "medium-flat" platen abrasive surfaces can produce "ultra-flat" workpiece surfaces. It is well established that the working surfaces of lapper machines are not provided with flatness equivalent to the flatness of the lapped workpieces. Furthermore, the active abrading lapper machine surfaces are not continuously maintained with the initial machine component flatness during extended abrading operations because they wear during the abrading processes. These platen abrasive surfaces are periodically re-flattened to re-establish their required flatness.

Because the floating-platen and fixed-spindle abrading process is single-sided, very thin workpieces can be attached to the rotatable spindles by vacuum or other attachment means. To provide abrading of the opposite side of the workpiece, it is removed from the spindle, flipped over and abraded with the floating platen. This is a simple two-step procedure. Here, the rotating spindles provide a workpiece surface that remains co-planar with the granite reference surface and the production of workpieces having two opposing non-planar surfaces is avoided. Non-planar workpiece surfaces are often produced by single-sided lapping operations that do not use fixed-position workpiece spindles.

The spindles and the platens can be rotated at very high speeds, particularly with the use of precision-thickness raised-island abrasive disks. These abrading speeds can exceed 10,000 surface feet per minute (SFM). The abrading pressures used are very low because of the extraordinary high material removal rates of superabrasives comprising diamond at high speeds. The abrading pressures are often much less than 1 psi which is a small fraction of the abrading pressures commonly used in abrading. Low abrading pressures result in highly desired low subsurface damage. In addition, low abrading pressures result in lapper machines that have considerably less weight and bulk than conventional abrading machines.

Use of a platen vacuum disk attachment system allows quick set-up changes where different sizes of abrasive particles and different types of abrasive material can be quickly attached to the flat platen surfaces. Also, the use of messy loose-abrasive slurries is avoided by using the fixed-abrasive disks.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

Automated Abrading System

Semiconductor wafers can be easily processed with a fully automated easy-to-operate process that is very practical. Here, individual wafer carriers can be changed on all three spindles with a robotic arm extending through a convenient gap-opening between two adjacent stand-alone wafer spindles.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasives can be coated on the backings using gravure-type coating techniques.

Robust And Durable Abrading System

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

BACKGROUND OF THE TECHNOLOGY

Flat lapping of workpiece surfaces to produce precision-flat and mirror smooth polished surfaces at high production rates where the opposing workpiece surfaces are co-planar is required for many high-value parts such as semiconductor wafer and rotary seals. The accuracy of the lapping or abrading process is constantly increased as the workpiece performance, or process requirements, become more demanding. The new workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800 and commonly assigned U.S. patent application published numbers 20100003904; 20080299875 and 20050118939 and all contents of which are incorporated herein by reference.

There are many different types of abrading and lapping machines that have evolved over the years. Slurry lapping has been the primary method of providing precision-flat and smoothly polished flat-surfaced workpieces using a liquid mixture of loose abrasive particles that is applied to a flat surfaced rotary platen that is pressed into contact with the rotating workpieces. The platen surface continually wears due to abrading contact with the workpieces and conditioning rings are used periodically or continuously to re-establish the required planar flatness of the platen. Most slurry lapping is single-sided where only the exposed surface of a workpiece is abraded. Double-sided slurry lapping can be done by using two abrading platens that mutually contact both surfaces of the flat workpieces that are sandwiched between the two rotating abrading platens. The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Slurry lapping typically uses low abrading pressure and it is slow and messy. Changing the size of abrasive particles requires that the messy platens have to be thoroughly cleaned before smaller-sized particles are used because a few straggler-type large-sized particles can result in scratches of high-value workpiece surfaces. Abrading processes require that the abrasive sizes be sequentially changed (typically in three steps) to minimize the time required to flatten and polish the surfaces of workpieces.

Micro-grinding (flat-honing) is a double-sided abrading process that uses two abrading platens that mutually contact both surfaces of the flat workpieces that are sandwiched between the two rotating abrading platens. Both the upper and lower platen annular abrading surfaces have a thick layer of fixed-abrasive materials that are bonded to abrasive-wheels, where the abrasive wheels are bolted to the platen surfaces. The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Micro-grinding is slow and very high abrading pressures are typically used. Changing the abrasive wheels is a time-consuming and complex operation so the abrasive wheels are typically operated for long periods of time before changing. Changing the size of abrasive particles requires that the abrasive wheels have to be changed.

Chemical mechanical planarization (CMP) of workpieces typically use a resilient flat-surfaced pad that is coated with a continuous or periodic flow of liquid slurry that contains loose abrasive particles and specialty chemicals that enhance the abrading characteristics of select workpiece materials. Flat-surfaced workpieces are placed in flat contact with the rotating pads where the workpieces are also typically rotated. The pads often have fiber construction where it has been estimated that only 10% of the individual fiber strands are in abrading contact with the workpiece surface as the workpiece is forced into the surface-depth of the resilient pads. It also has been estimated that 30% of the expensive diamond or other abrasive particles are lost before being utilized for abrading contact with the workpieces. As in slurry lapping, this CMP polishing process is messy. Changing the size of the abrasive particles requires that a new or different pad is used with the new-sized particles. Because the workpieces float on the surface of the resilient pads, the CMP process is a polishing process only. Very small surface protuberances are removed from the flat surfaces of semiconductor wafers but the precision flatness of a wafer can not be established by the CMP process because of the floatation of the wafers on the pad surface.

More recently, fixed-abrasive web material is used for CMP polishing of wafers. The web has shallow-height islands that are attached to a web backing and the abrasive web is incrementally advanced between times of polishing individual wafers held in flat contact with the stationary web. Water containing chemicals is applied to the wafers during the polishing procedure. The abrasive web is typically supported by a semi-rigid polymer surface that is supported by a resilient pad. When the abrasive web is stationary, the wafer is rotated. However, the rotated wafer has a near-zero abrading speed at the rotated wafer center. Because the well-established function of the workpiece material removal rate being directly proportional to the abrading speed, the material removal rate is very high at the outer periphery of the rotating wafer but near-zero at the wafer center. This results in non-uniform abrading of the wafer surface. The fixed-abrasive provides a clean CMP abrading process compared to the messy slurry-pad CMP process.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. Nos. 1,989,074 (Bullard), 2,410,752 (Sells et al), 2,696,067 (Leach), 2,973,605 (Carman et al), 2,979,868 (Emeis), 3,342,652 (Reisman et al), 3,475,867 (Walsh), 3,662,498 (Caspers), 4,104,099 (Scherrer), 4,165,584 (Scherrer), 4,256,535 (Banks), 4,315,383 (Day), 4,588,473 (Hisatomi et al), 4,720,938 (Gosis), 4,735,679 (Lasky), 4,910,155 (Cote et al), 5,032,544 (Ito et al), 5,137,542 (Buchanan et al), 5,191,738 (Nakazato et al), 5,274,960 (Karlsrud), 5,364,655 (Nakamura et al), 5,422,316 (Desai et al), 5,454,844 (Hibbard et al), 5,456,627 (Jackson et al), 5,538,460 (Onodera), 5,569,062 (Karlsrud), 5,643,067 (Katsuoka et al), 5,769,697 (Nisho), 5,800,254 (Motley et al), 5,833,519 (Moore), 5,840,629 (Carpio), 5,857,898 (Hiyama et al), 5,860,847 (Sakurai et al), 5,882,245 (Popovich et al), 5,916,009 (Izumi et al), 5,938,506 (Fruitman et al), 5,964,651 (Hose), 5,972,792 (Hudson), 5,975,997 (Minami), 5,981,454 (Small), 5,989,104 (Kim et al), 5,916,009 (Izumi et al), 6,007,407 (Rutherford et al), 6,022,266 (Bullard et al), 6,089,959 (Nagahashi), 6,139,428 (Drill et al), 6,165,056 (Hayashi et al), 6,168,506 (McJunken), 6,217,433 (Herrman et al), 6,273,786 (Chopra et al), 6,439,965 (Ichino), 6,520,833 (Saldana et al), 6,632,127 (Zimmer et al), 6,652,764 (Blalock), 6,702,866 (Kamboj), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,214,125 (Sharples et al), 7,250,368 (Kida et al), 7,364,495 (Tominaga et al), 7,367,867 (Boller), 7,393,790 (Britt et al), 7,422,634 (Powell et al), 7,446,018 (Brogan et al), 7,449,124 (Webb et al), 7,456, 7,527,722 (Sharan), 7,582,221 (Netsu et al), 7,585,425 (Ward), 7,588,674 (Frodis et al), 7,635,291 (Muldowney), 7,648,409 (Horiguchi et al) and in U.S. Patent Application 2008/0182413 (Menk et al).

I. Types of Abrading Contact

The characteristic of workpieces abrasion is highly dependent on the type of contact that is made with an abrasive surface. In one case, the flat (or curved) surface of a rigid platen-type surface is precisely duplicated on a workpiece. This is done by coating the platen with abrasive particles and rubbing the workpiece against the platen. In another case, a rigid moving abrasive surface is guided along a fixed path to abrade the surface of a workpiece. The accuracy of the abrasive guide-rail (or a rotary spindle) determines the accuracy of the abraded workpiece surface. A further case is where workpieces are "floated" in conforming surface-contact with a moving rigid abrasive-coated flat platen. Here, only the high-spot areas of the moving platen contact the workpiece. It is helpful that the abraded surface of the workpiece is typically flatter than the abrading surface of the platen.

For those workpieces requiring ultra-flat surfaces where the amount of material removed in an abrading process is extremely small, it is difficult to provide fixed-path abrading machines having rigid abrasive surfaces that can accomplish this. Out-of-plane variations of the moving abrasive are directly dependent on the variations of the moving abrading machine components. Abrading machines typically are not capable of providing moving abrading surfaces that have variations less than the often-required 1 lightband (0.000011 inches or 11 millionths of an inch) of workpiece flatness. It is much more difficult to create precision-flat and mirror-smooth surfaces on large sized workpieces than small ones.

Most lapping-type of abrading is done on rotary-platen machines that provide smooth continuous abrading motion rather than oscillating-motion machines. However, rotary-motion machines have an inherent flaw in that the abrading speed is high at the outer periphery of the platen and low at the platen center. This change of abrading speed across the surface of the platen results in non-uniform abrading of a workpiece surface. Using annular bands of abrasive on large diameter platens minimizes this problem. However, it is necessary to rotate workpieces while in abrading contact with the platen abrasive to even-out the wear on a workpiece.

Wear-down of the platen abrasives during abrading creates non-flat abrasive surfaces which prevent abrading precision-flat workpiece surfaces. It is necessary to periodically re-flatten the platen abrading surfaces.

For removing small amounts of surface material for workpieces, floatation-type abrading systems are often used. Here, conformal abrading contact provides uniform material removal across the full flat surface of a workpiece. One common-use of floatation-abrading is slurry lapping. Here, a flat platen is surface-coated with a liquid slurry mixture of abrasive particles and a workpiece is held in flat conformal contact with the slurry coated platen. This slurry lapping system can provide workpieces having both precision-flatness across the full workpiece surface and a mirror-smooth polish.

Another abrading system that has "floatation" characteristics is double-sided abrading. Here, equal-thickness workpiece parts are position around the circumference of a lower flat-surfaced abrasive platen. Then another flat-surfaced abrasive platen is placed in conformal contact with the top surface of the distributed workpieces. This upper abrasive platen is allowed to "float" while both abrasive platens are moved relative to the workpieces sandwiched between them.

II. Single-Sided Abrading

Abrading ultra-flat and ultra-smooth workpiece parts requires a sequential series of different abrading techniques. First, rigid-grind techniques are used. Here the, rough-surfaced workpieces are given flat surfaces that are fairly smooth. Then, workpieces are lapped even flatter and smoother. Precision-flat rigid platens are coated with a slurry containing loose abrasive particles are used for lapping. This slurry lapping process can produce workpieces that are much flatter than the platen surfaces. This is a critical achievement because it is not possible to produce and maintain platens that have surfaces that are as desired flatness of the workpieces.

Likewise, it is not possible to provide and maintain lapping machines that rotating workholders that are perfectly perpendicular to a rotary abrasive platen surface. Because of the lack of machine capability, it is not practical to produce workpieces having precisely parallel surfaces using this type of single-sided abrading machines.

III. Double-Sided Abrading

To produce parallel-surfaced workpieces, a different machine technology is used. Here, a large-diameter rigid precision-flat rotating platen is provided. Multiple equal-thickness workpieces are positioned around the circumference of the platen. Then, another large diameter flat-surfaced abrading platen is placed in contact with the top surfaces of the multiple workpieces. Here, the upper platen is allowed to float spherically so its flat surface assumes parallelism with the surface of the bottom platen. Both the upper and bottom platens have equal—diameter abrading surfaces. With this technology, no attempt is made to rigidly position the surface of the upper moving abrasive platen surface precisely perpendicular to the surface of the bottom platen. This co-planar alignment of the two double-sided abrading platens is achieved with ease and simplicity by using the uniform-thickness workpieces as spacers between the two [platens.

Building of complex and expensive rigid-workholder style of machines to abrade precisely co-planar (parallel) workpiece surfaces is avoided by this technique of double-sided abrading. The simple, and less expensive, machines provide an upper platen that floats spherically while rotationally moving in abrading contact with the top surface of the workpieces. Because both workpieces are abraded simultaneously, the workpiece surfaces are precisely co-planar.

IV. Raised-Island High Speed Flat Lapping

All of the present precision-flat abrading processes have very slow abrading speeds of about 5 mph. The high speed flat lapping system operates at about 100 mph. Increasing abrading speeds increase the material removal rates. This results in high workpiece production and large cost savings. In addition, those abrading processes that use liquid abrasive slurries are very messy. The fixed-abrasive used in high speed flat lapping eliminates the slurry mess. Another advantage is the quick-change features of the high speed lapper system where abrasive disks can be quickly changed with use of the disk vacuum attachment system. Changing the sized of the abrasive particles on all of the other abrading systems is slow and troublesome. The precision-thickness raised island abrasive disks that are used in high speed flat lapping can also be used for CMP-type abrading, but at lower speeds. These disks can be provided with thick semi-rigid backings that are supported with resilient foam backings.

V. Abrading Platens

A. Rotary Platens

Rotary platens are used for lapping because it is easy to establish and maintain their moving precision-flat surfaces that support abrasive coatings. The flat abrasive surfaces are replicated on workpieces where non-flat abrasive surfaces result in non-flat workpiece surfaces. Rotary platens also provide the required continuous smooth abrading motion during the lapping operation because they don't reverse direction as does an oscillating system. However, the circular rotary platen annular abrasive bands are curved which means the outer periphery travels faster than the inner periphery. As a result, the material cut-rate is higher at the outside portion of the annular band than the inside. To minimize this radial position cut rate disparity, very large diameter platens are used to accommodate large workpieces.

C. No Platen Wear

Unlike slurry lapping, there is no abrasive wear of raised island abrasive disk platens because only the non-abrasive flexible disk backing surface contacts the platen surface. There is no motion of the abrasive disk relative to the platen because the disk is attached to the platen. During lapping, only the top surface of the disk raised island fixed-abrasive has to be kept flat, not the platen surface itself. Here, the precision flatness of the high speed flat lapper system can be completely re-established by simply and quickly changing the abrasive disk. Changing the non-flat fixed abrasive surface of a micro-grinder can not be done quickly because it is a bolted-on integral part of the rotating platen that supports it.

D. Quick-Change Capability

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks can be stored or shipped flat in layers. Large and very large disks can be rolled and stored or shipped in polymer protective tubes. The abrasive disk quick change capability is especially desirable for laboratory lapping machines but they are also great for prototype lapping and full-scale production lapping machines. This abrasive disk quick-change capability also provides a large advantage over micro-grinding where it is necessary to change-out a worn heavy rigid platen or to replace it with one having different sized particles.

VI. Hydroplaning of Workpieces

Hydroplaning of workpieces occurs when smooth surfaces (continuous thin-coated abrasive) are in fast-moving contact with a flat surface in the presence of surface water. However, it does not occur when interrupted-surfaces (raised islands) contact a flat wetted workpiece surface. An analogy is the tread lugs on auto tires which are used on rain slicked roads. Tires with lugs grip the road at high speeds while bald smooth-surfaced tires hydroplane.

VII. Raised Island Disks

The reason that this lapping system can be operated at such high speeds is due to the use of precision-thickness abrasive coated raised island disks. Moving abrasive disks are surface cooled with water to prevent overheating of both the workpiece and the abrasive particles. Raised islands prevent hydroplaning of the stationary workpieces that are in flat conformal contact with water wetted abrasive that moves at very high speeds. Abrading speeds are often in excess of 100 mph. Hydroplaning occurs with conventional non-island continuous-coated lapping film disks where a high pressure water film is developed in the gap between the flat workpiece and the flat abrasive surfaces.

During hydroplaning, the workpiece is pushed up away from the abrasive by the high pressure water and also, the workpiece is tilted. These cause undesirable non-flat workpiece surfaces. The non-flat workpieces are typically polished smooth because of the small size of the abrasive particles. However, flat-lapped workpieces require surfaces that are both precision-flat and smoothly polished.

The islands have an analogy in the tread lugs on auto tires which are used on rain slicked roads. Tires with lugs grip the road at high speeds while bald tires hydroplane. Conventional continuous-coated lapping film disks are analogous to the bald tires.

Raised islands also reduce "stiction" forces that tend to bond a flat surfaced workpiece to a water wetted flat-surfaced abrasive surface. High stiction forces require that large forces are applied to a workpiece when the contacting abrasive moves at great speeds relative to the stationary workpiece. These stiction forces tend to tilt the workpiece, resulting in non-flat workpiece surfaces. A direct analogy is the large attachment forces that exist between two water-wetted flat plates that are in conformal contact with each other. It is difficult to slide one plate relative to the other. Also, it is difficult to "pry" one plate away from the other. Raised island have recessed channel passageways between the island structures. The continuous film of coolant water that is attached to the workpiece is broken up by these island passageways. Breaking up the continuous water film substantially reduces the stiction.

VIII. Precision Thickness Disks

Another reason that this lapping system can be operated at such high speeds is due to the use of precision-thickness abrasive coated raised island disks. These disks have an array of raised islands arranged in an annular band on a disk backing. To be successfully used for high speed lapping, the overall thickness of the abrasive disks, measured from the top surface of the exposed abrasive to the bottom mounting surface of the disk backing must be uniform across the full disk-abrasive surface with a standard deviation in thickness of less than 0.0001 inches. The top flat surfaces of the islands are coated with a very thin coating of abrasive. The abrasive coating consists of a monolayer of 0.002 inch beads that typically contain very small 3 micron (0.0001 inch) or sub-micron diamond abrasive particles. Raised island abrasive disks are attached with vacuum to ultra-flat platens that rotate at very high abrading surface speeds, often in excess of 100 mph.

The abrasive disks have to be of a uniform thickness over the full abrading surface of the disk for three primary reasons. The first reason is to present all of the disk abrasive in flat abrading contact with the flat workpiece surface. This is necessary to provide uniform abrading action over the full surface of the workpiece. If only localized "high spots" abrasive surfaces contact a workpiece, undesirable tracks or gouges will be abraded into the workpiece surface. The second reason is to allow all of the expensive diamond abrasive particles contained in the beads to be fully utilized. Again if only localized "high spots" abrasive surfaces contact a workpiece, those abrasive particles located in "low spots" will not contact the workpiece surface. Those abrasive beads that do not have abrading contact with a workpiece will not be utilized. Because the typical flatness of a lapped workpiece are measured in millionths of an inch, the allowable thickness variation of an raised island abrasive disk to provide uniform abrasive contact must also have extra-ordinary accuracy.

The third reason is to prevent fast moving uneven "high spot" abrasive surfaces from providing vibration excitation of the workpiece that "bump" the workpiece up and away from contact with the flat abrasive surface. Because the abrasive disks rotate at such high speeds and the workpieces are lightweight, these moving bumps tend to repetitively drive the workpiece up after which it falls down again with only occasional contact with the moving abrasive. The result is uneven wear of the workpiece surface.

All three of these reasons are unique to high speed flat lapping. The abrading problems, and solutions described here were progressively originated while developing this total lapping system. They were not known or addressed by others who had developed raised island abrasive disks. Because of that, their disks can not be used for high speed flat lapping.

IX. Abrading Pressure

Abrading pressures used are typically a small fraction of that used in traditional abrading processes. This is because of the extraordinary cutting rates of the diamond abrasive at the very high abrading speeds. Often abrading pressures of less than 0.2 psi can be used in high speed flat lapping. These low pressures have a very beneficial effect as they result in very small amounts of subsurface damage of workpiece materials that is typically caused by the abrasive material.

X. Annular Band of Abrasive

The raised abrasive islands are located only in an annular band that is positioned at the outer periphery of the disk. Problems associated with the uneven wear-down of abrasives located at the inner radius of a disk are minimized. Also, the uneven cutting rates of abrasives across the abrasive surface due to low abrading speeds at the innermost disk are minimized. Equalized cutting rates across the radial width of the annular band occur because the localized abrading speeds at the inner and outer radii of the annular abrasive band are equalized.

The abrasive islands are constructed in annular bands on a flexible backing. The disks are not produced from continuous abrasive coated webs is not used because the presence of abrasive material at the innermost locations on a disk are harmful to high speed flat lapping. In addition, there are no economic losses associated with the lack of utilization of expensive diamond particles located at the undesirable innermost radii of an abrasive disk.

XI. Initial Platen Flatness

The best flatness that is practical to achieve for a new (or reconditioned) slurry platen having a medium platen diameter is about 0.0001 inches. It is even more difficult to achieve this flatness for large diameter platens. These are platen flatness accuracies that are achieved immediately after a platen is initially flattened. This process is usually done with great care and requires great skill and effort. To better appreciate the small size of this 0.0001 inch allowable platen variation, a human hair has a diameter of about 0.004 inches and a sheet of copier paper is also about 0.004 inches thick. Attaining a flatness variation of 0.0001 inches is difficult for a medium 12 inch diameter platen, more difficult for a large 6 foot platen and extremely difficult for huge platens that exceed 30 feet in diameter.

The vertical distance that a typical outer periphery deviates from the platen planar surface far exceeds the size of a sub-micron abrasive particle. To appreciate the relative difference between platen flatness deviation dimensions and the abrasive particle sizes, a comparison is made here. Typically a new (or reconditioned) platen is flattened to within 0.0001 inches total variation of the platen plane. This is roughly equivalent to the size of a 3 micron abrasive particle. It is also approximately equal to 10 helium lightbands of flatness. These dimensions are so small that optical refraction devices are used to measure flatness variations in lightbands. It is difficult to accurately make these small measurements using conventional mechanical measuring devices. The out-of-plane platen flatness is even worse when compared to sub-micron sized abrasive particles. For instance, a typical 0.3 micron particle is only one tenth the size of a 3 micron particle. Even the typical non-worn platen flatness variations are grossly larger than the size of the sub-micron particles that are required to produce mirror-smooth polishes.

XII. Progresssive Use of Finer Abrasive Particles

Abrasive disks are typically used in sets of three abrasive particles sizes. The first disk has coarse sized particles to remove the large out-of-plane defects and establish the nominal flatness of a workpiece. The second disk has medium sized particles to further refine the flatness and develop a smoother surface. The third disk has very fine particles to polish the workpiece where the surface is both precisely flat and very smooth.

To provide an even more smoothly polished workpiece than do the spaced abrasive beads, a fourth disk can be used that has a continuous layer of very fine abrasive particles coated on the island tops. The abrasive is a mixture of abrasive particles and an adhesive that is flat-coated on the surface of the raised islands.

I. Vacuum Attachment of Disks to the Platens

Abrasive disks must be repetitively attached and removed from the lapping machine platens to complete the high speed flat lapping of workpieces. The abrasive disks are flexible and the disk backings have flat mounting surfaces that can provide a vacuum seal when the disks are mounted with vacuum to a flat platen surface.

The vacuum disk attachment system provides huge forces that bond the thin flexible raised island abrasive disks to the robust flat surfaced platens. These bonding forces are so large because all of the vacuum force of 10, or more, psig is applied to each square inch of surface area of an abrasive disk. At a modest 10 psig vacuum, a small sized 12 inch diameter abrasive disk having a surface area of 113 inches squared, results in a disk attachment bonding force of 1,130 lbs. With a perfect vacuum of 14.7 psig the disk hold-down bonding force is 1,661 lbs. These large disk attachment forces assure that the abrasive disks are in full conformal contact with the precision-flat platen surface. Here, the top flat planar surface of the abrasive disk assumes the precision flatness of the platen. The abrasive surface is simply off-set fro the platen by the precision thickness of the disk. Use of vacuum to attach precision thickness raised island abrasive disks to the precision flat platens results in an planar abrasive surface that is precisely flat and therefore, capable of high speed flat lapping.

Each platen-mounted raised island abrasive disk is rigid in a direction perpendicular to the disk surface. As a result, the typical small contact abrading forces applied to the disk have little effect on distorting the thickness of the disk. The abrading contact forces acting in a direction perpendicular to the abrasive surface are intentionally small because of the extraordinary cut rates of the abrasive particles at the high speeds used in high speed flat lapping. Friction forces in a direction parallel to the abrasive surface, due to the contact abrading forces, are correspondingly small. Also, the raised islands prevent large stiction-type disk shearing forces (from the coolant water) to act parallel to the flat surface of the moving disks. These small disk surface liquid shearing forces and friction forces have little effect on the disk because the disk is bonded to the structurally stiff platen by the huge vacuum disk attachment forces.

Platen surfaces have patterns of vacuum port holes that extend under the abrasive annular portion of an abrasive disk to assure that the disk is firmly attached to the platen surface. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to the flatness variation of a given platen will recapture that registered platen position and will not have to be "worn-in" again upon reinstallation.

When an abrasive disk is partially worn down, the top surface of the abrasive wears-in to assume a true planar flatness even when there are very small out-of-plane defects in the platen surface. After usage, this disk can be removed to be temporarily replaced by a disk having different sized abrasive particles. However, before the disk is removed from a platen, the disk and the platen are marked at a mutual tangential location. Then when the original disk is re-mounted on the same platen, the marking on the disk is tangentially aligned with the marking on the platen. This assures that the disk is positioned at the same original location on the platen to reestablish the true planar surface of the disk abrasive without having to re-wear in the abrasive disk.

Coolant water acts as a continuous flushing agent to keep each disk and the platen clean during an abrading procedure. This allows clean abrasive disks to be quickly removed from a platen by interrupting the platen vacuum for future use. Another disk can be quickly installed and attached to the platen by simply re-applying the vacuum to the platen.

SUMMARY OF THE INVENTION

The presently disclosed technology includes a fixed-spindle, floating-platen system which is a new configuration of a single-sided lapping machine system. Automated workpiece loading apparatus machines are described that can load and unload both workpieces and abrasive disks in the abrading system.

High-precision, large-diameter air bearing flat-surfaced rotary spindles are attached to a dimensionally-stable machine base. These machine bases are typically granite or epoxy-granite. Three of the spindles are used to provide three-point support of flat-surfaced rotary platens that have attached raised-island abrasive disks. The rotary spindles can be mounted directly on the surface of a granite base using three different construction techniques. In the first, spindles having precisely equal heights are mounted to granite bases having precision-flat surfaces to assure that the rotary spindle tops are precisely co-planar with each other. Non-precision flat granite bases can be used with the next two techniques. In one technique, the rotary spindles have adjustable-height support legs that allow the precision co-planar alignment of the spindle-tops flat surfaces. In another technique, the rotary spindles are mounted on two-piece spherical-action spindle-mounts that allow the top flat surfaces of the three spindle-tops to be precisely aligned co-planar to each other. In all three spindle mounting techniques where the spindles are attached to the flat surface of the granite bases, the aligned co-planar top flat surfaces of the three spindle-tops act at the primary reference plane for the fixed-spindle floating-platen abrading system.

This flat lapping abrading system is capable of producing ultra-flat thin semiconductor wafer workpieces at high abrading speeds. This is done by providing a dimensionally-stable, rigid (e.g., synthetic, composite or granite) machine base that the three-point rigid fixed-position workpiece spindles are mounted on. Flexible abrasive disks having annular bands of abrasive-coated raised islands may be attached to a rigid flat-surfaced rotary platen that floats in three-point abrading contact with the three equal-spaced flat-surfaced rotatable workpiece spindles. Use of a platen vacuum disk attachment system allows quick set-up changes where different sizes of abrasive particles and different types of abrasive material can be quickly attached to the flat platen surfaces.

Water coolant is preferably used with these raised island abrasive disks, which allows them to be used at very high abrading speeds, often in excess of 10,000 SFM. The coolant water can be applied directly to the top surfaces of the workpieces or the coolant water can be applied through aperture holes at the center of the abrasive disk or through aperture holes at other locations on the abrasive disk. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading.

The fixed-spindle-floating-platen system is easy to use, is flexible for abrasive selection set-ups, handles a wide range of types of abrading, is a clean process, produces ultra-flat and ultra-smooth finishes, handles thin workpieces, can be fully automated for changing workpieces and can be fully automated for changing abrasive disks to provide quick-changes of types and sizes of abrasive particles. The different types of abrading range from high-speed water-cooled flat-lapping to liquid slurry lapping, CMP polishing with liquid slurries and resilient pads, fixed-abrasive CMP polishing, and abrading with thick layers of abrasive pellets attached to thick disk backings. This system provides new wide range of abrading capabilities that can not be achieved by other conventional abrading systems.

This fixed-spindle, floating-platen system is particularly suited for precision flat-lapping or surface polishing large diameter semiconductor wafers. High-value large-sized workpieces such as 12 inch diameter (300 mm) semiconductor wafers can be attached to ultra-precise flat-surfaced 12 inch diameter air bearing spindles for precision lapping.

In this fixed-spindle floating-platen flat lapping systems, the lower platen of a slurry-type or flat-honing-type of double-sided platen abrading system having workpieces sandwiched between a floating upper platen and a lower rigidly mounted platen is replaced with a three-point fixed-spindle upper floating platen support system. Instead of the upper floating platen being conformably supported by equal-thickness flat workpieces that are supported by flat-surfaced contact with the flat surface of the lower platen, the upper floating platen is supported by contacting equal-thickness flat workpieces that are supported by flat-surfaced contact with the flat surfaces of the three rigidly mounted rotatable spindles. The equally-spaced workpiece spindles provide stable support for the floating upper platen.

This new floating platen abrading system is a single-sided abrading system as compared to the double-sided floating platen abrading system. Only the top surfaces of the workpieces are abraded as compared to both sides of workpieces being abraded simultaneously with the double-sided abrading system. The single-sided fixed-spindle-floating-platen system can abrade thin workpieces and produce ultra-flat abraded surfaces that are superior in flatness produced by conventional double-sided abrading. This flatness performance advantage occurs because the individual workpieces are supported by the precision-flat surfaces of the air bearing spindles rather than by the worn-down abrading surfaces of the bottom platen in a double-sided abrading system.

The systems of supporting the floating upper platen with the three-point rigid mounted precision-flat air bearing spindles provide a floating platen support system that is has a planar flatness that is equivalent to or flatter than that provided by a conventional rigid mounted lower platen. The air bearing spindles used here have precision flat surfaces that provide surface variations that are often more than one order of magnitude flatter than conventional abrading platen surfaces, even when the spindles are rotated at large speeds. Most conventional platen abrasive surfaces have original-condition flatness tolerances of 0.0001 inches (100 millionths) that typically wear down into a non-flat condition during abrading operations to approximately 0.0006 inch variation across the radial width of an annular abrasive band before they are reconditioned to re-establish the original flatness variation of 0.0001 inches. By comparison, the typical flatness of a precision air bearing spindle is less than 5 millionths of an inch. The air bearing spindles have large 12 inch diameter flat surfaces and are able to support 12 inch (300 mm) diameter workpieces such as semiconductor wafers with little spindle-top deflections due to abrading forces. The spindle stiffness of air bearings often exceeds the stiffness of mechanical roller bearing spindles. Workpieces are typically attached to or with equal-thickness carrier plates that are lapped precisely flat where both of the carrier plate flat surfaces are precisely parallel to each other. These precision carriers provide assurance that the independent workpieces that are mounted on the three spindles have workpiece surfaces that are precisely co-planar with each other.

The top flat surfaces of the equal-height spindles must be co-planar with each other. Each of the three rigid spindles is positioned with equal spacing between them to form a triangle of platen spindle-support locations. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts the workpieces attached to all three rotating spindle-tops to perform single-sided abrading on the exposed surfaces of the workpieces. The fixed-spindle-floating platen system can be used at high abrading speeds to produce precision-flat and mirror-smooth workpieces at very high production rates. There is no abrasive wear of the platen surface because it is protected by the attached flexible abrasive disks.

The multiple workpieces are in abrading contact with the abrasive disk that is attached to a floating rotary platen precision-flat annular abrading-surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

Very thin workpieces can be attached to the rotatable spindles by vacuum or other attachment means. These workpieces can be very much thinner than the workpieces that are held by planetary workholders in a double-sided flat-honing (micro-grinding) dual-platen abrading system. To provide abrading of the opposite side of the workpiece, it is removed from the spindle, flipped over and abraded with the floating platen. This is a simple two-step procedure. Here, the rotating spindles provide a workpiece surface that remains co-planar with the co-planar spindle-top reference surface and the two-step production of workpieces having two opposing non-planar surfaces is avoided. Non-planar workpiece surfaces are often produced by single-sided lapping operations that do not use fixed-position rigid-mounted rotary workpiece spindles that have spindle-top flat surfaces that are precisely co-planar with each other.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasive disks can be coated or printed on disk backings using gravure printers, off-set printers, flexo-graphic printers that use flexible polymer printing plates having raised-island printing features, or other printing or coating techniques. The abrasive material typically used for the CMP disks often includes ceria which can be applied as a slurry mixture of ceria particles mixed with a liquid. Also, spherical beads of ceria that are deposited to form abrasive-island features on a backing can be used. In addition, ceria abrasive-like material can consist of deposited island features of ceria abrasive beads in a slurry mixture of adhesive.

This system can also provide slurry lapping by attaching a disposable flat-surfaced metal, or non-metal, plate to the rigid platen abrading-surface and applying a coating of liquid loose-abrasive particle slurry to the exposed flat surface of the plate. The platen slurry plate can be periodically re-conditioned by attaching equal-thickness abrasive disks to the rotating workpiece spindles and holding the rotating platen in abrading contact with the spindle abrasive disks. Here again, the primary planar reference surface even for the system is the co-planar flat surfaces of the three spindle-tops.

The system can also be used to recondition the surface of the abrasive on the abrasive disk that us attached to the platen abrading surface. This abrasive surface of the abrasive disk tends to experience uneven wear across the radial surface of the annular abrasive band after continued abrading contact with the workpieces that are attached to the three spindle-tops. When the non-even wear of the abrasive surface becomes excessive and the abrasive can no longer provide precision-flat workpiece surfaces it must be reconditioned to re-establish its planar flatness. Reconditioning the platen-mounted abrasive disk abrasive surface can be easily accomplished with this system by attaching equal-thickness abrasive disks to the flat surfaces of the spindle-tops in place of the workpieces. Here, the abrasive disk abrasive surface reconditioning takes place by rotating the spindle-top abrasive disks while they are in flat-surfaced abrading contact with the rotating abrasive surface of the abrasive disks that are attached to the platen abrading-surface annular band.

Workpieces comprising semiconductor wafers can be easily processed with a fully automated easy-to-operate process that is very practical. Here, individual wafer carriers can be changed on all three spindles with a robotic arm extending through a convenient gap-opening between two adjacent stand-alone rotary workpiece spindles.

Also, an automated robotic loader device can be used to change abrasive disks on a rotary platen.

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

There is no wear of the platen surface because the abrasive is not in abrading contact with the platen. Each time an abrasive disk is attached to a platen, the non-worn platen provides the same precision-flat planar abrading-surface for the new or changed precision-thickness abrasive disk.

BRIEF DESCRIPTION OF THE DRAWINGS

FIG. 25 is an isometric view of fixed-abrasive raised islands on an annular abrasive disk.

FIG. 26 is an isometric view of a fixed-abrasive coated raised island annular abrasive disk.

FIG. 27 is an isometric view of a solid-layer fixed-abrasive annular disk.

DETAILED DESCRIPTION OF THE INVENTION

Figure 1:
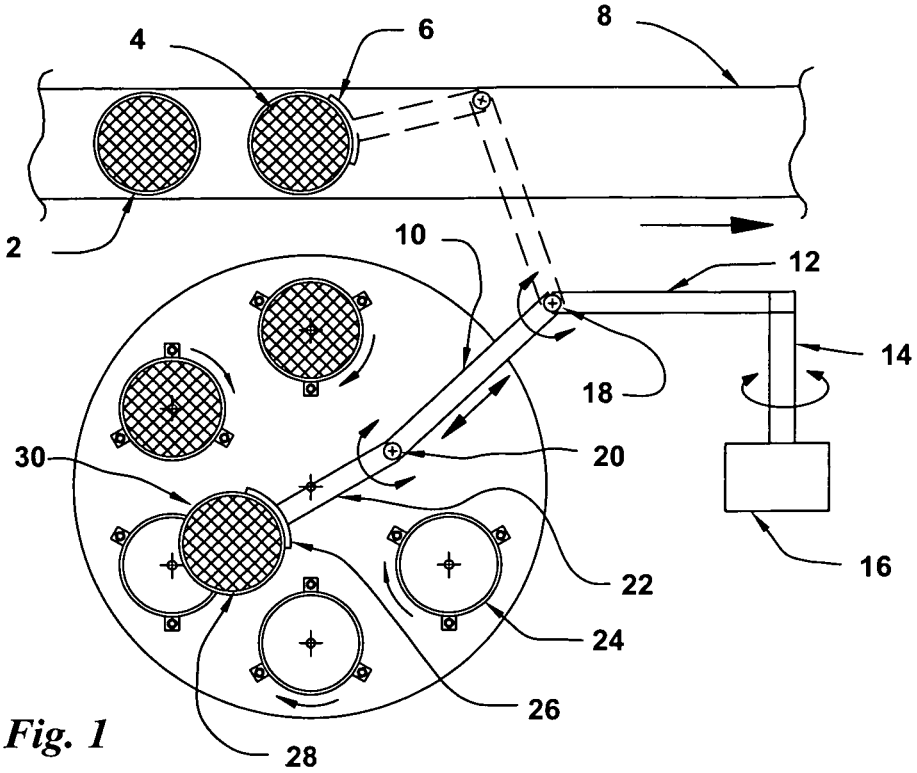
FIG. 1 is a top view of an automatic robotic workpiece loader for multiple spindles.

FIG. 1 is a top view of an automatic robotic workpiece loader for multiple spindles. An automated robotic device 16 has a rotatable shaft 14 that has an arm 12 to which is connected a pivot arm 10 that, in turn, supports another pivot arm 22. A workpiece carrier holder 26 attached to the pivot arm 22 holds a workpiece carrier 28 that contains a workpiece 30 where the robotic device 16 positions the workpiece 30 and carrier 28 on and concentric with the workpiece rotary spindle 24. Other workpieces 4 and carriers 2 are shown on a moving workpiece transfer belt 8 where they are picked up by the carrier holder 6. The workpieces 30 and 4 and workpiece carriers 28, 2 can also be temporarily stored in other devices comprising cassette storage devices (not shown). The workpieces 30, 4 and workpiece carriers 28, 2 can also be removed from the spindles 24 after the workpieces 30, 4 are abraded and the workpieces 30, 4 and workpiece carriers 28, 2 can then be placed in or on a moving belt (not shown) or a cassette device (not shown). The workpieces 30, 4 can also optionally be loaded directly on the spindles 24 without the use of the workpiece carriers 28, 2. Access for the robotic device 16 is provided in the open access area between two wide-spaced adjacent spindles 24.

Figure 2:
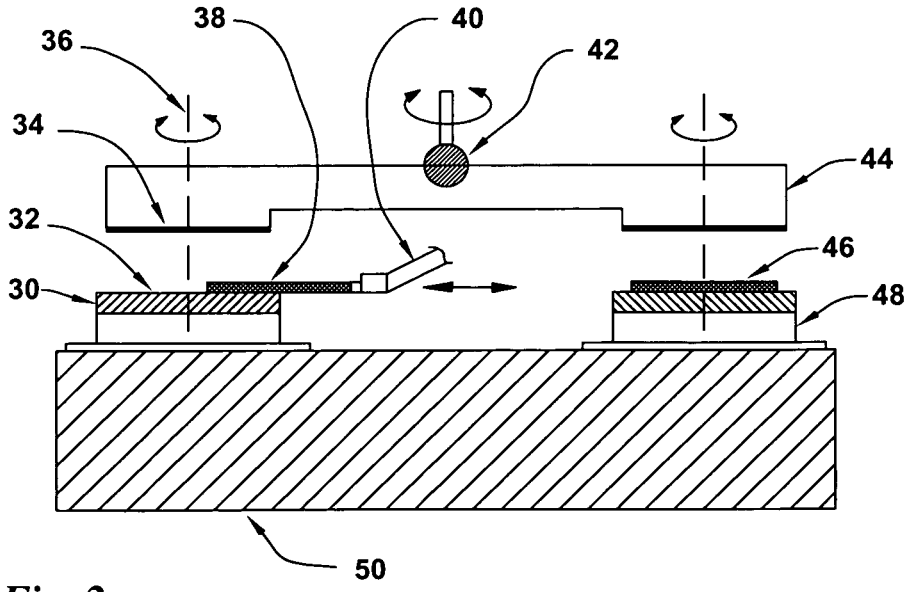
FIG. 2 is a side view of an automatic robotic workpiece loader for multiple spindles.

FIG. 2 is a side view of an automatic robotic workpiece loader for multiple spindles. An automated workpiece loader device 40 (partially shown) can be used to load workpieces 38, 46 onto spindles 48 that have spindle tops 30 that have flat surfaces 32 and where the spindle tops 30 rotate about the spindle axis 36. A floating platen 44 that is rotationally driven by a spherical-action device 42 has an annular abrasive surface 34 that contacts the equal-thickness workpieces 38 and 46 where the platen 44 is partially supported by abrading contact with the three independent near-equal spaced three-point spindles 48 and the abrading pressure on the workpieces 38 and 46 is controlled by controlled force-loading of the spherical action device 42. The spindles 48 are supported by a granite machine base 50.

Figure 3:
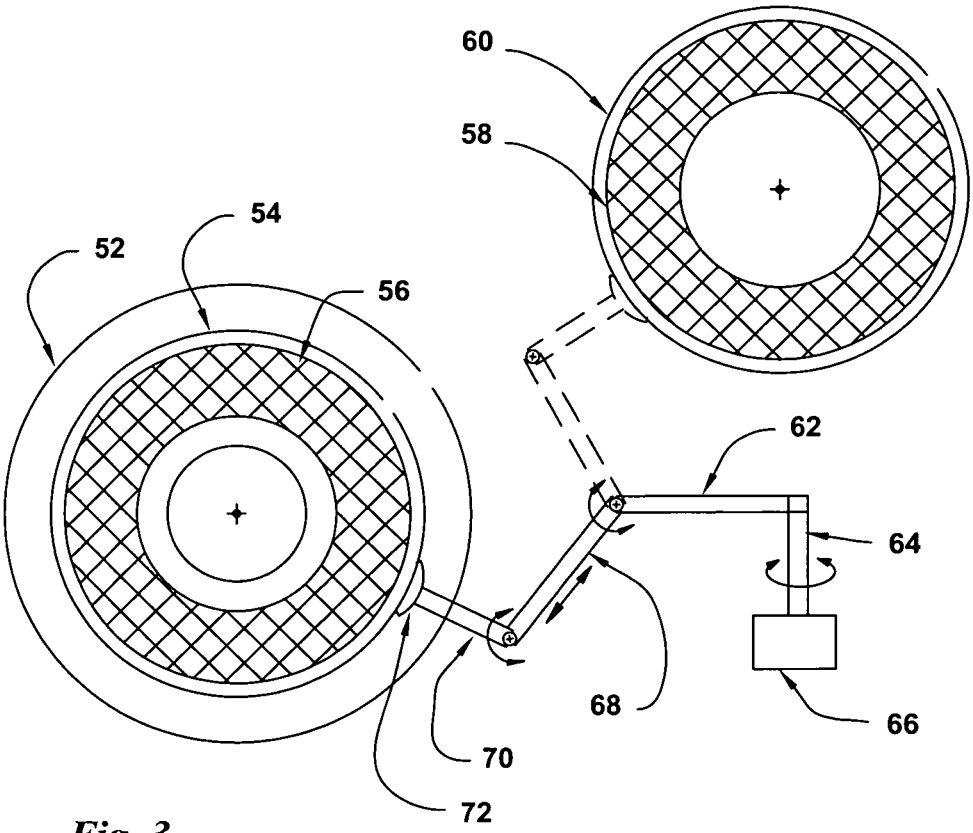
FIG. 3 is a top view of an automatic robotic abrasive disk loader for an upper platen.

FIG. 3 is a top view of an automatic robotic abrasive disk loader for an upper platen. An automated robotic device 66 has a rotatable shaft 64 that has an arm 62 to which is connected a pivot arm 68 that, in turn, supports another pivot arm 70. An abrasive disk carrier holder 72 attached to the pivot arm 70 holds an abrasive disk carrier 54 that contains an abrasive disk 56 where the robotic device 66 positions the abrasive disk 56 and disk carrier 54 on and concentric with the platen 52. Another abrasive disk 58 and abrasive disk carrier plate 60 are shown in a remote location where the abrasive disk 58 can also be temporarily stored in other devices comprising cassette storage devices (not shown). Guide or stop devices (not shown) can be used to aid concentric alignment of the abrasive disk 56 and the platen 52 and the robotic device 66 can position the abrasive disk 56 in flat conformal contact with the flat-surfaced platen 52 after which, vacuum (not shown) is applied to attach the disk 56 to the platen 52 flat abrading surface (not shown). Then the pivot arms 70, 68 and 62 and the carrier holder 72 and the disk carrier 54 are translated back to a location away from the platen 52.

Figure 4:
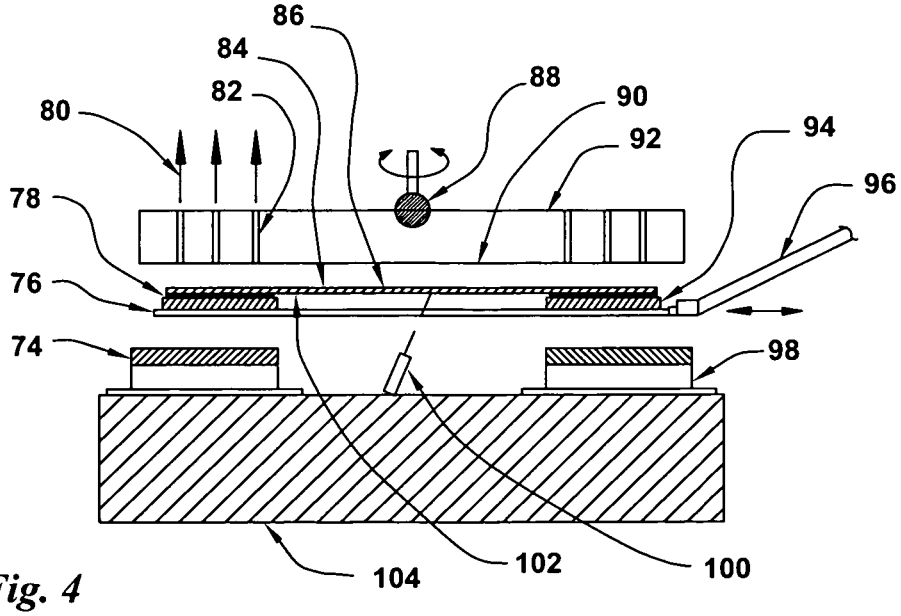
FIG. 4 is a side view of an automatic robotic abrasive disk loader for an upper platen.

FIG. 4 is a side view of an automatic robotic abrasive disk loader for an upper platen. An automated robotic device 96 (partially shown) has a carrier holder plate 76 that has an attached resilient annular disk support pad 94 that supports an abrasive disk 86 that has an abrasive layer 78. The abrasive disk carrier holder 76 that contains the abrasive disk 86 is moved whereby the robotic device 96 positions the abrasive disk 86 and disk carrier 76 on to and concentric with the platen 92. The resilient layer pad 94 attached to the carrier holder 76 allows the back-disk-mounting side 84 of the abrasive disk 86 to be in flat conformal contact with the platen 92 abrading surface 90 before the vacuum 80 that is present in the platen 92 vacuum ports 82 is activated. The platen 92 has vacuum 80 that is applied through vacuum port holes 82 to attach the abrasive disk 86 to the abrading surface 90 of the platen 92. The floating platen 92 is driven rotationally by a spherical action device 88 to allow abrading surface 102 of the abrasive disk 86 that is attached to the floating platen 92 abrading surface 90 to be in flat abrading contact with equal-thickness flat-surface workpieces (not shown) that are attached in flat surface contact to the flat top surface of the rotating spindle-top component 74 of at least three each three-point spindles 98 (one not shown) that are mounted on a granite base 104. After the abrasive disk 86 is attached to the platen 92 the robotic device 96 carrier holder 76 is withdrawn from the platen 92 area.

An optical sensor device 100 is attached to the granite machine base 104 to monitor the status and condition of the floating platen 92 abrading surface 90 and to monitor the abrasive disk 86 and also to monitor the condition of the abrading surface 102 of the abrasive disk 86 after attachment and during the abrading procedure operation. The optical sensor device 100 can be air-purged to prevent fouling of the optical sensor with coolant water spray or abrading debris.

Figure 5:
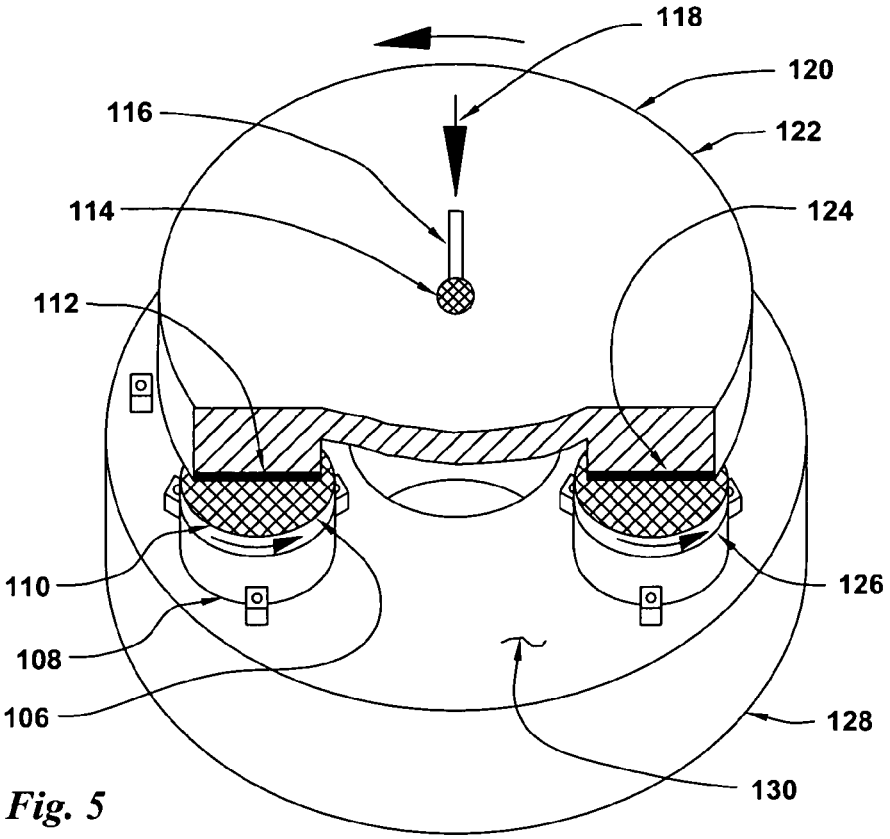
FIG. 5 is an isometric view of an abrading system with spindles and a floating platen.

FIG. 5 is an isometric view of an abrading system 122 having three-point fixed-position rotating workpiece spindles supporting a floating rotating abrasive platen. Three evenly-spaced rotatable spindles 108 (one not shown) having rotating tops 126 that have attached workpieces 110 support a floating abrasive platen 120. The platen 120 has a vacuum, or other, abrasive disk attachment device (not shown) that is used to attach an annular abrasive disk 124 to the precision-flat platen 120 abrasive-disk mounting precision-flat annular abrading surface 112. The abrasive disk 124 is in flat abrasive surface contact with all three of the workpieces 110. The rotating floating platen 120 is driven through a spherical-action universal joint type of device 114 having a platen drive shaft 116 to which is applied an abrasive contact force 118 to control the abrading pressure applied to the workpieces 110. The equal-height workpiece rotary spindles 108 are mounted on a granite base 128 that has either an precision-flat or an approximate-flat surface 130. The three workpiece spindles 108 have precise equal-heights which results in the top surfaces of the three spindles 108 to be co-planar when used with a granite base 128 precision-flat surface 130 and results in the co-planar surfaces of all of the flat-surfaced rotating workpiece spindles 108 to be co-planar with the flat surface 130 of the granite base 128. The equal-height workpiece spindles 108 can be interchanged or a new workpiece spindle 108 can be changed with an existing spindle 108 where the flat surfaces of the spindles 108 are in the same plane and are co-planar with the precision-flat surface 130 of the granite base 128. Here, the equal-thickness workpieces 110 are in the same plane and are abraded uniformly across each workpiece 110 exposed surface by the platen 120 precision-flat planar abrasive disk 124 abrading surface. The planar precision-flat annular abrading surface 112 of the floating platen 120 is co-planar with the flat surface 130 of the granite base 128.

The spindle 108 rotating surfaces spindle-tops 126 can be driven by different techniques comprising spindle 108 internal spindle shafts (not shown), external spindle 108 flexible drive belts (not shown), drive-wires (not shown) and spindle 108 internal drive motors (not shown). The spindle 108 tops 126 can be driven independently in both rotation directions and at a wide range of rotation speeds including very high speeds. Typically the spindles 108 are air bearing spindles that provide precision flat surfaces, equal heights, are very stiff, to maintain high rigidity against abrading forces, have very low friction and can operate at very high rotational speeds.

Abrasive disks (not shown) can be attached to the spindle 108 tops 126 to abrade the platen 120 flat annular surface 112 by rotating the spindle-tops 126 while the platen 120 flat surface 112 is positioned in abrading contact with the spindle abrasive disks that are rotated in selected directions and at selected rotational speeds when the platen 120 is rotated at selected speeds and selected rotation direction when applying a selected abrading force 118. The top surfaces 106 of the individual three-point spindle 108 rotating spindle-tops 126 can also be abraded by the platen 120 planar abrasive disk 124 by placing the platen 120 and the abrasive disk 124 in flat conformal contact with the spindle-tops 126 flat surfaces 106 of the workpiece spindles 108 as both the platen 120 and the spindle tops 126 are rotated in selected directions when an abrading pressure force 118 is applied. The top surfaces 106 of the spindles 108 abraded by the platen 120 results in all of the spindle 108 top surfaces 106 being in a common plane.

The granite base 128 is known to provide a time-stable nominally-flat surface 55 to which the precision-flat three-point spindles 108 can be mounted. The unique capability provided by this abrading system 122 is that the primary datum-reference is the fixed-position co-planar spindle-tops 126 flat surfaces 106. When the abrading system is initially assembled it can provide extremely flat abrading workpiece 110 spindle 108 top 126 mounting surfaces and extremely flat platen 120 abrading surfaces 112. The extreme flatness accuracy of the abrading system 122 provides the capability of abrading ultra-thin and large-diameter and high-value workpieces 110, such as semiconductor wafers, at very high abrading speeds with a fully automated workpiece 110 robotic device (not shown). Successful flat lapping operation of the system 122 is completely dependent on providing a rotary platen 120 precision-flat annular abrading surface 112 that supports precisely uniform-thickness abrasive disks 124.

In addition, the system 122 can provide unprecedented system 122 component flatness and workpiece abrading accuracy by using the system 122 components to "abrasively dress" other of these same-machine system 122 critical components such as the spindle tops 126 and the platen 120 planar annular abrading-surface 112. These spindle top 126 and the platen 120 planar surface 112 component dressing actions can be alternatively repeated on each other to progressively bring the system 122 critical components comprising the spindle tops 126 and the platen 120 planar-surface 112 into a higher state of operational flatness perfection than existed when the system 122 was initially assembled. This system 122 self-dressing process is simple, easy to do and can be done as often as desired to reestablish the precision flatness of the system 122 component or to improve their flatness for specific abrading operations.

This single-sided abrading system 122 self-enhancement surface-flattening process is unique among conventional floating-platen abrasive systems. Other abrading systems use floating platens but these systems are double-sided abrading systems. These other systems comprise slurry lapping and micro-grinding (flat-honing) that have rigid bearing-supported rotated lower abrasive coated platens that have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 122 is completely different than the double-sided system (not-shown).

The floating platen 120 abrading system 122 performance is based on supporting a floating abrasive platen 120 on the top surfaces 106 of three-point spaced fixed-position rotary workpiece spindles 108 that are mounted on a stable machine base 128 flat surface 55 where the top surfaces 106 of the spindles 108 are precisely located in a common plane and where the top surfaces 106 of the spindles 108 are co-planar with the -flat surface 130 of a rigid fixed-position granite, or other material, base 128. The three-point support is required to provide a stable support for the floating platen 120 as rigid components, in general, only contact each other at three points.

This abrading system 122 can be constructed with expensive granite bases 128 that have precision-flat surfaces 130 where the precision-flat surface 130 can be used as the abrading system 122 reference-surface where the spindles 108 having precision-heights can be mounted directly on the top precision-flat surface 130 to provide co-planar alignment of the top flat surfaces of the spindle-tops 126. Less expensive granite bases 128 that have non-precision-flat surfaces 130 can also be used with spindles that do not have precision spindle-heights or with spindles 108 that are mounted on the non-precision-flat surface 130 of the granite base 128 by use of adjustable-height spindle 108 support legs (not shown) or by use of two-piece spherical-action spindle mounts (not shown).

This three-point workpiece spindle abrading system 122 can also be used for abrasive slurry lapping (not shown), for micro-grinding (flat-honing) (not shown) and also for chemical mechanical planarization (CMP) (not shown) abrading to provide ultra-flat abraded workpieces 110.

Figure 6:
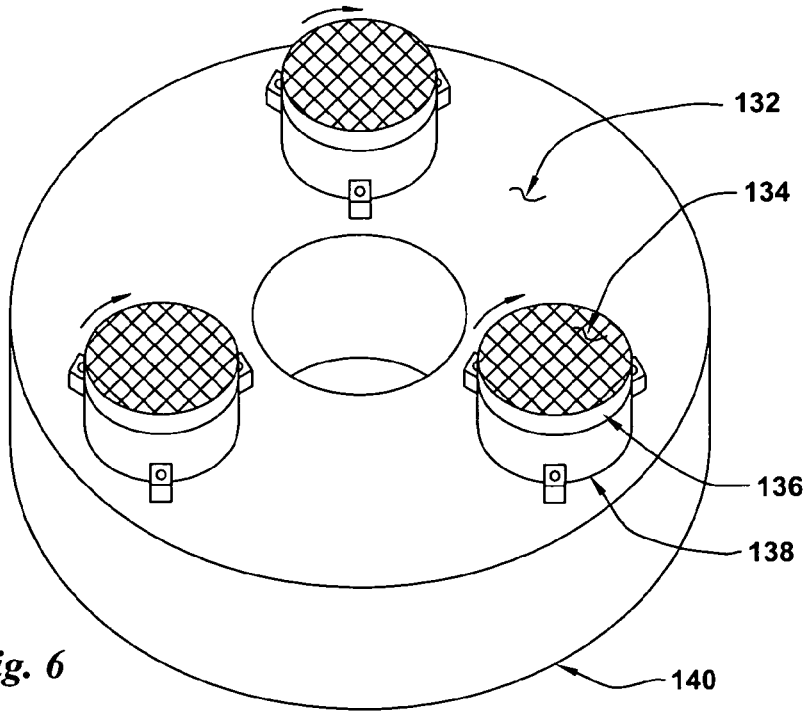
FIG. 6 is an isometric view of fixed-position spindles mounted on a granite base.

FIG. 6 is an isometric view of three-point fixed-position spindles mounted on a granite base. A granite base 140 has either a precision-flat or an approximate-flat top surface 132 that supports three attached workpiece spindles 138 that have rotatable driven tops 136 where flat-surfaced workpieces 134 are attached to the flat-surfaced spindle tops 136.

Figure 7:
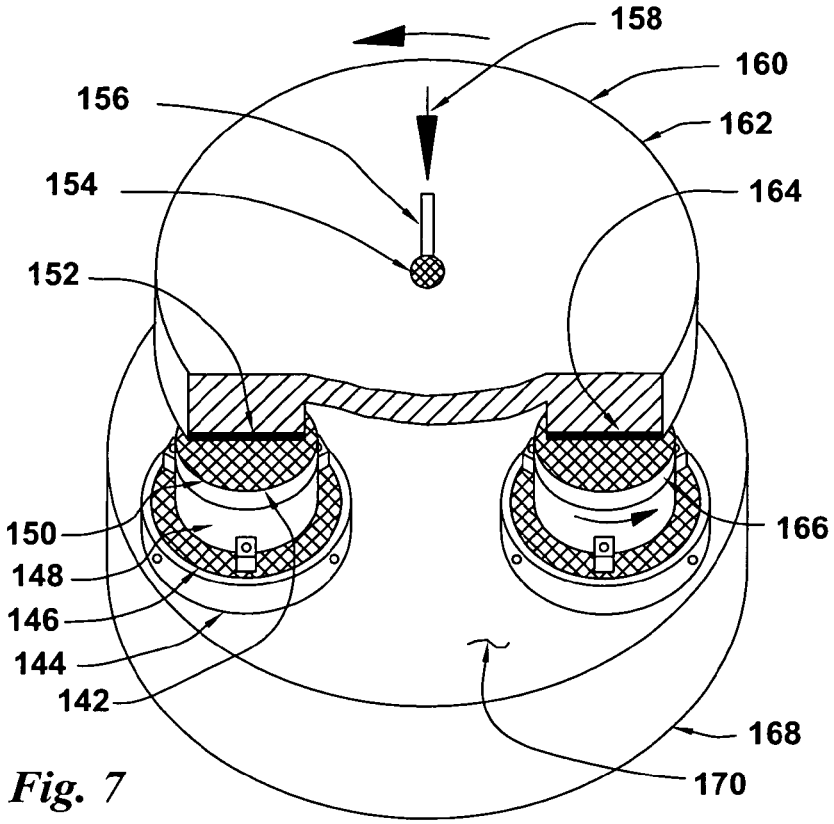
FIG. 7 is an isometric view of spherical-mount spindles supporting an abrasive platen.

FIG. 7 is an isometric view of two-piece spherical-mount spindles supporting an abrasive platen. An abrading system 162 having three-point fixed-position rotating workpiece spindles supporting a floating rotating abrasive platen. Three evenly-spaced rotatable spherical-base mounted spindles 148 (one not shown) having rotating tops 166 that have attached workpieces 150 support a floating abrasive platen 160. The rotary spindles 148 are attached to spherical-base rotors 146 that are mounted in spherical-bases 144 where the spherical rotors 146 can have spherical rotation action when mounted in the spherical-bases 144. The spindles 148 spherical-bases 144 are attached to the nominally-flat surface 170 of the granite or epoxy-granite machine base 168. The platen 160 has a vacuum, or other, abrasive disk attachment device (not shown) that is used to attach an annular abrasive disk 164 to the precision-flat platen 160 abrasive-disk mounting surface 152. The abrasive disk 164 is in flat abrasive surface contact with all three of the workpieces 150. The rotating floating platen 160 is driven through a spherical-action universal-joint type of device 154 having a platen drive shaft 156 to which is applied an abrasive contact force 158 to control the abrading pressure applied to the workpieces 150. The three workpiece rotary spindles 148 have approximate-equal-heights which allows alignment of the flat top surfaces 142 of the three spindles 148 spindle-tops 166 to be co-planar and results in the co-planar surfaces of all of the flat-surfaced rotary workpiece spindles 148 spindle-tops 166 to be approximately co-planar with the nominally-flat surface 170 of the granite base 168. Here, the equal-thickness workpieces 150 are in the same plane and are abraded uniformly across each workpiece 150 surface by the platen 160 precision-flat planar abrasive disk 164 abrading surface. The planar abrading surface 152 of the floating platen 160 is approximately co-planar with the nominally-flat surface 170 of the granite base 168.

The spindles 148 rotating spindle-tops 166 can driven by different techniques comprising spindle 148 internal spindle shafts (not shown), external spindle 148 flexible drive belts (not shown), drive-wires (not shown) and spindle 148 internal drive motors (not shown). The spindle 148 spindle-tops 166 can be driven independently in both rotation directions and at a wide range of rotation speeds including very high speeds. Typically the spindles 148 are air bearing spindles that provide precision flat surfaces, near-equal heights, are very stiff to maintain high rigidity against abrading forces, have very low friction and can operate at very high rotational speeds. The spindles 148 can also use precision roller bearings that allow the spindle-tops 166 to rotate.

Abrasive disks (not shown) or other abrasive deices (not shown) can be attached to the spindle 148 spindle-tops 166 to abrade the platen 160 flat surface 152 by rotating the spindle-tops 166 while the platen 160 flat surface 152 is positioned in abrading contact with the spindle abrasive disks or other spindle-top 166 disk abrasive devices that are rotated in selected directions and at selected rotational speeds when the platen 160 is rotated at selected speeds and selected rotation directions when applying a controlled abrading force 158. The top flat surfaces 142 of the individual three-point spindle 148 rotating spindle-tops 166 can also be abraded by the platen 160 planar abrasive disk 164 by placing the platen 160 and the abrasive disk 164 in flat conformal contact with the spindle-tops 166 flat surfaces 142 of the rotary workpiece spindles 148 as both the platen 160 and the spindle-tops 166 are rotated in selected directions when a controlled abrading pressure force 158 is applied. The abrading force 158 is evenly distributed to the three spindles 148 spindle-tops 166 because of the three point support of the platen 160 by the three spindles 148 that are evenly spaced from each other around the circumference of the platen 160. The top surfaces 142 of the spindles 148 spindle-tops 166 are abraded by the abrasive disk 164 that is attached to the platen 160 results in all of the spindles 148 spindle-tops 166 top surfaces 142 being in a common plane.

The granite base 168 provides a time-stable nominally-flat surface 170 to which the precision-flat three-point spindles 148 can be mounted by use of the spherical-base 144. The unique capability provided by this abrading system 162 is that the primary datum-reference is the fixed-position co-planar spindle-tops 166 flat surfaces 142. The spindles 148 spindle-tops 166 can be aligned to be mutually co-planar with each other without adjusting the heights of the individual spindles 148 because all the spindles 148 can rotate by spherical motion of the spherical rotors 146, after which the spherical rotors 146 can be attached to the spherical-bases 144 with fasteners (not shown). The spindles 148 spindle-tops 166 co-planar alignment can be done with alignment devices (not shown) or even the planar flat abrading-surface 152 of the platen 160 can be placed in contact with the spindle-tops 166 to establish the co-planar alignment of the spindle-tops 166.

The abrading system can provide extremely flat rotary spindle 148 spindle-top 166 workpiece mounting surfaces 142 and extremely flat platen 160 abrading surfaces 152. The extreme flatness accuracy of the abrading system 162 provides the capability of abrading ultra-thin and large-diameter and high-value workpieces 150, such as semiconductor wafers, at very high abrading speeds. Also, the workpieces 150 and the abrasive disks 164 can be loaded and unloaded into the abrading system 162 by using fully automated robotic devices (not shown).

In addition, the system 162 can provide unprecedented system 162 machine component flatness and workpiece abrading accuracy by using the abrading system 162 to "abrasively dress" other of these same abrading machine system 162 critical components such as the spindle tops 166 and the platen 160 planar-surface 152. These precision-abraded spindle top 166 and the platen 160 planar surface 152 components can be assembled into a new abrading system 162 and it can be used to progressively bring other abrading system 162 critical components comprising the spindle tops 166 and the platen 160 planar abrading-surface 152 into a higher state of operational flatness perfection than existed when the initial abrading system 162 was initially assembled. This abrading system 162 self-dressing process is simple, easy to do and can be done as often as desired to reestablish ultra-precision flatness of the abrading system 162 critical components or to improve their flatness for specific high-precision abrading operations.

This single-sided abrading system 162 self-enhancement surface-flattening process is unique among conventional floating-platen abrasive systems. Other abrading systems use floating platens but these systems are double-sided abrading systems. These other systems comprise slurry lapping and micro-grinding (flat-honing) that have rigid bearing-supported rotated lower abrasive coated platens that have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) typically have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 162 described here is completely different than the other double-sided system (not-shown).

The fixed-spindle, floating platen 160 abrading system 162 performance is based on supporting a floating abrasive platen 160 on the top surfaces 142 of three-point spaced fixed-position rotary workpiece spindles 148 that are mounted on a stable machine base 168 flat surface 170 where the top surfaces 142 of the spindles 148 spindle-tops 166 are precisely located in a common plane. Also, the top surfaces 142 of the spindles 148 are typically approximately co-planar with the nominally-flat surface 170 of a rigid fixed-position granite, epoxy-granite or other material, base 168. The three-point support is required to provide a stable support for the floating platen 160 as rigid components, in general, only contact each other at three points.

This three-point workpiece spindle abrading system 162 can also be used for abrasive slurry lapping (not shown), for micro-grinding (flat-honing) (not shown) and also for chemical mechanical planarization (CMP) (not shown) abrading to provide ultra-flat abraded workpieces 150.

Figure 8:
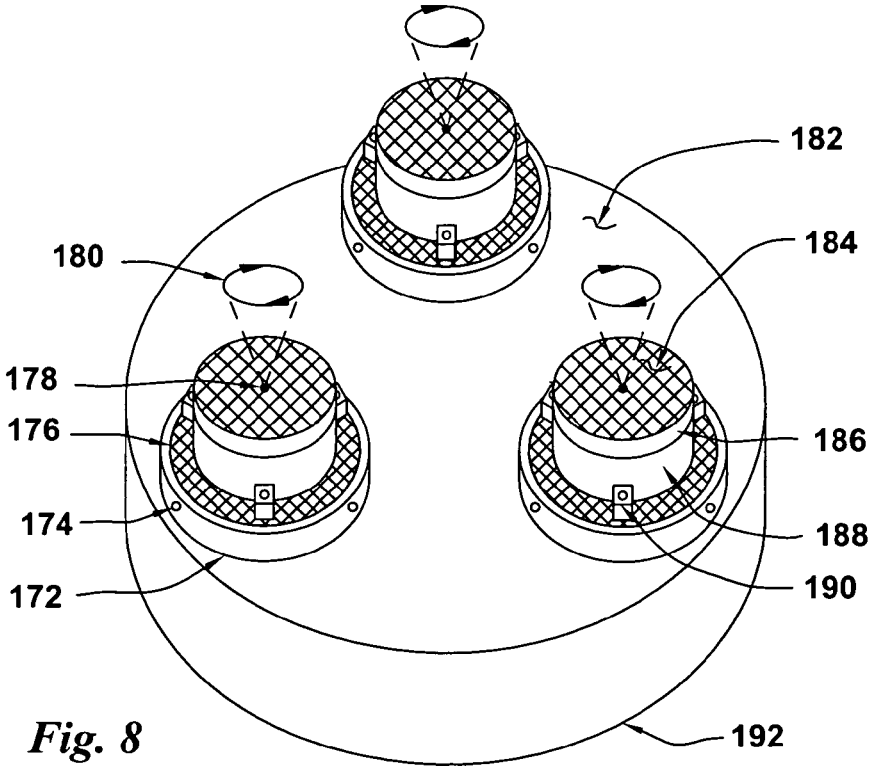
FIG. 8 is an isometric view of spherical-mount spindles mounted on a granite base.

FIG. 8 is an isometric view of two-piece spherical-mount spindles mounted on a granite base. An isometric view of three-point fixed-position spindles mounted on a granite base. A granite base 192 has a nominally-flat top surface 182 that supports three attached workpiece spindles 188 that have rotatable driven spindle-tops 186 where flat-surfaced workpieces 184 are attached to the flat-surfaced spindle-tops 186. The spindles 46 have attached spindle legs 190 that allow the spindles 188 to be attached to spherical rotors 176 that are mounted in spherical-action bases 172 having matching spherical diameters to the respective spherical rotors 176 where the spherical rotors 176 can be attached to the spherical-action bases 172 with fasteners 174 after co-planar alignment of the flat surfaces of the spindle-tops 186. The spindle-tops 186 have a center of rotation 178 and the spherical rotor 176 allows the spindle 188 to have spherical rotation as shown by 180. The spherical bases 172 are attached to the nominally-flat surface 182 of the machine base 192.

Figure 9:
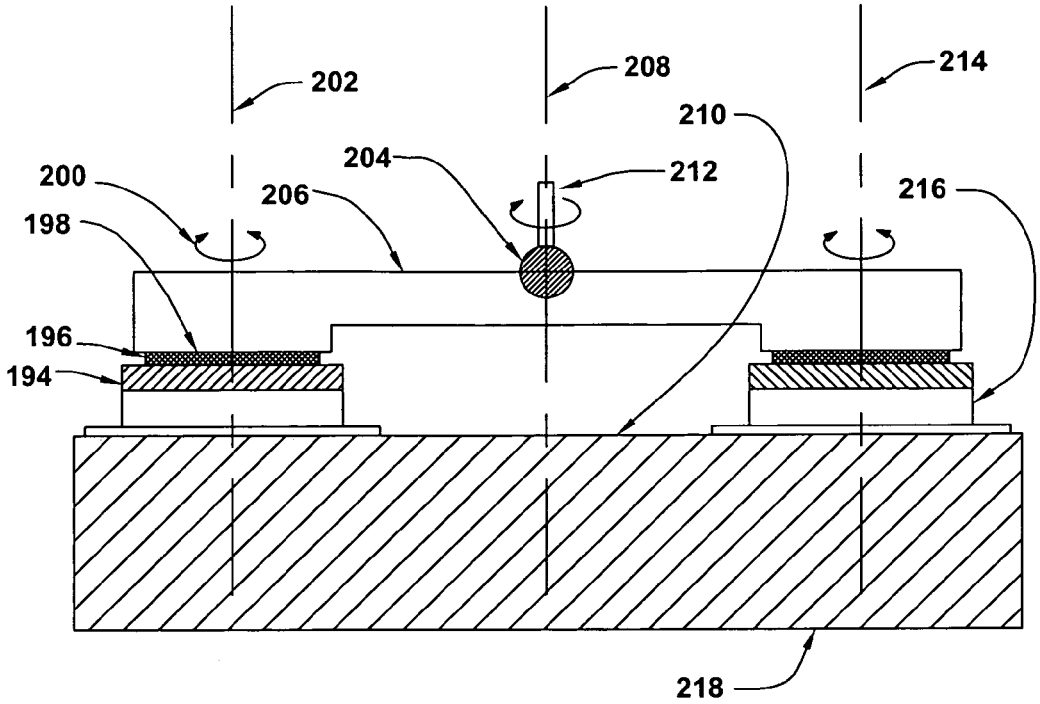
FIG. 9 is a cross section view of three-point spindles and a floating solid-abrasive platen.

FIG. 9 is a cross section view of three-point spindles and a floating solid-abrasive platen. A floating circular platen 206 has a spherical-action rotating drive mechanism 204 having a drive shaft 212 where the platen 206 rotates about an axis 208. Three workpiece spindles 216 (one not shown) having rotatable spindle tops 194 are mounted to the top precision-flat surface 210 of a machine base 218 that is constructed from granite, metal or composite or other materials. The flat top surfaces of the spindle 216 spindle-tops 194 are all in a common plane that is approximately co-planar with the precision-flat top surface 210 of the machine base 218. The floating platen 206 is three-point supported by the three equally-spaced spindles 216 where the thick solid-abrasive layer 196 that is attached to the flat planar annular abrading-surface 198 of the platen 206 is shown in flat abrading-contact with the top flat surfaces of the fixed-position spindle 216 rotating spindle-tops 194. The spindle-tops 194 rotate 200 about spindle axes 202 and 214.

Figure 10:
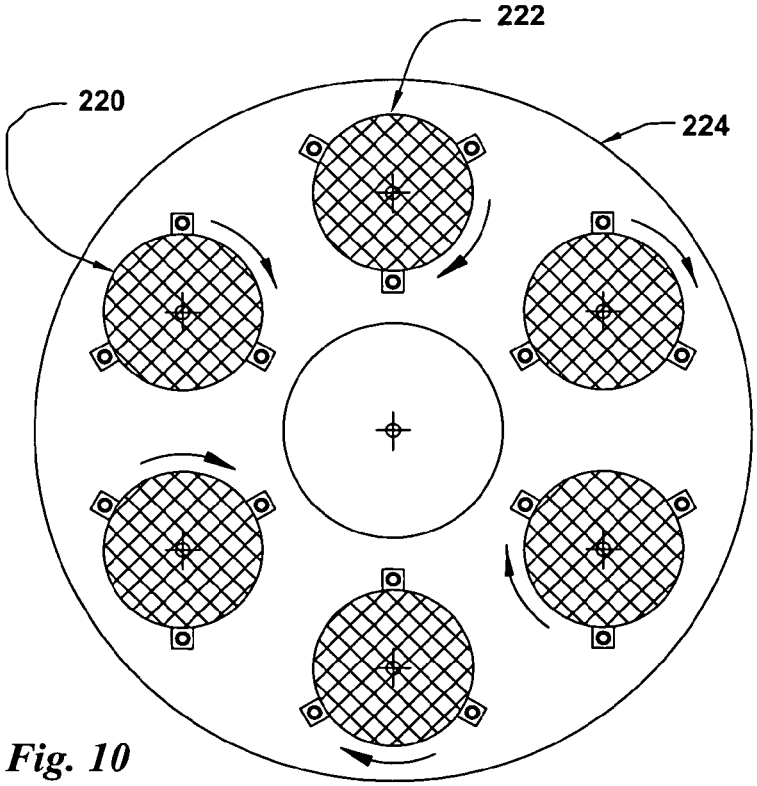
FIG. 10 is a top view of multiple fixed-spindles that support an abrasive floating platen.

FIG. 10 is a top view of multiple fixed-spindles that support an abrasive floating platen. A flat-surfaced granite base 224 supports multiple fixed-position air bearing spindles 220 that have rotating flat-surfaced tops 222. The multiple spindles 220 support a floating abrasive platen (not shown) having a flat abrading surface on the multiple spindle top 222 flat surfaces that are all co-planar.

Figure 11:
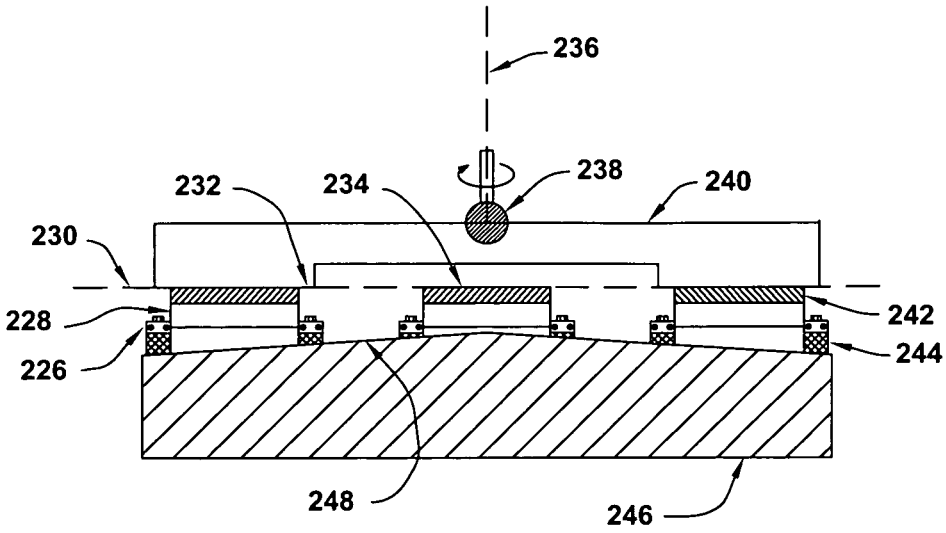
FIG. 11 is a cross section view of a floating platen and spindles on a angled machine base.

FIG. 11 is a cross section view of a floating platen and spindles on an angled machine base. Three spindles 228 having spindle legs 226 are mounted on a machine base 246 that has an angled top surface 248 by height-adjusting the spindle legs 226 and with use of spindle leg 226 spacers 244 where all three spindles 228 spindle-top 242 flat surfaces 234 are co-planar and lie in a common plane 230. A floating platen 240 has a spherical-rotation platen support device 238 that allows the platen 240 to rotate about a platen rotation axis 236 and where the spherical platen support device 238 allows the flat annular surface 232 of the platen 240 to be in conformal contact with the all three co-planar spindle tops 242 flat surfaces 234. Also, the platen 240 spherical-action support device 238 restrains the platen 240 in a platen 240 annular surface 232 radial direction while the platen 240 has the capability for three-dimensional spherical-rotation about the platen 240 two-dimensional rotation axis 236.

Figure 12:
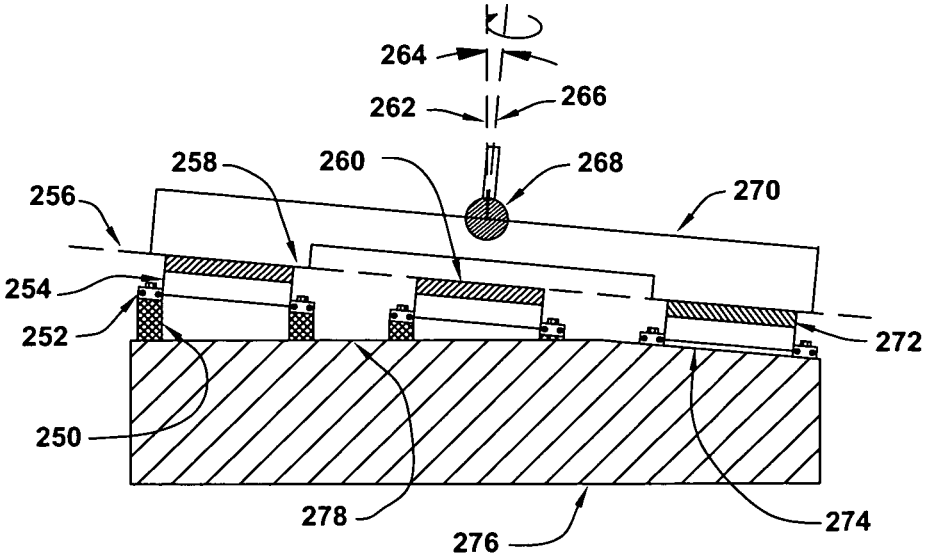
FIG. 12 is a cross section view of a floating platen and spindles on an angled base.

FIG. 12 is a cross section view of a floating platen and spindles on an angled machine base. Three spindles 254 having spindle legs 252 are mounted on a machine base 276 that has an angled top surfaces 278 and 274 by height-adjusting the spindle legs 252 and with use of spindle leg 252 spacers 250 where all three spindles 254 spindle-top 272 flat surfaces 260 are co-planar and lie in a common plane 256. A floating platen 270 has a spherical-rotation platen support device 268 that allows the platen 270 to rotate about a platen rotation axis 266 and where the spherical platen support device 268 allows the flat annular surface 258 of the platen 270 to be in conformal contact with the all three co-planar spindle tops 272 flat surfaces 260. Also, the platen 270 spherical-action support device 268 restrains the platen 270 in a platen 270 annular surface 258 radial direction while the platen 270 rotates about the platen 270 rotation axis 266. The platen 270 annular flat surface 258 is tilted from the horizontal as represented by the tilt angle 264 between the platen 270 rotation axis 266 and a vertical axis 262.

Figure 13:
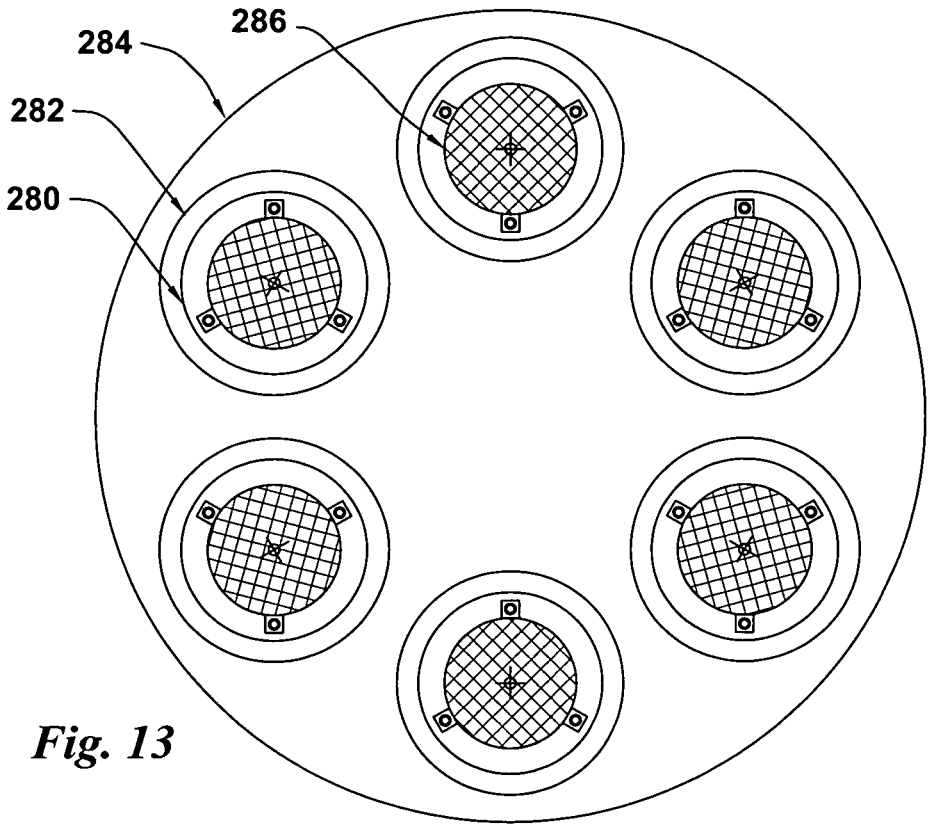
FIG. 13 is a top view of multiple rotary spindles mounted on a machine base.

FIG. 13 is a top view of multiple rotary spindles mounted on a machine base. Six rotary spindles 286 are shown attached to a spherical rotor 280 that is mounted in a spherical base 282 that is attached to the flat surface of a machine base 284.

Figure 14:
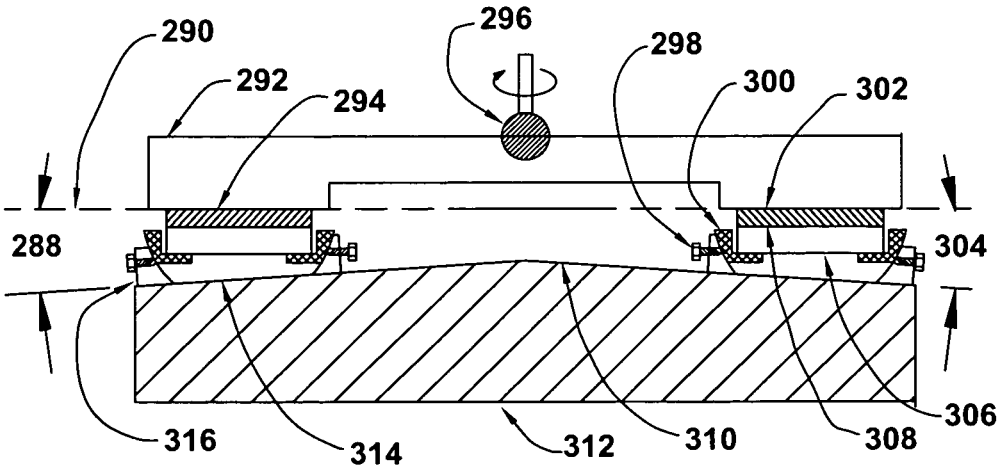
FIG. 14 is a cross section view of spherical-base mounted spindles supporting a floating abrasive platen.

FIG. 14 is a cross section view of two-piece spherical-base mounted spindles supporting a floating abrasive platen. Two rotary spindles 306 having rotary spindle-tops 308 are shown supporting a rotary platen 292 having a platen 292 flat abrading-surface 294 where the spindle-tops 308 abrading surfaces 294 are precisely co-planar with each other. Another spindle 306 (not shown) and the two shown spindles 306 form a three-point support of the platen 292 where all three spindles 306 have near-equal spaces between them. The rotating floating platen 292 is driven through a spherical-action universal joint type of device 296.

The rotary spindles 306 are attached to spherical base rotors 300 that are mounted in spherical bases 316 where the spherical rotors 300 can have spherical rotation action when mounted in the spherical bases 316. The spherical rotors 300 can be attached to the spherical bases 316 with fasteners 298. The spindles 306 spherical bases 316 are attached to the angled surfaces 310 and 314 of the granite or epoxy-granite machine base 312. The three workpiece rotary spindles 306 have approximate-equal-heights which allows alignment of the flat top surfaces 294 of the three spindles 306 spindle-tops 308 to be precisely co-planar and results in the co-planar surfaces 294 of all of the flat-surfaced rotary workpiece spindles 306 spindle-tops 308 to be approximately co-planar with the angled surfaces 310 and 314 of the granite base 312. The abrading surface 302 of the floating platen 292 shares a common plane 290 with the co-planar surfaces 294 of the spindle-tops 308 and the abrading surface 302 of the floating platen 292 is approximately co-planar with the nominally-flat or approximately-flat angled surfaces 310 and 314 of the granite base 312. Here the shallow-angled surface 310 of the machine base 312 has an shallow-angle 304 with the common plane 290 where the angle 304 is a shallow angle and the angle 288 of the angled surface 314 is also a shallow angle where the overall machine base 312 has a nominally-flat surface. The machine base 312 surface shallow-angles 288 and 304 are shown as large angles here to illustrate the difference between a nominally-flat and a precision-flat surface of machine bases 312.

Figure 15:
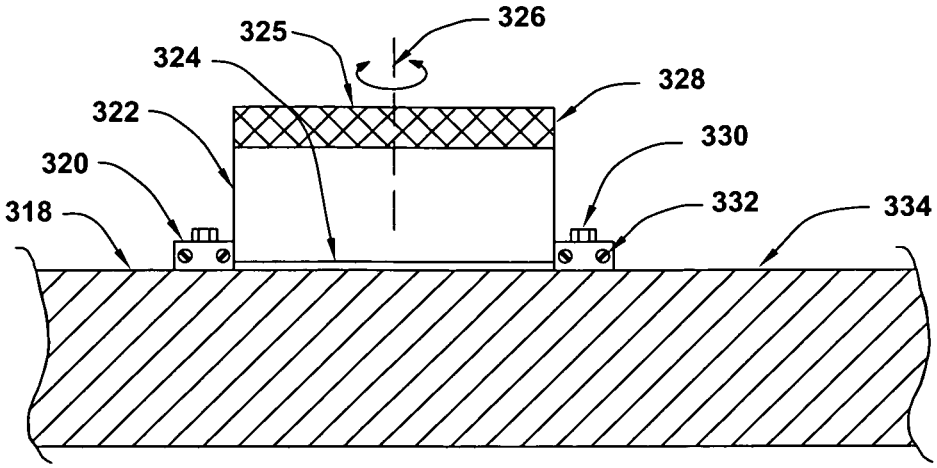
FIG. 15 is a cross section view of adjustable legs on a workpiece spindle.

FIG. 15 is a cross section view of adjustable legs on a workpiece spindle. A rotary workpiece spindle 322 is attached to a granite base 334 by fasteners 330 that are used to bolt the spindle legs 320 to the granite base 334. The spindle 322 has three equally spaced spindle legs 320 that are shown here attached to the bottom portion of the spindle 322 where there is a space gap 324 between the bottom of the spindle and the flat surface 318 of the granite base 334. The spindle 322 has a rotary spindle top 328 that rotates about a spindle axis 326 and the three spindle legs 320 are height-adjusted to align the spindle axis 326 approximately perpendicular with the top surface 318 of the approximately-flat or nominally-flat granite base 334. To adjust the height of the spindle leg 320, transverse bolts 332 are tightened to squeeze-adjust the spindle leg 320 where the spindle leg 320 distorts along the spindle axis 326 thereby raising the portion of the spindle 322 located adjacent to the transverse bolts 332 squeeze-adjusted spindle leg 320. After the three spindle legs 320 are adjusted to provide the desired height of the top flat surface of the spindle top 328 and provide the perpendicular alignment of the spindle axis 326 with the top surface 318 of the granite base 334, the spindle hold-down attachment bolts 330 are torque-controlled tightened to attach the spindle 322 to the granite base 334. The hold-down bolts 330 can be loosened and the spindle 322 removed and the spindle 322 then brought back to the same spindle 322 location and position on the granite base 334 for re-mounting on the granite base 334 without affecting the height of the spindle top 328 or perpendicular alignment of the spindle axis 326 because the controlled compressive force applied by the hold-down bolts 330 does not substantially affect the desired size-height distortion of the spindle legs 320 along the spindle rotation axis 326. The height adjustments provided by this adjustable spindle leg 320 can be extremely small, as little as 1 or 2 micrometers or even less such as 2 micro-inches, which is adequate for precision alignment adjustments required for air bearing spindles 322 that are typically used for the fixed-spindle floating-platen abrasive system (not shown). Also, these spindle leg 320 height adjustments are dimensionally stable over long periods of time because the squeeze forces produced by the transverse bolts 332 do not stress the spindle leg 320 material past its elastic limit. Here, the spindle leg 320 acts as a compression-spring where the spindle leg 320 height can be reversibly changed by changing the force applied by the transverse bolts 332 which is changed by changing the tightening-torque that is applied to these threaded transverse bolts 332. Using the same height-adjustment of the spindle legs 320, the spindles 322 can be aligned where ball the spindle 322 spindle-tops flat surfaces 325 can be aligned to be precisely co-planar with other spindle 322 (not shown) spindle-tops' flat surfaces 325.

Figure 16:
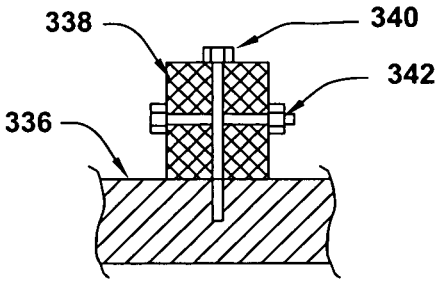
FIG. 16 is a cross section view of an adjustable spindle leg.

FIG. 16 is a cross section view of an adjustable spindle leg. A spindle leg 338 has transverse tightening bolts 342 that compress the spindle leg 338 along the axis of the transverse bolts 342. Spindle (not shown) hold-down bolts 340 are threaded to engage threads (not shown) in the granite base 336 but the compressive action applied on the spindle leg 338 by the hold-down bolts 340 along the axis of the hold-down bolt 340 is carefully controlled in concert with the compressive action of the transverse bolts 342 to provide the desired height-distortion of the spindle leg 338 along the axis of the hold-down bolts 340.

Figure 17:
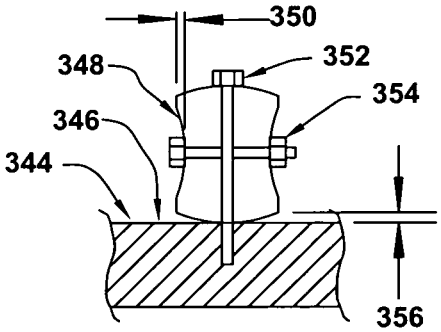
FIG. 17 is a cross section view of a compressed adjustable spindle leg.

FIG. 17 is a cross section view of a compressed adjustable spindle leg. A spindle leg 348 has transverse tightening bolts 354 that compress the spindle leg 348 along the longitudinal axis of the transverse bolts 354 by a distortion amount 350. Spindle (not shown) hold-down bolts 352 are threaded to engage threads (not shown) in the granite base 344 but the compressive action applied on the spindle leg 348 by the hold-down bolts 352 along the longitudinal axis of the hold-down bolt 352 is carefully controlled in concert with the compressive action of the transverse bolts 354 to provide the desired distortion 356 of the spindle leg 348 along the longitudinal axis of the hold-down bolts 352. The transverse bolts 354 create a transverse squeezing distortion 350 that is present on the spindle leg 348 and this transverse distortion 350 produces the desired height distortion 356 of the spindle leg 348. When the spindle leg 348 is distorted by the amount 356, the spindle is incrementally raised away from the surface 346 of the granite base 344 by this distance amount 356.

Figure 18:
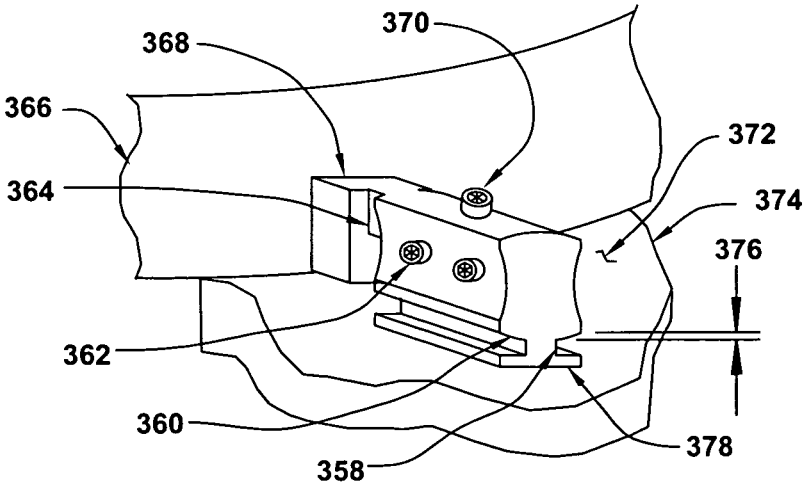
FIG. 18 is an isometric view of a compressed adjustable spindle leg.

FIG. 18 is an isometric view of a compressed adjustable spindle leg. A spindle leg 368 has transverse tightening bolts 362 that compress the spindle leg 360 along the axis of the transverse bolts 362. The spindle 366 has attached spindle legs 368 that have spindle hold-down bolts 370 that are threaded to engage threads (not shown) in the granite base 374. The compressive action applied on the spindle leg 368 by the hold-down bolts 370 along the longitudinal axis of the hold-down bolt 370 is carefully controlled in concert with the compressive action of the transverse bolts 362 to provide the desired distortion 376 of the spindle leg 368 along the longitudinal axis of the hold-down bolts 370. The transverse bolts 362 create a transverse squeezing distortion that is present on the spindle leg 368 and this transverse distortion produces the desired height distortion 376 of the spindle leg 368. When the spindle leg 368 is distorted by the amount 376, the spindle 366 is raised away from the surface 372 of the granite base 374 by this distance amount 376. A spindle leg 368 integral flat-base 378 having a distortion-isolation wall 358 provides flat-contact of the spindle leg 368 with the flat surface 372 of the granite base 374. The distortion-curvature 360 of the spindle leg 368 is shown where the spindle leg 368 leg integral flat-base 378 remains flat where it contacts the granite base 374 flat surface 372. A narrow but stiff bridge section 364 that is an integral portion of the spindle leg 368 isolates the spindle leg 368 distortion 376 from the body of the spindle 366.

Figure 19:
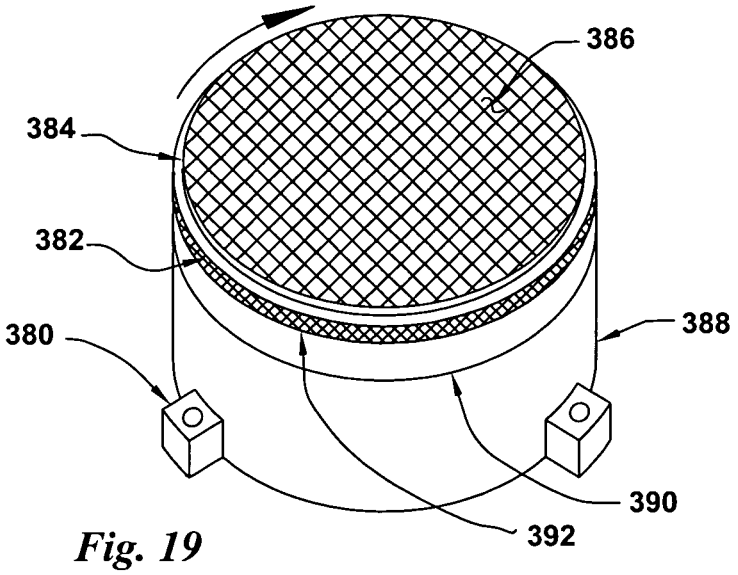
FIG. 19 is an isometric view of a workpiece spindle having three-point mounting legs.

FIG. 19 is an isometric view of a workpiece spindle having three-point mounting legs. The workpiece rotary spindle 388 has a rotary top 390 that has a precision-flat surface 392 to which is attached a precision-flat vacuum chuck device 382 that has co-planar opposed flat surfaces. A flat-surfaced workpiece 384 has an exposed flat surface 386 that is abraded by an abrasive coated platen (not shown). The workpiece spindle 388 is three-point supported by spindle legs 380. The workpiece 384 shown here has a diameter of almost 12 inches (300 mm) and is supported by a spindle 388 having a 12 inch (300 mm) diameter and a rotary top 390 top flat surface 392 that has a diameter of 12 inches (300 mm).

Figure 20:
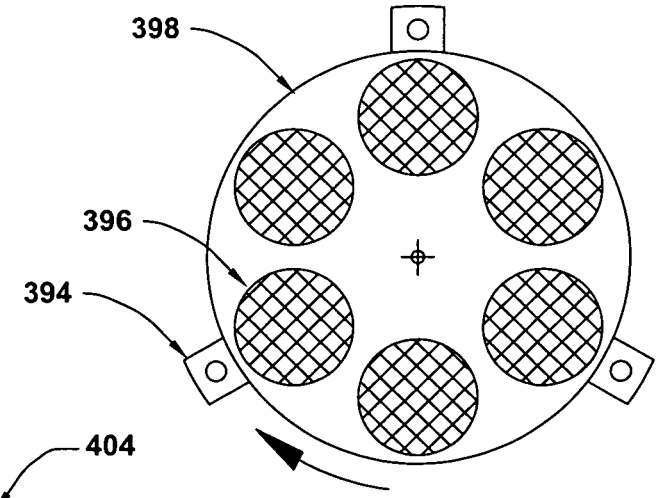
FIG. 20 is a top view of a workpiece spindle having multiple circular workpieces.

FIG. 20 is a top view of a workpiece spindle having multiple circular workpieces. A workpiece rotary spindle 398 having three-point support legs 394 where the spindle 398 supports small circular flat-surfaced workpieces 396 that are abraded by an abrasive coated platen (not shown).

Figure 21:
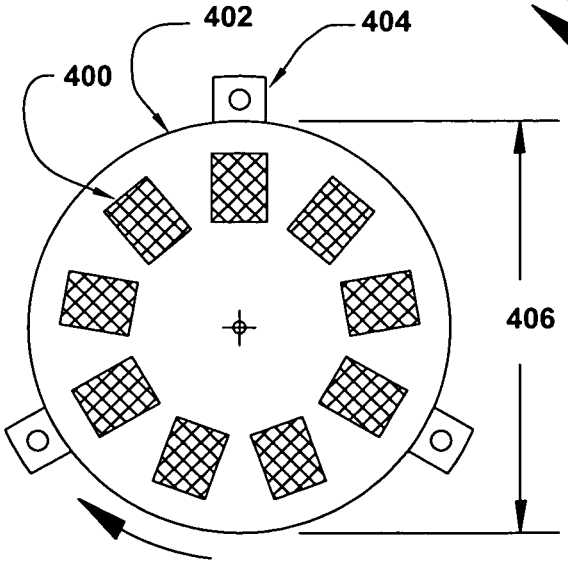
FIG. 21 is a top view of a workpiece spindle having multiple rectangular workpieces.

FIG. 21 is a top view of a workpiece spindle having multiple rectangular workpieces. A workpiece rotary spindle 402 having three-point support legs 404 where the spindle 402 supports small circular flat-surfaced workpieces 400 that are abraded by an abrasive coated platen (not shown). The spindle 402 has a spindle diameter 406.

Figure 22:
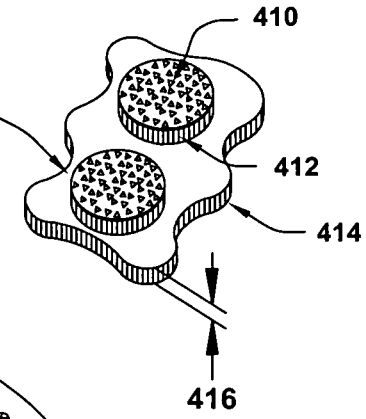
FIG. 22 is an isometric view of fixed-abrasive coated raised islands on an abrasive disk.

FIG. 22 is an isometric view of fixed-abrasive coated raised islands on an abrasive disk. Abrasive particle 410 coated raised islands 412 are attached to an abrasive disk 408 backing 414. The backing 414 has a backing thickness 416 that is thick enough to provide sufficient structural strength and support of the annular abrasive disk 408 whereby the disk 408 can be handled without damage to the disk 408 and where the disk 408 can be mounted to the flat annular surface of an abrading platen (not shown) where the disk 408 can be successfully attached to the platen abrasive disk 408 mounting surface with a vacuum attachment system (not shown). The backing 414 has a thickness 416 where the backing 414 is manufactured from a suitable backing material and has a suitable thickness 416 that together provide sufficient abrasive disk 408 strength and durability to resist dynamic abrading forces such that the backing 414 does not rip or tear or crumple when the abrasive disk 408 is subjected to abrading forces and abrading environments including water or water mist or chemicals that are present during the intended use of the abrasive disk 408.

Figure 23:
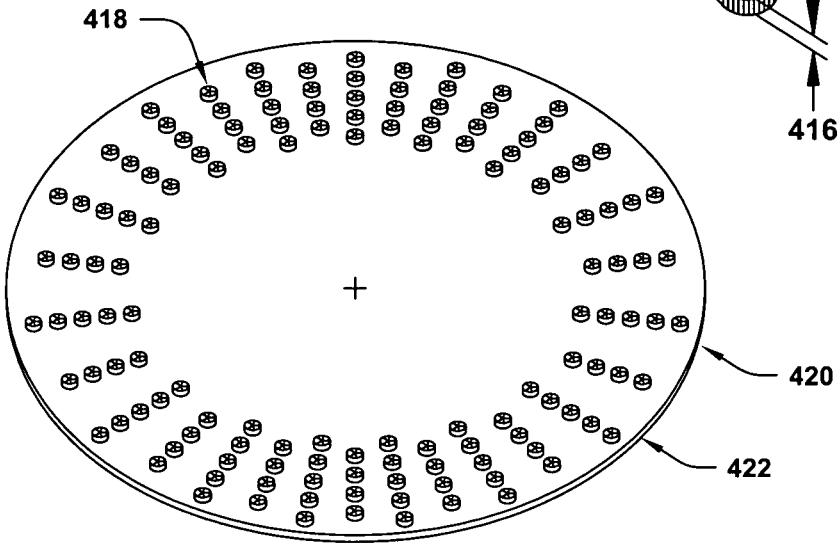
FIG. 23 is an isometric view of a fixed-abrasive coated raised island abrasive disk.

FIG. 23 is an isometric view of a fixed-abrasive coated raised island abrasive disk. Abrasive particle coated raised islands 418 are attached to an abrasive disk 422 backing 420.

Figure 24:
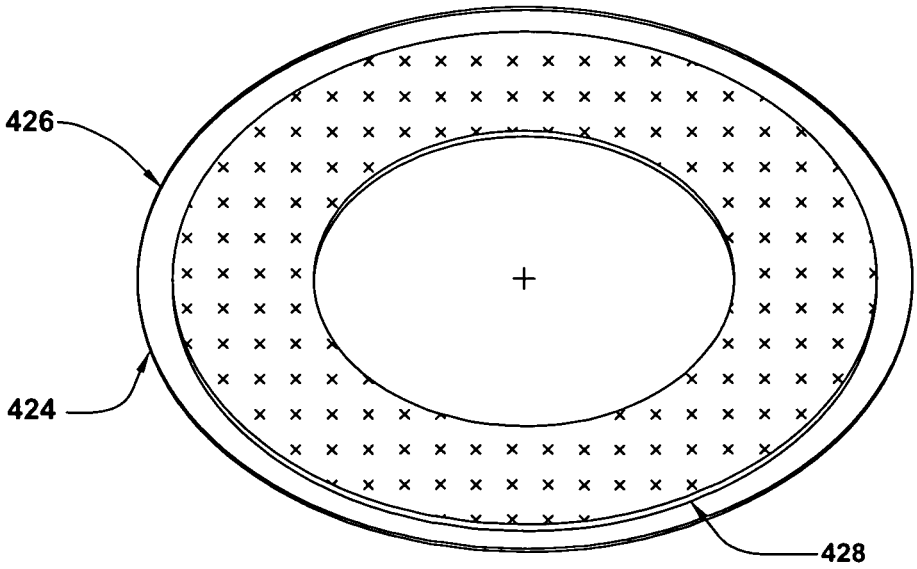
FIG. 24 is an isometric view of a solid-layer fixed-abrasive disk.

FIG. 24 is an isometric view of a flexible fixed-abrasive coated abrasive disk having a thick layer of solid abrasive material attached to the abrasive disk backing. A continuous flat-surfaced annular band of a thick layer of solid abrasive material 428 is attached to the flexible backing 424 of an abrasive disk 426 that can be attached with vacuum or by other mechanical attachment devices (not shown) to a flat-surfaced rotary platen (not shown).

FIG. 25 is an isometric view of fixed-abrasive coated raised islands on a flexible annular abrasive disk that has an open disk center. Abrasive particle 434 coated raised islands 436 are attached to an abrasive disk 432 backing 438 where the annular backing 438 has an abrasive disk 432 inner periphery 430. The backing 438 has a backing thickness 440 that is thick enough to provide sufficient structural strength and support of the annular abrasive disk 432 whereby the disk 432 can be handled without damage to the disk 432 and where the disk 432 can be mounted to the flat annular surface of an abrading platen (not shown) where the disk 432 can be successfully attached to the platen abrasive disk 432 mounting surface with a vacuum attachment system (not shown). The backing 438 has a thickness 430 where the backing 438 is manufactured from a suitable backing material and has a suitable thickness 430 that together provide sufficient abrasive disk 432 strength and durability to resist dynamic abrading forces such that the backing 438 does not rip or tear or crumple when the abrasive disk 432 is subjected to abrading forces and abrading environments including water or water mist or chemicals that are present during the intended use of the abrasive disk 432.

FIG. 26 is an isometric view of a fixed-abrasive coated raised island annular abrasive disk. Abrasive particle coated raised islands 442 are attached to an abrasive disk 446 backing 448 and where the annular abrasive disk 446 has an open center and also has an annular inner radius 444.

FIG. 27 is an isometric view of a flexible annular fixed-abrasive coated abrasive disk having a thick layer of solid abrasive material attached to the annular abrasive disk backing. A continuous flat-surfaced annular band of a thick layer of solid abrasive material 460 is attached to the annular flexible backing 452 of an abrasive disk 450 that can be attached with vacuum or by other mechanical attachment devices (not shown) to a flat-surfaced rotary platen (not shown). The annular abrasive material 460 has inner radius abrasive periphery 458 and the abrasive disk 450 annular backing 452 has an abrasive disk 450 annular backing 452 inner radius periphery 456.

Figure 28:
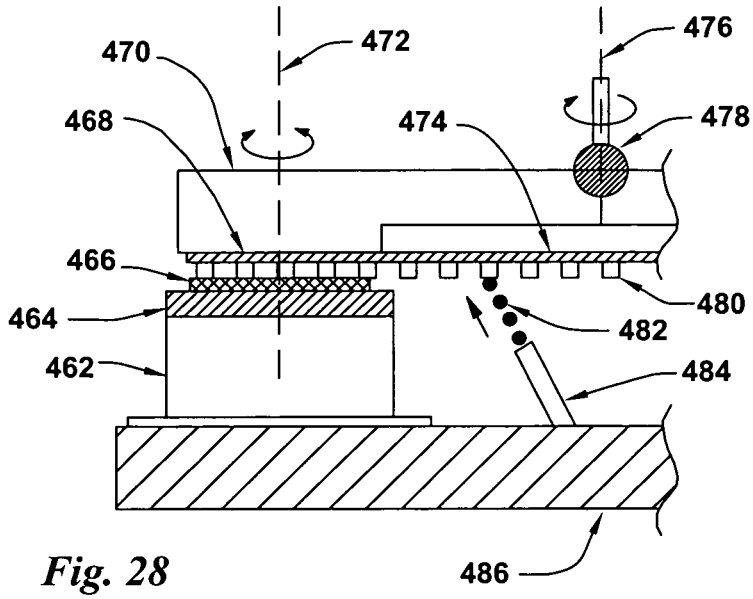
FIG. 28 is a cross section view of raised island structures abrading a spindle workpiece.

FIG. 28 is a cross section view of raised island structures on a disk that is used with an abrasive-slurry to abrade a workpiece that is attached to a fixed-position rotary spindle. A disk 474 having attached raised island structures 480 is attached to the flat-surfaced abrading-surface 468 of a rotary platen 470 that has a spherical-action spherical device 478 that allows the platen 470 to float while the platen 470 is rotated about a platen 470 rotation axis 476. A flat-surfaced workpiece 466 is attached to the flat surface of a rotary spindle 462 rotatable spindle-top 464. The spindle 462 is attached to an abrading machine base 486 and the spindle-top 464 rotates about a spindle axis 472. A liquid jet device 484 is attached to the machine base 486 and has a liquid stream of liquid droplets 482 where the liquid 482 comprises water, a slurry liquid that contains abrasive particles, including ceria, and chemicals including abrasive action enhancing chemicals and abrading agents including those used in chemical mechanical planarization (CMP) abrading processes.

Figure 29:
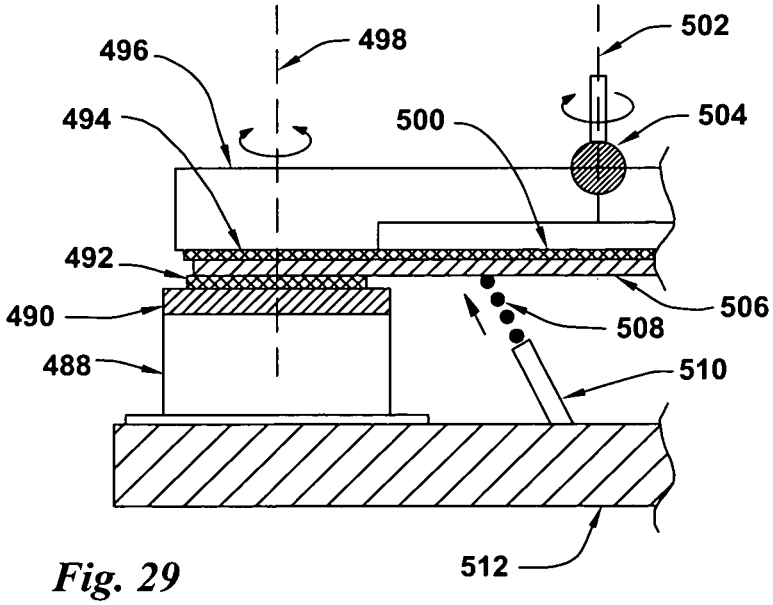
FIG. 29 is a cross section view of a porous pad with slurry abrading a spindle workpiece.

FIG. 29 is a cross section view of a porous pad on a disk that is used with an abrasive-slurry to abrade a workpiece that is attached to a fixed-position rotary spindle. A disk 500 having an attached porous pad 506 is attached to the flat-surfaced abrading-surface 494 of a rotary platen 496 that has a spherical-action spherical device 504 that allows the platen 496 to float while the platen 496 is rotated about a platen 496 rotation axis 502. A flat-surfaced workpiece 492 is attached to the flat surface of a rotary spindle 488 rotatable spindle-top 490. The spindle 488 is attached to an abrading machine base 512 and the spindle-top 490 rotates about a spindle axis 498. A liquid jet device 510 is attached to the machine base 512 and has a liquid stream of liquid droplets 508 where the liquid 508 comprises water, a slurry liquid that contains abrasive particles, including ceria, and chemicals including abrasive action enhancing chemicals and abrading agents including those used in chemical mechanical planarization (CMP) abrading processes.

Figure 30:
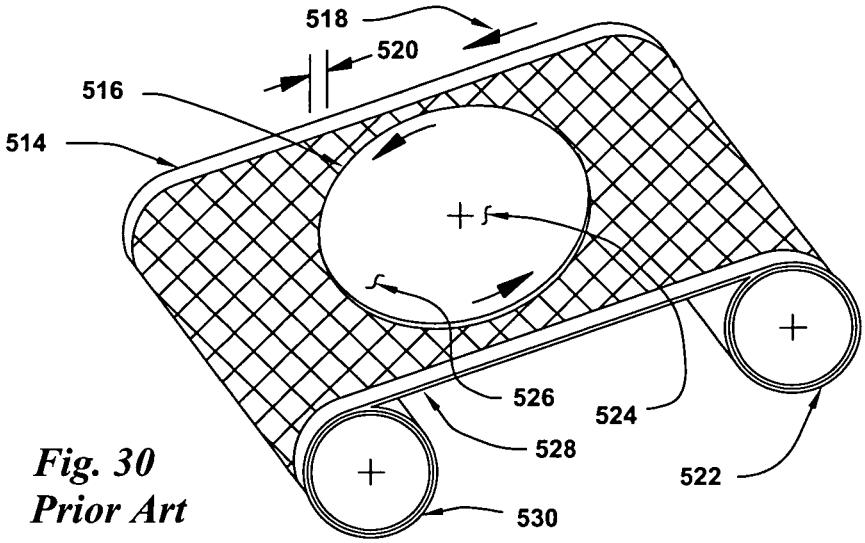
Fig. 30 Prior Art
FIG. 30 is an isometric view of a workpiece on a fixed-abrasive CMP web polisher.

FIG. 30 is an isometric view of a workpiece on a fixed-abrasive CMP web polisher. A fixed-abrasive CMP-type web polisher 514 has a flat mid-section and it has a web winder roll 530 and a web unwind roll 522 that advances the shallow-island fixed-abrasive flexible web 528. The web 528 is stationary during the flat workpiece 516 polishing action and the web 528 advances forward an incremental distance 520 in the direction 518 when a new workpiece 516 is polished. The workpiece 516 rotates with a high abrading speed at the outer periphery area 526 of the workpiece 516 and with a near-zero workpiece abrading speed at the inner portion area 524 of workpiece 516. Because the abrasive web 528 is not attached to the flat web 528 support plate (not shown) under the web 528, the abrasive web 528 can be wrinkled by the rubbing action of the rotating workpiece 516.

Figure 31:
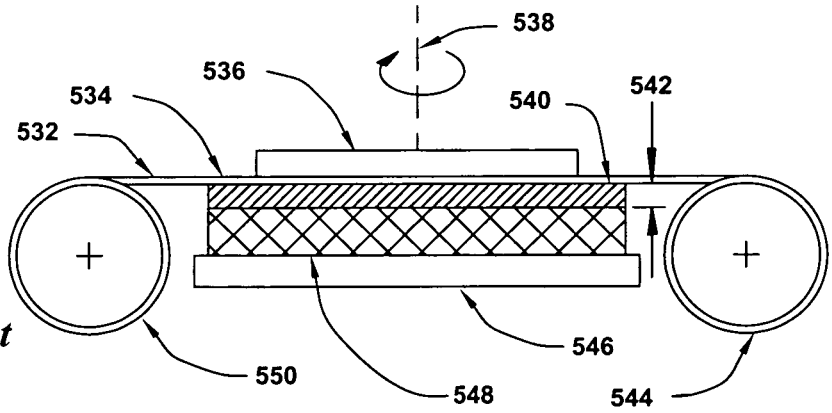
Fig. 31 Prior Art
FIG. 31 is a cross section view of a workpiece on a fixed-abrasive CMP web polisher.

FIG. 31 is a cross section view of a workpiece on a fixed-abrasive CMP web polisher. A fixed-abrasive CMP-type web polisher 532 has a flat mid-section and it has a web winder roll 550 and a web unwind roll 544 that advances the shallow-island fixed-abrasive flexible web 534. The shallow-island abrasive web 534 is stationary during the flat workpiece 536 polishing action procedure and the workpiece 536 rotates about an axis 538 while the fixed-abrasive web 534 is stationary. The flexible fixed-abrasive web 534 is supported by a rigid, or semi-rigid, polymer, or other material, flat-surfaced stationary plate 540. The stationary web support plate 540 has a dimensional thickness 542 that determines the stiffness of the web support platen 540. The web support plate 540 is attached to a resilient support base 548 that is supported by a rigid web polisher 532 base 546. The resilient support base 548 allows the web support plate 540 to tilt or to deform locally to provide near-flat-surface abrading contact with the rotating flat-surfaced workpiece 536. Typically the resilient support base 548 material has reduced-elastic deformation characteristics where some time period is required before the deformed material is restored to its original position after it was deformed by a high-spot area of a contacting rotating workpiece 536. Here, the support base 548 material experiences a motion-damping type of time delay in that it does not dimensionally respond quickly when it is allowed to return to its original shape after a surface deformation-causing force is removed. This damping-type of dimensional response prevents full abrading pressure contact to a moving low-spot area of the moving workpiece 536 that follows the high-spot area, especially if the workpiece 536 is rotated at high speeds. The result is that the support base 548 is not able to flex sufficiently fast to accommodate surface-defect variations of the abraded surface of the rotating workpiece 536 whereby undesirable non-uniform abrading action is applied across the abraded surface of the workpiece 536.

The workpiece 536 is typically a thin semiconductor wafer that is exceedingly flat. However, the flat top surface of the web support base 540 that is in direct contact with the abrasive web 534 typically has a flatness-variation accuracy that is significantly less than the flatness-variation accuracy of the semiconductor workpieces 536. Also, the abrading surface of the fixed-abrasive shallow-island web 534 has undesirable non-uniform down-stream web thickness variations. These variations occur because the web 534 abrasive surface is worn-down progressively as it advances incrementally with the sequential introduction of new workpiece 536 semiconductor wafers that are polished on the same portion of the shallow-island web 534 used to polish previous-polished workpieces 536.

Because the flexible abrasive web 534 is constructed from a thin polymer web material and the shallow islands have such small heights, this shallow-island abrasive web 534 has a high structural stiffness in the direction perpendicular to the flat surface of the web 534. Here, the high-spot non-planar imperfection areas of the web support plate 540 are directly translated to the localized web 534 abrasive contact areas with the flat surface of the wafer workpiece 536.

Intentional out-of-plane flexing of the thin wafer workpieces 536 can increase the sizes of the localized mutual abrading contact areas between portions of the wafer workpiece 536 and the abrasive web 534. However, most wafer-type workpieces 536 are typically mounted on rigid flat-surfaced carriers (not shown) that do not provide out-of-plane flexing of the workpiece 536 to match surface variations of the supporting plate 540.

The workpiece 536 has a rotation axis 538 and the abrading speed at the portion of the workpiece 536 near the workpiece 536 rotation axis is near-zero and the abrading speed near the outer periphery of the rotating workpiece 536 is maximum. The CMP-type abrading speed varies proportionally across the radial portion of the rotating workpiece 536. Because the abrasive web 534 is stationary, the abrasive web 534 does not contribute any abrading speed to any portion of the abraded surface of the flat-surfaced rotated workpieces 536. Here, the material removal rate from the workpiece 536 ranges from near-zero at the radial center of the workpiece 536 that is close to the workpiece 536 rotational axis 538 to a large material removal rate at the outer periphery of the rotating workpiece 536 instead of the desired uniform material removal rate across the full abraded surface of the workpiece 536.

Figure 32:
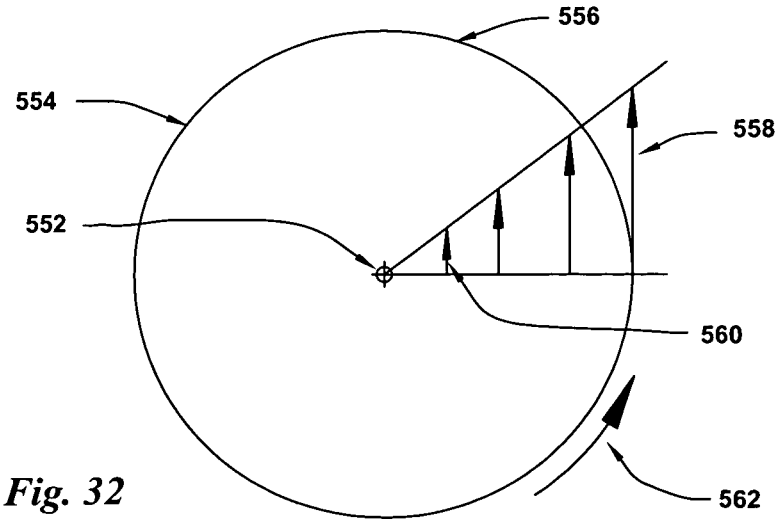
FIG. 32 is a top view of a rotating workpiece on a fixed-abrasive CMP web polisher.

FIG. 32 is a top view of a rotating workpiece on a fixed-abrasive CMP web polisher. The workpiece 554 rotates in a direction 562 about an axis 552 where the workpiece 554 has a maximum abrading speed 558 at the outer periphery 556 of the workpiece 554 and a minimum abrading speed 560 near the workpiece 554 center and an abrading speed of zero at the workpiece 554 rotation axis 552 location.

Automated Workpiece Loading Apparatus

An automated robotic workpiece loading apparatus is described that can selectively install and remove workpieces to and from an at least three-point fixed-spindle floating-platen abrading machine apparatus comprises:

a) at least three rotary spindles having circular rotatable flat-surfaced spindle-tops that each have a spindle-top axis of rotation at the center of a respective rotatable flat-surfaced spindle-top for respective rotary spindles;

b) wherein the at least three spindle-tops' axes of rotation are perpendicular to the respective spindle-tops' flat surfaces;

c) an abrading machine base having a horizontal flat top surface and a spindle-circle where the spindle-circle is coincident with the machine base flat top surface;

d) wherein the at least three rotary spindles are located with equal spaces between each of them and the spindle-tops' axes of rotation intersect the machine base spindle-circle and the rotary spindles are attached to the machine base top surface at those spindle-circle locations;

e) wherein the at least three spindle-tops' flat surfaces are aligned to be co-planar with each other;

f) a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the abrading platen precision-flat annular abrading-surface provides conformal support of the full-abrasive-surface of the flexible abrasive disk's abrasive coated surface annular band where the abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band;

i) wherein each flexible abrasive disk is attached in flat conformal contact with the abrading platen precision-flat annular abrading-surface by a disk attachment technique selected from the group consisting of vacuum disk attachment techniques, mechanical disk attachment techniques and adhesive disk attachment techniques;

j) wherein approximately equal thickness workpieces having parallel or near-parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

k) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and l) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) wherein the at least three spindle-tops having the attached approximately equal thickness workpieces can be rotated about the respective spindle-tops' rotation axes and the abrading platen having the attached flexible abrasive disk can be rotated about the abrading platen rotation axis to single-side abrade the approximately equal thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the approximately equal thickness workpieces that are attached to the respective at least three spindle-tops and where the abrading platen precision-flat annular abrading-surface assumes a co-planar alignment with the precisely co-planar flat surfaces of the respective at least three spindle-tops;

n) an automated robotic device that can sequentially transport and install selected flat-surfaced workpieces on the top flat surface on all of at least three spindle-top flat surfaces by picking selected individual workpieces from a corresponding workpiece storage device and transporting them to selected spindles' spindle-tops where the workpieces are positioned concentrically with the rotational centers of the respective rotatable spindle-tops and wherein the workpieces are attached to the respective spindle-tops for abrading action on the workpieces' flat surfaces by the abrading machine apparatus; and o) wherein the same automated robotic device can sequentially remove selected flat-surfaced workpieces from the top flat surfaces of all three spindle-tops by picking the individual workpieces from selected spindle-tops and transporting them to a corresponding workpiece storage device for storage.

This workpiece loader apparatus is described where it can selectively install and remove workpieces to and from an at least three-point fixed-spindle floating-platen abrading machine apparatus having a machine base that has a precision-flat surface where the at least three equal-height rotary spindles are mechanically attached to the machine base precision-flat top surface at those respective at least three rotary spindles' spindle-circle locations wherein the at least three spindle-tops' flat surfaces are aligned to be co-planar with each other.

This workpiece loader apparatus is described where it can also selectively install and remove workpieces to and from an at least three-point fixed-spindle floating-platen abrading machine apparatus having a machine base that has a nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

In addition, this workpiece loader apparatus is described where it can also selectively install and remove workpieces to and from an at least three-point fixed-spindle floating-platen abrading machine apparatus comprising:

a) a machine base having a nominally-flat surface;

b) rotary spindle two-piece spindle-mount devices consisting of a rotatable spindle-mount spherical-action rotor and a stationary spindle-mount spherical-base where both the rotatable spindle-mount spherical-action rotor and a stationary spindle-mount spherical-base have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices are able to lock the respective rotatable spindle-mount spherical-action rotors to the respective stationary spindle-mount spherical-bases;

c) wherein the at least three rotary spindles are located with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

d) wherein the at least three spindle-tops' flat surfaces are aligned to be co-planar with respect to each other by spherical rotation of the rotatable spindle-mount spherical-action rotors relative to the respective stationary spindle-mount spherical-bases;

e) wherein rotary spindle two-piece spindle-mount devices' locking devices are adapted to lock the respective rotatable spindle-mount spherical-action rotors to the respective stationary spindle-mount spherical-bases to structurally maintain the co-planar alignment of the at least three spindle-tops' flat surfaces.

Also, this workpiece loader apparatus is described where it can selectively install and remove workpieces to and from an at least three-point fixed-spindle floating-platen abrading machine apparatus wherein the at least three rotary spindles are air bearing rotary spindles.

A process is described where a robotic workpiece loading apparatus selectively installs and removes workpieces to and from an at least three-point fixed-spindle floating-platen abrading machine apparatus comprising:

a) providing at least three rotary spindles having circular rotatable flat-surfaced spindle-tops that each have a spindle-top axis of rotation at a center of a respective rotatable flat-surfaced spindle-top for respective rotary spindles;

b) wherein the at least three spindle-tops' axes of rotation are perpendicular to the respective spindle-tops' flat surfaces;

c) providing an abrading machine base having a horizontal flat top surface and a spindle-circle where the spindle-circle is coincident with the machine base flat top surface;

d) wherein the at least three rotary spindles are located with equal spaces between each of them and the spindle-tops' axes of rotation intersect the machine base spindle-circle and the rotary spindles are attached to the machine base top surface at those spindle-circle locations;

e) wherein that the at least three spindle-tops' flat surfaces are aligned to be co-planar with each other;

f) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the abrading platen precision-flat annular abrading-surface provides conformal support of the full-abrasive-surface of the flexible abrasive disk's abrasive coated surface annular band where the abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band;

i) wherein each flexible abrasive disk is attached in flat conformal contact with the abrading platen precision-flat annular abrading-surface by a disk attachment technique selected from the group consisting of vacuum disk attachment techniques, mechanical disk attachment techniques and adhesive disk attachment techniques;

j) providing approximately equal thickness workpieces having parallel or near-parallel opposed flat workpiece top surfaces and flat workpiece bottom surfaces that are attached in flat-surfaced contact with the flat surfaces of the respective at least three spindle-tops where the workpiece bottom surfaces contact the flat surfaces of the respective at least three spindle-tops;

k) moving the abrading platen vertically along the abrading platen rotation axis by the abrading platen spherical-action rotation device to allow the abrasive surface of the flexible abrasive disk that is attached to contact the abrading platen precision-flat annular abrading-surface to the top surfaces of the workpieces that are attached to the flat surfaces of the respective at least three spindle-tops wherein the at least three rotary spindles provide at least three-point support of the abrading platen; and l) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) wherein the at least three spindle-tops having the attached approximately equal thickness workpieces are rotated about the respective spindle-tops' rotation axes and the abrading platen having the attached flexible abrasive disk are rotated about the abrading platen rotation axis to single-side abrade the approximately equal thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the approximately equal thickness workpieces that are attached to the respective at least three spindle-tops and where the abrading platen precision-flat annular abrading-surface assumes a co-planar alignment with the precisely co-planar flat surfaces of the respective at least three spindle-tops;

n) sequentially transporting and installing selected flat-surfaced workpieces on the top flat surface on all of at least three spindle-top flat surfaces with an automated robot by picking selected individual workpieces from a corresponding workpiece storage device and transporting them to selected rotary spindles' spindle-tops and positioning the individual workpieces concentrically with the rotational centers of the respective rotatable spindle-tops and attaching the workpieces to the respective spindle-tops to abrade the workpieces' flat surfaces by the abrading machine apparatus; and o) wherein the same automated robotic device can sequentially remove selected flat-surfaced workpieces from the top flat surfaces of all three spindle-tops by picking the individual workpieces from selected spindle-tops and transporting them to a corresponding workpiece storage device for storage.

This workpiece loading process is also described where it can be used to selectively install and remove workpieces to and from an at least three-point fixed-spindle floating-platen abrading machine apparatus having a machine base that has a precision-flat surface where the at least three equal-height rotary spindles are mechanically attached to the machine base precision-flat top surface at those respective at least three rotary spindles' spindle-circle locations wherein the at least three spindle-tops' flat surfaces are aligned to be co-planar with each other.

In addition, this workpiece loading process is described where it can be used to selectively install and remove workpieces to and from an at least three-point fixed-spindle floating-platen abrading machine apparatus having a machine base that has a nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

Further, this workpiece loading process is described where it can be used to selectively install and remove workpieces to and from an at least three-point fixed-spindle floating-platen abrading machine apparatus having a machine base that comprises:

a) a machine base having a nominally-flat surface;

b) rotary spindle two-piece spindle-mount devices consisting of a rotatable spindle-mount spherical-action rotor and a stationary spindle-mount spherical-base where both have a common-radius spherical joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices have the capability to lock the respective rotatable spindle-mount spherical-action rotors to the respective stationary spindle-mount spherical-bases;

c) wherein the at least three rotary spindles are located with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

d) wherein the at least three spindle-tops' flat surfaces are aligned to be co-planar with each other by spherical rotation of the rotatable spindle-mount spherical-action rotors relative to the respective stationary spindle-mount spherical-bases;

e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

Also, this workpiece loading process is described where it can selectively install and remove workpieces to and from an at least three-point fixed-spindle floating-platen abrading machine apparatus wherein the at least three rotary spindles are air bearing rotary spindles.

An automated robotic abrasive disk loading apparatus is described that can selectively install and remove abrasive disks to and from a platen of an at least three-point fixed-spindle floating-platen abrading machine assembly apparatus comprising:

a) an at least three rotary spindles having circular rotatable flat-surfaced spindle-tops that each have a spindle-top axis of rotation at the center of a respective rotatable flat-surfaced spindle-top for respective rotary spindles;

b) wherein the at least three spindle-tops' axes of rotation are perpendicular to the respective spindle-tops' flat surfaces;

c) an abrading machine base having a horizontal flat top surface and a spindle-circle where the spindle-circle is coincident with the machine base flat top surface;

d) wherein the at least three rotary spindles are located with equal spaces between each of them and the spindle-tops' axes of rotation intersect the machine base spindle-circle and the rotary spindles are attached to the machine base top surface at those spindle-circle locations;

e) wherein the at least three spindle-tops' flat surfaces are aligned to be co-planar with each other;

f) a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the abrading platen precision-flat annular abrading-surface provides conformal support of the full-abrasive-surface of the flexible abrasive disk's abrasive coated surface annular band where the abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band;

i) wherein each flexible abrasive disk is attached in flat conformal contact with the abrading platen precision-flat annular abrading-surface by a disk attachment technique selected from the group consisting of vacuum disk attachment techniques, mechanical disk attachment techniques and adhesive disk attachment techniques;

j) approximately equal thickness workpieces having parallel or near-parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

k) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and l) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) wherein the at least three spindle-tops having the attached approximately equal thickness workpieces can be rotated about the respective spindle-tops' rotation axes and the abrading platen having the attached flexible abrasive disk can be rotated about the abrading platen rotation axis to single-side abrade the approximately equal thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the approximately equal thickness workpieces that are attached to the respective at least three spindle-tops and where the abrading platen precision-flat annular abrading-surface assumes a co-planar alignment with the precisely co-planar flat surfaces of the respective at least three spindle-tops;

n) an automated robotic device that can install selected abrasive disks comprising flexible abrasive disks, flexible raised-island abrasive disks, flexible abrasive disks having attached solid abrasive pellets, chemical mechanical planarization resilient disk pads, shallow-island abrasive disks, flat-surfaced slurry abrasive plate disks, and non-abrasive cloth or other material pads where the selected abrasive disks are attached to the platen flat-surfaced abrading by picking selected individual abrasive disks from a corresponding abrasive disk storage device and transporting it to the platen abrading surface where it is positioned concentrically with the rotational center of the platen and the flexible abrasive disk is pressed conformably against the abrading surface of the platen wherein the abrasive disk is attached to the platen abrading surface with vacuum for abrading action on the workpieces by the abrading machine apparatus;

o) and the same automated robotic device sequentially removes selected abrasive disk from the flat abrading surface of the platen by picking the abrasive disk from the platen after the abrasive disk attachment vacuum is released and transporting the abrasive disk to an abrasive disk storage device for storage.

In addition, this robotic abrasive disk loading apparatus is described where it can adapted to selectively install and remove abrasive disks to and from a platen of an at least three-point fixed-spindle floating-platen abrading machine apparatus having a machine base that has a precision-flat surface where the at least three equal-height rotary spindles are mechanically attached to the machine base precision-flat top surface at those respective at least three rotary spindles' spindle-circle locations wherein the at least three spindle-tops' flat surfaces are aligned to be co-planar with each other.

Further, this robotic abrasive disk loading apparatus is described where it can be adapted to selectively install and remove abrasive disks to and from a platen of an at least three-point fixed-spindle floating-platen abrading machine apparatus having a machine base that has a nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

Also, this robotic abrasive disk loading apparatus is described where it can be adapted to selectively install and remove abrasive disks to and from a platen of an at least three-point fixed-spindle floating-platen abrading machine apparatus comprising:

a) a machine base having a nominally-flat surface;

b) rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices have the capability to lock the respective rotatable spindle-mount spherical-action rotors to the respective stationary spindle-mount spherical-bases;

c) wherein the at least three rotary spindles are located with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

d) wherein the at least three spindle-tops' flat surfaces are aligned to be co-planar with each other by spherical rotation of the rotatable spindle-mount spherical-action rotors relative to the respective stationary spindle-mount spherical-bases;

e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

Also, this robotic abrasive disk loading apparatus is described where the at least three rotary spindles are air bearing rotary spindles.

A process is described where an automated robotic abrasive disk loading apparatus can adapted to selectively install and remove abrasive disks to and from a platen of an at least three-point fixed-spindle floating-platen abrading machine assembly apparatus comprising:

a) providing at least three rotary spindles having circular rotatable flat-surfaced spindle-tops that each have a spindle-top axis of rotation at the center of a respective rotatable flat-surfaced spindle-top for respective rotary spindles;

b) wherein that the at least three spindle-tops' axes of rotation are perpendicular to the respective spindle-tops' flat surfaces;

c) providing an abrading machine base having a horizontal flat top surface and a spindle-circle where the spindle-circle is coincident with the machine base flat top surface;

d) wherein the at least three rotary spindles are located with equal spacing between each of them and the spindle-tops' axes of rotation intersect the machine base spindle-circle and the rotary spindles are attached to the machine base top surface at those spindle-circle locations;

e) wherein the at least three spindle-tops' flat surfaces are aligned to be co-planar with each other;

f) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) providing flexible abrasive disk articles having annular bands of abrasive coated surfaces that have an abrasive coated surface annular band radial width and an abrasive coated surface annular band inner radius and an abrasive coated surface annular band outer radius where the selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the abrading platen precision-flat annular abrading-surface provides conformal support of the full-abrasive-surface of the flexible abrasive disk's abrasive coated surface annular band where the abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band;

i) wherein each flexible abrasive disk is attached in flat conformal contact with the abrading platen precision-flat annular abrading-surface by a disk attachment technique selected from the group consisting of vacuum disk attachment techniques, mechanical disk attachment techniques and adhesive disk attachment techniques;

j) providing approximately equal thickness workpieces having parallel or near-parallel opposed flat workpiece top surfaces and flat workpiece bottom surfaces that are attached in flat-surfaced contact with the flat surfaces of the respective at least three spindle-tops where the workpiece bottom surfaces contact the flat surfaces of the respective at least three spindle-tops;

k) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and l) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) wherein the at least three spindle-tops having the attached approximately equal thickness workpieces can be rotated about the respective spindle-tops' rotation axes and the abrading platen having the attached flexible abrasive disk can be rotated about the abrading platen rotation axis to single-side abrade the approximately equal thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the approximately equal thickness workpieces that are attached to the respective at least three spindle-tops and where the abrading platen precision-flat annular abrading-surface assumes a co-planar alignment with the precisely co-planar flat surfaces of the respective at least three spindle-tops;

n) providing an automated robotic device that can install selected abrasive disks comprising flexible abrasive disks, flexible raised-island abrasive disks, flexible abrasive disks having attached solid abrasive pellets, chemical mechanical planarization resilient disk pads, shallow-island abrasive disks, flat-surfaced slurry abrasive plate disks, and non-abrasive cloth or other material pads where the selected abrasive disks are attached to the platen flat-surfaced abrading surface by picking selected individual abrasive disks from a corresponding abrasive disk storage device and transporting it to the platen abrading surface where an individual selected disk is positioned concentrically with the rotational center of the platen and the flexible abrasive disk is pressed conformably against the abrading surface of the platen wherein the abrasive disk is attached to the platen abrading surface with vacuum for abrading action on the workpieces by the abrading machine apparatus;

o) wherein the same automated robotic device sequentially removes selected abrasive disk from the flat abrading surface of the platen by picking the abrasive disk from the platen after the abrasive disk attachment vacuum is released and transporting the abrasive disk to an abrasive disk storage device for storage.

This process is also described wherein the robotic abrasive disk loading apparatus can adapted to selectively install and remove abrasive disks to and from a platen of an at least three-point fixed-spindle floating-platen abrading machine apparatus having a machine base that has a machine base precision-flat surface where the at least three equal-height rotary spindles are mechanically attached to the machine base precision-flat top surface at those respective at least three rotary spindles' spindle-circle locations wherein the at least three spindle-tops' flat surfaces are aligned to be co-planar with each other.

In addition, this process is described where the robotic abrasive disk loading apparatus can be adapted to selectively install and remove abrasive disks to and from a platen of an at least three-point fixed-spindle floating-platen abrading machine apparatus having a machine base that has a machine base nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

Further, this process is described where the robotic abrasive disk loading apparatus can be adapted to selectively install and remove abrasive disks to and from a platen of an at least three-point fixed-spindle floating-platen abrading machine apparatus comprising:

a) a machine base having a nominally-flat surface;

b) rotary spindle two-piece spindle-mount devices consisting essentially of a rotatable spindle-mount spherical-action rotor and a stationary spindle-mount spherical-base where both have a common-radius spherical joint wherein the rotatable spindle-mount spherical-action rotors are mounted in common-radius spherical joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices are adapted to lock the respective rotatable spindle-mount spherical-action rotors to respective stationary spindle-mount spherical-bases;

c) wherein the at least three rotary spindles are located with approximately equal spacing between the at least three of the rotary spindles and the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

d) wherein the at least three spindle-tops' flat surfaces are adapted to be aligned to be co-planar with each other by spherical rotation of the rotatable spindle-mount spherical-action rotors relative to the respective stationary spindle-mount spherical-bases;

e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

Also, this process is described where the at least three rotary spindles are air bearing rotary spindles.

What is claimed:

1. An automated robotic workpiece loading apparatus that can selectively install and remove workpieces to and from an at least three-point fixed-spindle floating-platen abrading machine apparatus, the automated workpiece loading apparatus comprising: a) at least three rotary spindles having circular rotatable flat-surfaced spindle-tops that each have a spindle-top axis of rotation at a center of a respective rotatable flat-surfaced spindle-top for respective rotary spindles; b) wherein the at least three spindle-tops' axes of rotation are perpendicular to the respective rotatable flat-surfaced spindle-tops' flat surfaces; c) an abrading machine base having a horizontal flat top surface and a spindle-circle where the spindle-circle is coincident with the abrading machine base flat top surface; d) wherein the at least three rotary spindles are located with equal spaces between each of them and the spindle-tops' axes of rotation intersect the machine base spindle-circle at an intersection point, and the at least three rotary spindles are attached to the machine base top surface at machine base spindle-circle at respective intersection points; e) wherein the at least three spindle-tops' flat surfaces are aligned to be co-planar with each other; f) a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about an abrading platen rotation axis located at a rotational center of the floating, rotatable abrading platen by a spherical-action rotation device located at a rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle; g) wherein the floating, rotatable abrading platen spherical-action rotation device allows spherical motion of the floating, rotatable abrading platen about the floating, rotatable abrading platen rotational center where a precision-flat annular abrading-surface of the floating, rotatable abrading platen that is supported by the floating, rotatable abrading platen spherical-action rotation device is nominally horizontal; and h) flexible abrasive disk articles having annular bands of abrasive coated surfaces that have an abrasive coated surface annular band radial width and an abrasive coated surface annular band inner radius and an abrasive coated surface annular band outer radius where a flexible abrasive disk is attached in flat conformal contact with an floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk's abrasive coated annular abrading band and wherein the floating, rotatable abrading platen precision-flat annular abrading-surface provides conformal support of the full-abrasive-surface of the flexible abrasive disk's abrasive coated surface annular band where the floating, rotatable abrading platen precision-flat annular abrading-surface inner radius is less than the inner radius of the attached flexible abrasive disk's abrasive coated surface annular band and where the floating, rotatable abrading platen precision-flat annular abrading-surface outer radius is greater than the outer radius of the attached flexible abrasive disk's abrasive coated surface annular band; i) wherein each flexible abrasive disk is attached in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques; j) wherein approximately equal thickness workpieces having parallel or near-parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops; k) wherein the floating, rotatable abrading platen is moveable vertically along the floating, rotatable abrading platen rotation axis by the floating, rotatable abrading platen spherical-action rotation device to allow the abrasive surface of the flexible abrasive disk that is attached to the floating, rotatable abrading platen precision-flat annular abrading-surface to contact the top surfaces of the workpieces that are attached to the flat surfaces of the respective at least three spindle-tops wherein the at least three rotary spindles provide at least three-point support of the floating, rotatable abrading platen; and l ) wherein the total floating, rotatable abrading platen abrading contact force applied to workpieces that are attached to the respective at least three spindle-top flat surfaces by contact of the abrasive surface of the flexible abrasive disk that is attached to the floating, rotatable abrading platen precision-flat annular abrading-surface with the top surfaces of the workpieces that are attached to the flat surfaces of the respective at least three spindle-tops is controlled through the abrading platen spherical-action floating, rotatable abrading platen rotation device to allow the total abrading platen abrading contact force to be evenly distributed to the workpieces attached to the respective at least three spindle-tops; m) wherein the at least three spindle-tops having the attached approximately equal thickness workpieces can be rotated about the respective spindle-tops' rotation axes and the floating, rotatable abrading platen having the attached flexible abrasive disk can be rotated about the floating, rotatable abrading platen rotation axis to single-side abrade the approximately equal thickness workpieces that are attached to the flat surfaces of the at least three spindle-tops while the moving abrasive surface of the flexible abrasive disk that is attached to the moving floating, rotatable abrading platen precision-flat annular abrading-surface is in force-controlled abrading contact with the top surfaces of the approximately equal thickness workpieces that are attached to the respective at least three spindle-tops and where the floating, rotatable abrading platen precision-flat annular abrading-surface assumes a co-planar alignment with the precisely co-planar flat surfaces of the respective at least three spindle-tops; n) an automated robotic device that can sequentially transport and install flat-surfaced workpieces on the top flat surface on all of at least three spindle-top flat surfaces by picking individual workpieces from a corresponding workpiece storage device and transporting the individual workpieces to spindle-tops where the individual workpieces are positioned concentrically with the rotational centers of the respective rotatable spindle-tops and wherein the workpieces are attached to the respective spindle-tops for abrading action on the workpieces' flat surfaces by the abrading machine apparatus; and o) wherein the same automated robotic device can sequentially remove selected flat-surfaced workpieces from the top flat surfaces of all three spindle-tops by picking the individual workpieces from the spindle-tops and transporting them to a corresponding workpiece storage device for storage.

2. The apparatus of claim 1 wherein the robotic workpiece loading apparatus is adapted to selectively install and remove workpieces to and from an at least three-point fixed-spindle floating-platen abrading machine apparatus having a machine base that has a precision-flat surface where the at least three equal-height rotary spindles are mechanically attached to the machine base precision-flat top surface at respective at least three rotary spindles' spindle-circle locations wherein the at least three spindle-tops' flat surfaces are aligned to be co-planar with each other.

3. The apparatus of claim 1 wherein the robotic workpiece loading apparatus is adapted to selectively install and remove workpieces to and from an at least three-point fixed-spindle floating-platen abrading machine apparatus having a machine base that has a nominally-flat surface where the at least three rotary spindles are mechanically attached to the machine base nominally-flat top surface at respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

4. The apparatus of claim 1 wherein the robotic workpiece loading apparatus is adapted to selectively install and remove workpieces to and from an at least three-point fixed-spindle floating-platen abrading machine apparatus comprising: a) a machine base having a nominally-flat surface; b) rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices are able to lock the respective rotatable spindle-mount spherical-action rotors to the respective stationary spindle-mount spherical-bases; c) wherein the at least three rotary spindles are located with approximately equal spacing between the at least three of the rotary spindles and the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations; d) wherein the at least three spindle-tops' flat surfaces are aligned to be co-planar with respect to each other by spherical rotation of the rotatable spindle-mount spherical-action rotors relative to the respective stationary spindle-mount spherical-bases; e) wherein rotary spindle two-piece spindle-mount devices' locking devices are adapted to lock the respective rotatable spindle-mount spherical-action rotors to the respective stationary spindle-mount spherical-bases to maintain the co-planar alignment of the at least three spindle-tops' flat surfaces.

5. The apparatus of claim 1 wherein the at least three rotary spindles are air bearing rotary spindles.

6. A process of a robotic workpiece loading apparatus selectively installing and removing workpieces to and from an at least three-point fixed-spindle floating-platen abrading machine apparatus comprising: a) providing at least three rotary spindles having circular rotatable flat-surfaced spindle-tops that each have a spindle-top axis of rotation at a center of a respective rotatable flat-surfaced spindle-top for respective rotary spindles; b) wherein the at least three spindle-tops' axes of rotation are perpendicular to the respective spindle-tops' flat surfaces; c) providing an abrading machine base having a horizontal flat top surface and a spindle-circle where the spindle-circle is coincident with the machine base flat top surface; and wherein the at least three rotary spindles are located with equal spacing among each of them and the at least three spindle-tops' axes of rotation intersect the machine base spindle-circle and the rotary spindles are attached to the machine base top surface at those spindle-circle locations; and wherein that the at least three spindle-tops' flat surfaces are aligned to be co-planar with each other; d) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle; e) the abrading platen spherical-action rotation device spherically moves the abrading platen about the abrading platen rotational center where the precision-flat annular abrading-surface of the abrading platen that is supported by the abrading platen spherical-action rotation device is nominally horizontal; and f) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the abrading platen precision-flat annular abrading-surface provides conformal support of the full-abrasive-surface of the flexible abrasive disk's abrasive coated surface annular band where the abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band; g) wherein each flexible abrasive disk is attached in flat conformal contact with the abrading platen precision-flat annular abrading-surface by a disk attachment technique selected from the group consisting of vacuum disk attachment techniques, mechanical disk attachment techniques and adhesive disk attachment techniques; h) providing approximately equal thickness workpieces having parallel or near-parallel opposed flat workpiece top surfaces and flat workpiece bottom surfaces that are attached in flat-surfaced contact with the flat surfaces of the respective at least three spindle-tops where the workpiece bottom surfaces contact the flat surfaces of the respective at least three spindle-tops; i) moving the abrading platen vertically along the abrading platen rotation axis by the abrading platen spherical-action rotation device to contact the abrasive surface of the flexible abrasive disk that is attached to the abrading platen precision-flat annular abrading-surface to the top surfaces of the workpieces that are attached to the flat surfaces of the respective at least three spindle-tops wherein the at least three rotary spindles provide at least three-point support of the abrading platen; and j) applying a total abrading platen abrading contact force to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops; k) wherein the at least three spindle-tops having the attached approximately equal thickness workpieces are rotated about the respective spindle-tops' rotation axes and the abrading platen having the attached flexible abrasive disk are rotated about the abrading platen rotation axis to single-side abrade the approximately equal thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the approximately equal thickness workpieces that are attached to the respective at least three spindle-tops and where the abrading platen precision-flat annular abrading-surface assumes a co-planar alignment with the precisely co-planar flat surfaces of the respective at least three spindle-tops; l) sequentially transporting and installing flat-surfaced workpieces on the top flat surface on all of at least three spindle-top flat surfaces with an automatic robot by picking individual workpieces from a corresponding workpiece storage device and transporting them to selected rotary spindles' spindle-tops; m) positioning the individual workpieces concentrically with the rotational centers of the respective rotatable spindle-tops and attaching the workpieces to the respective spindle-tops to abrade the workpieces' flat surfaces by the abrading machine apparatus; and n) wherein the automated robot sequentially removes flat-surfaced workpieces from the top flat surfaces of all three spindle-tops by picking the individual workpieces from selected spindle-tops and transporting them to a corresponding workpiece storage device for storage.

7. The process of claim 6 wherein the robotic workpiece loading apparatus selectively installs and removes workpieces to and from an at least three-point fixed-spindle floating-platen abrading machine apparatus having a machine base that has a precision-flat surface where at least three equal-height rotary spindles are mechanically attached to the machine base precision-flat top surface at those respective at least three rotary spindles' spindle-circle locations wherein the at least three spindle-tops' flat surfaces are aligned to be co-planar with each other.

8. The process of claim 6 wherein the robotic workpiece loading apparatus selectively installs and removes workpieces to and from an at least three-point fixed-spindle floating-platen abrading machine apparatus having a machine base that has a nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

9. The process of claim 6 wherein the robotic workpiece loading apparatus selectively installs and removes workpieces to and from an at least three-point fixed-spindle floating-platen abrading machine apparatus comprising: a) a machine base having a nominally-flat surface; b) rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices lock the respective rotatable spindle-mount spherical-action rotors to the respective stationary spindle-mount spherical-bases; c) wherein the at least three rotary spindles are located with near-equal spacing between the at least three of the rotary spindles and that the at least three spindle-tops' axes of rotation intersect the machine base spindle-circle at an intersection point and where the respective at least three rotary spindle two-piece spindle-mount devices' spindle-mount spherical-bases are mechanically attached to the machine base nominally-flat top surface at respective intersection points on the at least three rotary spindles' spindle-circle locations; d) wherein the at least three spindle-tops' flat surfaces are aligned to be co-planar with each other by spherical rotation of the rotatable spindle-mount spherical-action rotors relative to the respective stationary spindle-mount spherical-bases; e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

10. The process of claim 6 wherein the at least three rotary spindles are air bearing rotary spindles.

11. An automated robotic abrasive disk loading apparatus adapted to selectively install and remove abrasive disks to and from a platen of an at least three-point fixed-spindle floating-platen abrading machine assembly apparatus comprising: a) an at least three rotary spindles having circular rotatable flat-surfaced spindle-tops that each have a spindle-top axis of rotation at the center of a respective rotatable flat-surfaced spindle-top for respective rotary spindles; b) wherein the at least three spindle-tops' axes of rotation are perpendicular to the respective spindle-tops' flat surfaces; c) an abrading machine base having a horizontal flat top surface and a spindle-circle where the spindle-circle is coincident with the machine base flat top surface; d) wherein the at least three rotary spindles are located with equal spacing between each of them and the spindle-tops' axes of rotation intersect the machine base spindle-circle at intersection points and the rotary spindles are attached to the machine base top surface at respective spindle-circle intersection points; e) wherein the at least three spindle-tops' flat surfaces are aligned to be co-planar with each other; f) a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about a floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle; g) wherein the floating, rotatable abrading platen spherical-action rotation device allows spherical motion of the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and h) flexible abrasive disk articles having annular bands of abrasive coated surfaces that have an abrasive coated surface annular band radial width and an abrasive coated surface annular band inner radius and an abrasive coated surface annular band outer radius where the selected flexible abrasive disk is attached in flat conformal contact with a floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk's abrasive coated annular abrading band and wherein the floating, rotatable abrading platen precision-flat annular abrading-surface provides conformal support of the full-abrasive-surface of the flexible abrasive disk's abrasive coated surface annular band where the floating, rotatable abrading platen precision-flat annular abrading-surface inner radius is less than the inner radius of the attached flexible abrasive disk's abrasive coated surface annular band and where the floating, rotatable abrading platen precision-flat annular abrading-surface outer radius is greater than the outer radius of the attached flexible abrasive disk's abrasive coated surface annular band; i) wherein each flexible abrasive disk is attached in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques; j) approximately equal thickness workpieces having parallel or near-parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops; k) wherein the floating, rotatable abrading platen can be moved vertically along the abrading platen rotation axis by the floating, rotatable abrading platen spherical-action rotation device to allow the abrasive surface of the flexible abrasive disk that is attached to the floating, rotatable abrading platen precision-flat annular abrading-surface to contact the top surfaces of the workpieces that are attached to the flat surfaces of the respective at least three spindle-tops wherein the at least three rotary spindles provide at least three-point support of the floating, rotatable abrading platen; and l) wherein a total floating, rotatable abrading platen abrading contact force applied to equal thickness workpieces that are attached to the respective at least three spindle-top flat surfaces by contact of the abrasive surface of the flexible abrasive disk that is attached to the floating, rotatable abrading platen precision-flat annular abrading-surface with the top surfaces of the workpieces that are attached to the flat surfaces of the respective at least three spindle-tops is controlled through the floating, rotatable abrading platen spherical-action abrading platen rotation device to allow the total floating, rotatable abrading platen abrading contact force to be evenly distributed to the workpieces attached to the respective at least three spindle-tops; m) wherein the at least three spindle-tops having the attached approximately equal thickness workpieces can be rotated about the respective spindle-tops' rotation axes and the floating, rotatable abrading platen having the attached flexible abrasive disk can be rotated about the floating, rotatable abrading platen rotation axis to single-side abrade the approximately equal thickness workpieces attached to the flat surfaces of the at least three spindle-tops while the moving abrasive surface of the flexible abrasive disk that is attached to the moving floating, rotatable abrading platen precision-flat annular abrading-surface is in force-controlled abrading contact with the top surfaces of the approximately equal thickness workpieces that are attached to the respective at least three spindle-tops and where the floating, rotatable abrading platen precision-flat annular abrading-surface assumes a co-planar alignment with the precisely co-planar flat surfaces of the respective at least three spindle-tops; n) an automated robotic device that can install abrasive disks selected from the group consisting of: flexible abrasive disks, flexible raised-island abrasive disks, flexible abrasive disks having attached solid abrasive pellets, chemical mechanical planarization resilient disk pads, shallow-island abrasive disks, flat-surfaced slurry abrasive plate disks, non-abrasive cloth and material pads where the selected abrasive disks are attached to the floating, rotatable platen flat-surfaced abrading surface by selecting individual abrasive disks from a corresponding abrasive disk storage device and transporting it to the floating, rotatable platen abrading surface where an individual selected disk is positioned concentrically with the rotational center of the floating, rotatable abrading platen and the flexible abrasive disk is pressed conformably against the abrading surface of the floating, rotatable abrading platen wherein the abrasive disk is attached to the floating, rotatable abrading platen abrading surface with vacuum for abrading action on the workpieces by the abrading machine apparatus; o) and the automated robotic device sequentially removes selected abrasive disk from the flat abrading surface of the platen by picking the abrasive disk from the platen after the abrasive disk attachment vacuum is released and transporting the abrasive disk to an abrasive disk storage device for storage.

12. The apparatus of claim 11 wherein the robotic abrasive disk loading apparatus is adapted to selectively install and remove abrasive disks to and from a platen of an at least three-point fixed-spindle floating-platen abrading machine apparatus having a machine base that has a precision-flat surface where the at least three equal-height rotary spindles are mechanically attached to the machine base precision-flat top surface at respective at least three rotary spindles' spindle-circle intersection points wherein the at least three spindle-tops' flat surfaces are aligned to be co-planar with each other.

13. The apparatus of claim 11 wherein the robotic abrasive disk loading apparatus is adapted to selectively install and remove abrasive disks to and from a platen of an at least three-point fixed-spindle floating-platen abrading machine apparatus having a machine base that has a nominally-flat surface where the at least three rotary spindles are mechanically attached to the machine base nominally-flat top surface at those respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

14. The apparatus of claim 11 wherein the robotic abrasive disk loading apparatus is adapted to selectively install and remove abrasive disks to and from a floating, rotatable abrading platen of an at least three-point fixed-spindle floating-platen abrading machine apparatus comprising: a) a machine base having a nominally-flat surface; b) rotary spindle two-piece spindle-mount devices consisting essentially of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices are adapted to lock the respective rotatable spindle-mount spherical-action rotors to respective stationary spindle-mount spherical-bases; c) wherein the at least three rotary spindles are located with approximately equal spacing between the at least three of the rotary spindles and the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations; d) wherein the at least three spindle-tops' flat surfaces are adapted to be aligned to be co-planar with each other by spherical rotation of the rotatable spindle-mount spherical-action rotors relative to the respective stationary spindle-mount spherical-bases; e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

15. The apparatus of claim 11 wherein the at least three rotary spindles are air bearing rotary spindles.

16. A process of an automated robotic abrasive disk loading apparatus selectively installing and removing abrasive disks to and from a platen of an at least three-point fixed-spindle floating-platen abrading machine assembly apparatus comprising: a) providing at least three rotary spindles having circular rotatable flat-surfaced spindle-tops that each have a spindle-top axis of rotation at a center of a respective rotatable flat-surfaced spindle-top for respective rotary spindles; b) wherein that the at least three spindle-tops' axes of rotation are perpendicular to the respective spindle-tops' flat surfaces; c) providing an abrading machine base having a horizontal flat top surface and a spindle-circle where the spindle-circle is coincident with the machine base flat top surface; d) wherein the at least three rotary spindles are located with equal spaces between each of them and the spindle-tops' axes of rotation intersect the machine base spindle-circle and the rotary spindles are attached to the machine base top surface at those spindle-circle locations; e) wherein the at least three spindle-tops' flat surfaces are aligned to be co-planar with each other; f) providing a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about a floating, rotatable abrading platen rotation axis located at a rotational center of the floating, rotatable abrading platen by a spherical-action rotation device located at a rotational center of the floating, rotatable abrading platen and where the floating, rotatable abrading platen spherical-action rotation device restrains the floating, rotatable abrading platen in a radial direction relative to the floating, rotatable abrading platen axis of rotation and where the abrading platen axis of rotation is concentric with the machine base spindle-circle; g) spherically moving the floating, rotatable abrading platen about the abrading platen rotational center where the precision-flat annular abrading-surface of the floating, rotatable abrading platen that is supported by the floating, rotatable abrading platen spherical-action rotation device is nominally horizontal; and h) providing flexible abrasive disk articles having annular bands of abrasive coated surfaces that have an abrasive coated surface annular band radial width and an abrasive coated surface annular band inner radius and an abrasive coated surface annular band outer radius and attaching a selected flexible abrasive disk in flat conformal contact with a floating, rotatable abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk's abrasive coated annular abrading band and wherein the floating, rotatable abrading platen precision-flat annular abrading-surface provides conformal support of the full-abrasive-surface of the flexible abrasive disk's abrasive coated surface annular band where the floating, rotatable abrading platen precision-flat annular abrading-surface inner radius is less than the inner radius of the attached flexible abrasive disk's abrasive coated surface annular band and where the abrading platen precision-flat annular abrading-surface outer radius is greater than the outer radius of the attached flexible abrasive disk's abrasive coated surface annular band; i) attaching each flexible abrasive disk in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques; j) providing approximately equal thickness workpieces having parallel or near-parallel opposed flat workpiece top surfaces and flat workpiece bottom surfaces attached in flat-surfaced contact with the flat surfaces of respective at least three spindle-tops where the workpiece bottom surfaces contact the flat surfaces of the respective at least three spindle-tops; k) moving the floating, rotatable abrading platen vertically along the abrading platen rotation axis by the floating, rotatable abrading platen spherical-action rotation device to allow the abrasive surface of the flexible abrasive disk that is attached to the floating, rotatable abrading platen precision-flat annular abrading-surface to contact the top surfaces of the workpieces that are attached to the flat surfaces of the respective at least three spindle-tops wherein the at least three rotary spindles provide at least three-point support of the floating, rotatable abrading platen; and l) applying a total floating, rotatable abrading platen abrading contact force workpieces that are attached to the respective at least three spindle-top flat surfaces by contact of the abrasive surface of the flexible abrasive disk that is attached to the floating, rotatable abrading platen precision-flat annular abrading-surface with the top surfaces of the workpieces that are attached to the flat surfaces of the respective at least three spindle-tops, wherein the total floating abrading platen contact force is controlled through the floating, rotatable abrading platen spherical-action abrading platen rotation device to allow the total floating, rotatable abrading platen abrading contact force to be evenly distributed to the workpieces attached to the respective at least three spindle-tops; m) the at least three spindle-tops having the attached approximately equal thickness workpieces are rotated about the respective spindle-tops' rotation axes and the abrading platen having the attached flexible abrasive disk are rotated about the abrading platen rotation axis to single-side abrade the approximately equal thickness workpieces that are attached to the flat surfaces of the at least three spindle-tops while the moving abrasive surface of the flexible abrasive disk that is attached to the moving floating, rotatable abrading platen precision-flat annular abrading-surface is in force-controlled abrading contact with the top surfaces of the approximately equal thickness workpieces that are attached to the respective at least three spindle-tops and where the floating, rotatable abrading platen precision-flat annular abrading-surface assumes a co-planar alignment with the precisely co-planar flat surfaces of the respective at least three spindle-tops; n) installing selected abrasive disks comprising flexible abrasive disks, flexible raised-island abrasive disks, flexible abrasive disks having attached solid abrasive pellets, chemical mechanical planarization resilient disk pads, shallow-island abrasive disks, flat-surfaced slurry abrasive plate disks, non-abrasive cloth or material pads with an automated robotic device where the selected abrasive disks are attached to the floating, rotatable platen flat-surfaced abrading by picking selected individual abrasive disks from a corresponding abrasive disk storage device and transporting it to the platen abrading surface where the selected individual abrasive disk is positioned concentrically with the rotational center of the platen and the flexible abrasive disk is pressed conformably against the abrading surface of the floating, rotatable abrading platen wherein the abrasive disk is attached to the floating, rotatable abrading platen abrading surface with vacuum for abrading action on the workpieces by the abrading machine apparatus; o) wherein the automated robotic device sequentially removes selected abrasive disk from the flat abrading surface of the platen by picking the abrasive disk from the platen after the abrasive disk attachment vacuum is released and transporting the removed abrasive disk to an abrasive disk storage device for storage.

17. The process of claim 16 wherein the robotic abrasive disk loading apparatus selectively installs and removes abrasive disks to and from the platen of the at least three-point fixed-spindle floating-platen abrading machine apparatus wherein the at least three spindle-tops' flat surfaces are aligned to be co-planar with each other.

18. The process of claim 16 wherein the robotic abrasive disk loading apparatus selectively installs and removes abrasive disks to and from a platen of an at least three-point fixed-spindle floating-platen abrading machine apparatus having a machine base that has a machine base having a nominally-flat surface where the at least three rotary spindles are mechanically attached to the machine base nominally-flat top surface at respective at least three rotary spindles' spindle-circle locations by respective at least three rotary spindle-support adjustable-height mounting legs that are approximately equally spaced around the outer periphery of the rotary spindles to form at least three-point support of the at least three rotary spindles and wherein the at least three spindle-tops' flat surfaces are aligned to be co-planar with each other.

19. The process of claim 16 wherein the robotic abrasive disk loading apparatus selectively installs and removes abrasive disks to and from a platen of an at least three-point fixed-spindle floating-platen abrading machine apparatus comprising: a) a machine base having a nominally-flat surface; b) rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices have the capability to lock the respective rotatable spindle-mount spherical-action rotors to the respective stationary spindle-mount spherical-bases; c) wherein the at least three rotary spindles are located with approximately equal spacing between the at least three of the rotary spindles and that the at least three spindle-tops' axes of rotation intersect the machine base spindle-circle and the respective at least three rotary spindle two-piece spindle-mount devices' spindle-mount spherical-bases are mechanically attached to the machine base nominally-flat top surface at those respective at least three rotary spindles' spindle-circle locations; d) wherein the at least three spindle-tops' flat surfaces are aligned to be co-planar with each other by spherical rotation of the rotatable spindle-mount spherical-action rotors relative to the respective stationary spindle-mount spherical-bases; e) wherein rotary spindle two-piece spindle-mount devices' locking devices lock the respective rotatable spindle-mount spherical-action rotors to the respective stationary spindle-mount spherical-bases to structurally maintain the co-planar alignment of the at least three spindle-tops' flat surfaces.

20. The process of claim 16 wherein the at least three rotary spindles are air bearing rotary spindles.

* * * * *